US007229750B2

(12) United States Patent
Suzuki et al.

(10) Patent No.: US 7,229,750 B2
(45) Date of Patent: Jun. 12, 2007

(54) SILVER HALIDE EMULSION AND SILVER HALIDE PHOTOGRAPHIC LIGHT-SENSITIVE MATERIAL

(75) Inventors: Hiroyuki Suzuki, Minami-ashigara (JP); Masami Sakurada, Minami-ashigara (JP); Toshihiro Kariya, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/926,037

(22) Filed: Aug. 26, 2004

(65) Prior Publication Data

US 2005/0048424 A1 Mar. 3, 2005

(30) Foreign Application Priority Data

| | | |
|---|---|---|
| Aug. 28, 2003 | (JP) | 2003-305371 |
| Sep. 22, 2003 | (JP) | 2003-330632 |
| Sep. 22, 2003 | (JP) | 2003-330721 |
| Sep. 22, 2003 | (JP) | 2003-330739 |
| Sep. 24, 2003 | (JP) | 2003-331827 |
| Sep. 24, 2003 | (JP) | 2003-332308 |
| Sep. 24, 2003 | (JP) | 2003-332351 |

(51) Int. Cl.

| | |
|---|---|
| ***G03C 1/00*** | (2006.01) |
| ***G03C 1/06*** | (2006.01) |
| ***G03C 1/005*** | (2006.01) |
| ***G03C 1/494*** | (2006.01) |

(52) U.S. Cl. ..... 430/598; 430/599; 430/607; 430/567; 430/550

(58) Field of Classification Search ..... 430/598, 430/599, 603, 567, 607, 550

See application file for complete search history.

(56) References Cited

U.S. PATENT DOCUMENTS

| | | | |
|---|---|---|---|
| 5,028,522 | A | 7/1991 | Kojima et al. |
| 5,393,655 | A | 2/1995 | Sasaki et al. |
| 5,547,829 | A | 8/1996 | Kojima et al. |
| 6,673,531 | B2 | 1/2004 | Suzuki et al. |

FOREIGN PATENT DOCUMENTS

| | | |
|---|---|---|
| JP | 4-271341 | 9/1992 |
| JP | 7-140579 | 6/1995 |
| JP | 7-301879 | 11/1995 |
| JP | 9-197603 | 7/1997 |
| JP | 2001-75215 | 3/2001 |
| JP | 2002-268170 | 9/2002 |

*Primary Examiner*—Geraldina Visconti
(74) *Attorney, Agent, or Firm*—Sughrue Mion, PLLC

(57) ABSTRACT

A silver halide emulsion chemically sensitized by a compound of formula (1), (6-1), (6-2) or (7); and a silver halide photographic light-sensitive material containing the silver halide emulsion:

| | |
|---|---|
| Formula (1) | $E^1$-Ch-$E^2$ |
| Formula (6-1) | $W^1 \ldots AuX^2{}_m$ |
| Formula (6-2) | $[W^1 \ldots Au \ldots W^2]X^2{}_m$ |
| Formula (7) | $E^5$-Ch-Au . . . $(L^2)_1$ |

wherein Ch is a sulfur, selenium or tellurium atom; $E^1$, $E^2$, and $E^5$ each are, for example, a specific methylene group having a substituent; Au is a monovalent or trivalent gold ion; $W^1$ and $W^2$ each are a specific chalcogen compound; $X^2$ is a monovalent anion; m is 1, 2 or 3; $L^2$ is a compound that can coordinate with gold through a nitrogen, sulfur, selenium, tellurium or phosphorous atom; and l is 0, 1, 2 or 3.

11 Claims, No Drawings

SILVER HALIDE EMULSION AND SILVER HALIDE PHOTOGRAPHIC LIGHT-SENSITIVE MATERIAL

FIELD OF THE INVENTION

The present invention relates to a silver halide emulsion.

Further, the present invention relates to a silver halide photographic light-sensitive material, and specifically to a silver halide photographic light-sensitive material, which is achieved by using a specific chalcogen compound, which is high in sensitivity and low in fogging, and which is less in occurrence of fogging and in variation of photographic properties after storage.

BACKGROUND OF THE INVENTION

Silver halide emulsions for use in silver halide photographic light-sensitive materials are, in general, chemically sensitized by using various chemical substances to obtain, for example, desired sensitivity and gradation. As typical methods for the chemical sensitization, various sensitizing methods, such as sulfur sensitization, selenium sensitization, tellurium sensitization; noble metal sensitization using, for example, gold, and combinations of these sensitizing methods, are known. Various improvements in the aforementioned sensitizing methods have been recently made to cope with a strong need, for example, for excellent granularity, high sharpness, and high sensitivity of silver halide photographic light-sensitive materials, and further rapid processing promoted by accelerating development.

It is known that a serenocarboxylate; namely, a sereno ester, may be used as a selenium sensitizer in a selenium sensitization among the aforementioned sensitizing methods. Examples of disclosures showing specific compounds include U.S. Pat. No. 3,297,446, U.S. Pat. No. 3,297,447, and JP-B-57-22090 ("JP-B" means examined Japanese patent publication).

Although there is the case in which the selenium sensitizer has a greater sensitizing effect than a sulfur sensitizer used in the fields of the art, such a sensitizer largely tends to cause much fogging, to result softened gradation, and to cause increased variation of sensitivity during storage. Many patent publications have been disclosed aiming to improve these drawbacks. However, satisfactory results have not yet been brought by these improvements, and there has been a strong need for basic improvement; in particular, for greater suppression of the occurrence of fogging. Also, if sulfur sensitization, selenium sensitization, or tellurium sensitization is used in combination with gold sensitization, respectively, sensitivity is significantly increased in each case. However, fogging is increased at the same time. Although, particularly, gold-selenium sensitization and gold-tellurium sensitization result in greater sensitivity than gold-sulfur sensitization, they also result in much fogging, and they are apt to result increased gradation softness. There remains, therefore, a strong need for development of a selenium sensitizer and a tellurium sensitizer that give increased sensitivity, less fogging, and increased gradation hardness.

In this situation, the following compounds are described as examples of useful selenium sensitizers: diacyl serenide compounds, as described in JP-A-4-271341 ("JP-A" means unexamined published Japanese patent application); compounds in which two carbonyl groups are bonded with a selenium atom, as described in JP-A-5-11385; and selenocarboxylic acid (Se-ester) compounds, as described in JP-A-7-140579. Although these compounds are disclosed to enable suppressing fogging to a low level and achieving high sensitivity, they nonetheless remain unsatisfactory, and compounds that can better suppress fogging and attain higher sensitivity have been desired.

A known chemical sensitizer used is a compound in which gold (I) ion is coordinated with a selenourea, as a known selenium sensitizer. Example references disclosing specific examples of the compound include JP-A-2001-75215, JP-A-2001-75216, and JP-A-2001-75217. Although the aforementioned drawbacks can be improved using such a compound, its effect remains insufficient. It is also disclosed, in JP-A-9-269554, that compounds in which gold (III) ion is coordinated with phosphine selenides as known selenium sensitizers, are used as a chemical sensitizer. However, the effect remains insufficient. Moreover, a gold (I) halide compound coordinated with a chalcogeno ether compound is also disclosed, in JP-A-2002-268170. However, the level reached by this gold halide compound is likewise insufficient.

Further, a gold (I) compound (hereinafter referred to as a meso-ion gold (I) compound) containing a meso-ion ligand is known as a gold compound for use in gold sensitization. It is disclosed, in JP-A-4-267249, that the meso-ion gold (I) compound is useful to produce a highly sensitive and hard gradation (contrast) emulsion. It is, however, known that the meso-ion gold (I) compound has a problem concerning stability in a solution, as disclosed in JP-A-11-218870. It has been desired to improve the stability of the meso-ion gold (I) compound, because stability in solution is an essential condition to produce a light-sensitive emulsion having constant qualities, stably.

As a measure to solve this problem, a method of utilizing a gold (I) complex of a mercapto compound is proposed in JP-A-11-218870. Although this gold sensitizer has improved stability in a solution, it is still a compound that will be decomposed, and it remains only an insufficient solving measure.

It is also known that many selenium compounds and tellurium compounds generally have lower stability than corresponding sulfur compounds. Not a few selenium compounds and tellurium compounds to be used as chemical sensitizers have less comparative stability. When these compounds are stored in a solution state, they resultantly gradually decompose. There is, therefore, a tendency for there to be a large difference in sensitivity, fogging, gradation, and the like, between the case of producing a light-sensitive emulsion just after a solution of a selenium compound or a tellurium compound is prepared, and the case of producing a light-sensitive emulsion a while after the solution is prepared. Therefore, chemical sensitizers that suppress fogging to attain high sensitivity are desired to have higher stability.

In this background, there is strong need for development of a gold-chalcogen sensitizer that can largely increase the sensitivity and causes less occurrence of fogging.

SUMMARY OF THE INVENTION

The present invention resides in a silver halide emulsion, which is chemically sensitized by a compound represented by formula (1):

$$E^1\text{-Ch-}E^2 \qquad \text{Formula (1)}$$

wherein, in formula (1), Ch represents a sulfur atom, a selenium atom or a tellurium atom; $E^1$ is a group selected from groups represented by formula (2), (3), (4) or (5); and $E^2$ is a group selected from groups represented by formula (3), (4) or (5);

Formula (2)

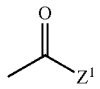

Formula (3)

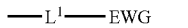

Formula (4)

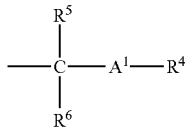

Formula (5)

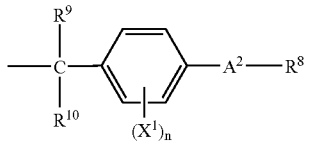

wherein, in formula (2), $Z^1$ represents an alkyl group, an alkenyl group, an alkynyl group, an aryl group, a heterocyclic group, $OR^1$, or $NR^2R^3$, in which $R^1$, $R^2$ and $R^3$ each independently represent an alkyl group, an alkenyl group, an alkynyl group, an aryl group or a heterocyclic group;

wherein, in formula (3), L1 represents a divalent linking group; and EWG represents an electron withdrawing group;

wherein, in formula (4), $A^1$ represents an oxygen atom, a sulfur atom, or $NR^7$; and $R^4$, $R^5$, $R^6$ and $R^7$ each independently represent a hydrogen atom, an alkyl group, an alkenyl group, an alkynyl group, an aryl group, or a heterocyclic group; or $R^4$ and $R^5$, $R^4$ and $R^6$ or $R^4$ and $R^7$ may bond together to form a ring;

wherein, in formula (5), $A^2$ represents an oxygen atom, a sulfur atom, or $NR^{11}$; $R^8$ represents a hydrogen atom, an alkyl group, an alkenyl group, an alkynyl group, an aryl group, a heterocyclic group, or an acyl group; $R^9$, $R^{10}$, and $R^{11}$ each independently represent a hydrogen atom, an alkyl group, an alkenyl group, an alkynyl group, an aryl group, or a heterocyclic group; $X^1$ represents a substituent; n is an integer from 0 to 4; when n is 2 or more, $X^1$s may be the same or different;

wherein when $E^1$ and $E^2$ each represent a group represented by the same formula, $E^1$ and $E^2$ may be the same or different; and wherein when $E^1$ is a group represented by formula (2), $E^2$ is not a group represented by formula (3).

Further, the present invention resides in a silver halide emulsion, which is chemically sensitized by a gold compound represented by formula (6-1) or (6-2):

$$W^1 \ldots AuX^2_m \quad \text{Formula (6-1)}$$

$$[W^1 \ldots Au \ldots W^2]X^2_m \quad \text{Formula (6-2)}$$

wherein, in formulas (6-1) and (6-2), Au represents a monovalent or trivalent gold ion; $W^1$ is a compound represented by a formula selected from formula (S1), (S2) or (S3); $W^1$ coordinates with the Au through the Ch; when Au represents a trivalent gold ion, $W^1$ is a compound represented by a formula selected from formula (S1) or (S3); $W^2$ is a compound represented by formula (S3); $W^2$ coordinates with the Au through the Ch; $X^2$ represents a monovalent anion; and m is an integer from 1 to 3;

Formula (S1)

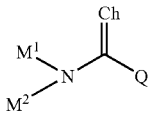

Formula (S2)

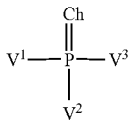

Formula (S3)

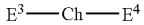

wherein, in formula (S1), Ch represents a sulfur atom, a selenium atom or a tellurium atom; $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group or a carbamoyl group; Q represents an alkyl group, an alkenyl group, an alkynyl group, an aryl group, a heterocyclic group, $OM^3$, or $NM^4M^5$; $M^3$, $M^4$ and $M^5$ each independently represent a hydrogen atom, an alkyl group, an alkenyl group, an alkynyl group, an aryl group or a heterocyclic group; and any two groups of $M^1$, $M^2$ and Q may bond together, to form a cyclic structure;

wherein, in formula (S2), Ch represents a sulfur atom, a selenium atom or a tellurium atom; $V^1$, $V^2$ and $V^3$ each independently represent a hydrogen atom, an alkyl group, an alkenyl group, an alkynyl group, an aryl group, a heterocyclic group, $OJ^1$, or $NJ^2J^3$; and $J^1$, $J^2$ and $J^3$ each independently represent a hydrogen atom, an alkyl group, an alkenyl group, an alkynyl group, an aryl group or a heterocyclic group; and wherein, in formula (S3), Ch represents a sulfur atom, a selenium atom or a tellurium atom; and $E^3$ and $E^4$, which may be the same or different, each represent a group represented by a formula selected from formulae (2) to (5).

Further, the present invention resides in a silver halide emulsion, which is chemically sensitized by a compound represented by formula (7):

$$E^5\text{-Ch-Au} \ldots (L^2)_l \quad \text{Formula (7)}$$

wherein, in formula (7), Au represents a monovalent or trivalent gold ion; Ch represents a sulfur atom, a selenium atom or a tellurium atom; $E^5$ is a group selected from groups represented by formula (5); $L^2$ represents a compound which can coordinate with gold through a nitrogen atom, sulfur atom, selenium atom, tellurium atom or phosphorous atom; and l is an integer from 0 to 3.

Further, the present invention resides in a silver halide photographic light-sensitive material, which comprises: at least one silver halide emulsion layer on a support, wherein at least one layer of the silver halide emulsion layers contains the silver halide emulsion chemically sensitized by using at least one of the compounds represented by formula (1), (6-1), (6-2) or (7).

Other and further features and advantages of the invention will appear more fully from the following description.

DETAILED DESCRIPTION OF THE INVENTION

According to the present invention, there is provided the following means:

(1) A silver halide emulsion, which is chemically sensitized by a compound represented by formula (1):

$$E^1\text{-Ch-}E^2 \qquad \text{Formula (1)}$$

wherein, in formula (1), Ch represents a sulfur atom, a selenium atom or a tellurium atom; $E^1$ is a group selected from groups represented by formula (2), (3), (4) or (5); and $E^2$ is a group selected from groups represented by formula (3), (4) or (5);

Formula (2)

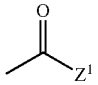

Formula (3)

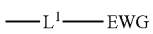

Formula (4)

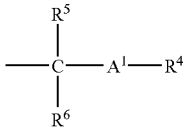

Formula (5)

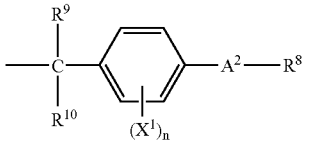

wherein, in formula (2), $Z^1$ represents an alkyl group, an alkenyl group, an alkynyl group, an aryl group, a heterocyclic group, $OR^1$, or $NR^2R^3$; in which $R^1$, $R^2$ and $R^3$ each independently represent an alkyl group, an alkenyl group, an alkynyl group, an aryl group or a heterocyclic group;

wherein, in formula (3), L1 represents a divalent linking group; and EWG represents an electron withdrawing group;

wherein, in formula (4), $A^1$ represents an oxygen atom, a sulfur atom, or $NR^7$; and $R^4$, $R^5$, $R^6$ and $R^7$ each independently represent a hydrogen atom, an alkyl group, an alkenyl group, an alkynyl group, an aryl group, or a heterocyclic group; or $R^4$ and $R^5$, $R^4$ and $R^6$ or $R^4$ and $R^7$ may bond together to form a ring;

wherein, in formula (5), $A^2$ represents an oxygen atom, a sulfur atom, or $NR^{11}$; $R^8$ represents a hydrogen atom, an alkyl group, an alkenyl group, an alkynyl group, an aryl group, a heterocyclic group, or an acyl group; $R^9$, $R^{10}$, and $R^{11}$ each independently represent a hydrogen atom, an alkyl group, an alkenyl group, an alkynyl group, an aryl group, or a heterocyclic group; $X^1$ represents a substituent; n is an integer from 0 to 4; when n is 2 or more, $X^1$s may be the same or different;

wherein when $E^1$ and $E^2$ each represent a group represented by the same formula, $E^1$ and $E^2$ may be the same or different; and wherein when $E^1$ is a group represented by formula (2), $E^2$ is not a group represented by formula (3);

(2) The silver halide emulsion according to the above item (1), wherein, in formula (1), $E^1$ is a group selected from groups represented by formula (2), (3), (4) or (5), and $E^2$ is a group selected from groups represented by formula (5);

(3) The silver halide emulsion according to the above item (1), wherein, in formula (1), $E^1$ is a group selected from groups represented by formula (3), (4) or (5), and $E^2$ is a group selected from groups represented by formula (5);

(4) The silver halide emulsion according to the above item (1), wherein, in formula (1), Ch is a selenium atom or a tellurium atom;

(5) The silver halide emulsion according to the above item (1), wherein, in formula (1), Ch is a selenium atom;

(6) The silver halide emulsion according to the above item (1), wherein, in formula (1), $E^1$ is a group selected from groups represented by formula (4) or (5), and $E^2$ is a group selected from groups represented by formula (5);

(7) The silver halide emulsion according to the above item (1), wherein, in formula (1), $E^1$ and $E^2$ each are a group selected from groups represented by formula (5);

(8) The silver halide emulsion according to the above item (1), wherein, in formula (1), $E^1$ is a group selected from groups represented by formula (2) or (4), and $E^2$ is a group selected from groups represented by formula (4), provided that $R^4$ in formula (4) of $E^2$ is not an alkyl halide group (a halogenated alkyl group);

(9) The silver halide emulsion according to the above item (8), wherein, in formula (1), Ch is a selenium atom;

(10) The silver halide emulsion according to the above item (8), wherein, in formula (1), $E^1$ is a group selected from groups represented by formula (4);

(11) The silver halide emulsion according to the above item (1), wherein, in formula (1), $E^1$ is a group selected from groups represented by formula (3), and $E^2$ is a group selected from groups represented by formula (3) or (4);

(12) The silver halide emulsion according to the above item (11), wherein, in formula (1), Ch is a selenium atom;

(13) The silver halide emulsion according to the above item (11), wherein, in formula (1), $E^2$ is a group selected from groups represented by formula (4);

(14) The silver halide emulsion according to the above item (1), wherein, in formula (3), the divalent linking group represented by $L^1$ is represented by formula (LA) or (LB):

Formula (LA)

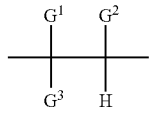

Formula (LB)

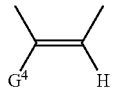

in which, in formulae (LA) and (LB), $G^1$, $G^2$, $G^3$ and $G^4$ each independently represent a hydrogen atom, an alkyl group, an aryl group, or a heterocyclic group; $G^1$ and $G^2$, or $G^2$ and $G^3$ may bond together to form a ring; or EWG and any of $G^1$ to $G^3$ may bond together to form a ring;

(15) A silver halide emulsion, which is chemically sensitized by a gold compound represented by formula (6-1) or (6-2):

$$W^1 \ldots AuX^2_m \qquad \text{Formula (6-1)}$$

$$[W^1 \ldots Au \ldots W^2]X^2_m \qquad \text{Formula (6-2)}$$

wherein, in formulas (6-1) and (6-2), Au represents a monovalent or trivalent gold ion; $W^1$is a compound represented by a formula selected from formula (S1), (S2) or (S3); $W^1$ coordinates with the Au through the Ch; when Au represents a trivalent gold ion, $W^1$ is a compound represented by a formula selected from formula (S1) or (S3); $W^2$ is a compound represented by formula (S3); $W^2$ coordinates with the Au through the Ch; $X^2$ represents a monovalent anion; and m is an integer from 1 to 3;

Formula (S1)

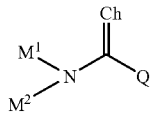

Formula (S2)

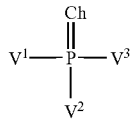

Formula (S3)

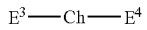

wherein, in formula (S1), Ch represents a sulfur atom, a selenium atom or a tellurium atom; $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group or a carbamoyl group; Q represents an alkyl group, an alkenyl group, an alkynyl group, an aryl group, a heterocyclic group, $OM^3$, or $NM^4M^5$; $M^3$, $M^4$ and $M^5$ each independently represent a hydrogen atom, an alkyl group, an alkenyl group, an alkynyl group, an aryl group or a heterocyclic group; and any two groups of $M^1$, $M^2$ and Q may bond together, to form a cyclic structure;

wherein, in formula (S2), Ch represents a sulfur atom, a selenium atom or a tellurium atom; $V^1$, $V^2$ and $V^3$ each independently represent a hydrogen atom, an alkyl group, an alkenyl group, an alkynyl group, an aryl group, a heterocyclic group, $OJ^1$, or $NJ^2J^3$; and $J^1$, $J^2$ and $J^3$ each independently represent a hydrogen atom, an alkyl group, an alkenyl group, an alkynyl group, an aryl group or a heterocyclic group;

wherein, in formula (S3), Ch represents a sulfur atom, a selenium atom or a tellurium atom; and $E^3$ and $E^4$, which may be the same or different, each represent a group represented by a formula selected from formulae (2) to (5);

(16) The silver halide emulsion according to the above item (15), wherein, in formulae (6-1) and (6-2), Au is a monovalent gold ion;

(17) The silver halide emulsion according to the above item (15), wherein, in formulae (6-1) and (6-2), $W^1$ is a compound represented by a formula selected from formula (S1) or (S3);

(18) The silver halide emulsion according to the above item (15), wherein, in formula (S1), Ch is a sulfur atom or a selenium atom;

(19) The silver halide emulsion according to the above item (15), wherein, in formula (S3), Ch is a selenium atom or a tellurium atom;

(20) The silver halide emulsion according to the above item (15), wherein, in formulae (6-1) and (6-2), the monovalent anion represented by $X^2$ is a halogen ion, a tetrafluoroboronate ion, a hexafluorophosphonate ion, a hexafluoroantimonate ion, an arylsulfonate ion, an alkylsulfonate ion, or a carboxy ion;

(21) A silver halide emulsion, which is chemically sensitized by a compound represented by formula (7):

$$E^5\text{-Ch-Au} \ldots (L^2)_l \qquad \text{Formula (7)}$$

wherein, in formula (7), Au represents a monovalent or trivalent gold ion; Ch represents a sulfur atom, a selenium atom or a tellurium atom; $E^5$ is a group selected from groups represented by formula (5); $L^2$ represents a compound which can coordinate with gold through a nitrogen atom, sulfur atom, selenium atom, tellurium atom or phosphorous atom; and l is an integer from 0 to 3;

(22) The silver halide emulsion according to the above item (21), wherein, in formula (7), $L^2$ is a compound represented by a formula selected from formula (S1), (S2) or (S3);

(23) The silver halide emulsion according to the above item (21), wherein, in formula (7), Au is a monovalent gold ion;

(24) The silver halide emulsion according to the above item (21), wherein, in formula (7), Ch represents a sulfur atom or a selenium atom;

(25) A silver halide photographic light-sensitive material, comprising:

at least one silver halide emulsion layer on a support, wherein at least one layer of the silver halide emulsion layers contains a silver halide emulsion, the silver halide emulsion being chemically sensitized by using at least one of the compounds represented by formula (1), (6-1), (6-2) or (7); and

(26) A method of chemically sensitizing a silver halide emulsion, comprising:

using at least one of the compounds represented by formula (1), (6-1), (6-2) or (7).

Hereinbelow, some embodiments according to the present invention will be explained in detail.

The silver halide photographic light-sensitive material of the present invention is provided with at least one silver halide emulsion layer on a support. In such a silver halide photographic light-sensitive material, at least one layer of silver halide emulsion layer(s) is chemically sensitized by using a compound represented by formula (1), (6-1), (6-2), or (7), thereby a silver halide photographic light-sensitive material that has high sensitivity and low fogging; that is reduced in increased fogging during storage, and/or that is reduced in sensitivity variation caused by a difference in humidity condition at the time of exposure, is obtained. Although a silver halide photographic light-sensitive material having a silver halide emulsion sensitized by a selenium sensitizer usually tends to have softened gradation, with use of the compound according to the present invention, the light-sensitive material has such an unexpected effect that gradation is hard.

The compound represented by formula (1) for use in the present invention is described in detail below.

In formula (1), Ch represents a sulfur atom, a selenium atom or a tellurium atom. Among these, in the present invention, Ch is preferably a selenium atom or a tellurium atom, and more preferably a selenium atom.

Next, formula (2) is explained.

In formula (2), $Z^1$ represents an alkyl group, an alkenyl group, an alkynyl group, an aryl group, a heterocyclic group, —$OR^1$, or —$NR^2R^3$. $R^1$, $R^2$ and $R^3$ each independently represent an alkyl group, an alkenyl group, an alkynyl group, an aryl group, or a heterocyclic group. Hereinafter, the term "alkyl group" means a straight-chain, branched or cyclic, substituted or unsubstituted alkyl group. Preferred examples thereof include a straight-chain or branched, substituted or unsubstituted alkyl group having 1 to 30 carbon atoms (e.g., a methyl group, an ethyl group, an isopropyl group, a n-propyl group, a n-butyl group, a t-butyl group, a 2-pentyl group, a n-hexyl group, a n-octyl group, a t-octyl group, a 2-ethylhexyl group, a 1,5-dimethylhexyl group, a n-decyl group, a n-dodecyl group, a n-tetradecyl group, a n-hexadecyl group, a hydroxyethyl group, a hydroxypropyl group, a 2,3-dihydroxypropyl group, a carboxymethyl group, a carboxyethyl group, a sodiumsulfoethyl group, a diethylaminoethyl group, a diethylaminopropyl group, a butoxypropyl group, an ethoxyethoxyethyl group and a n-hexyloxypropyl group); a substituted or unsubstituted cycloalkyl group having 3 to 18 carbon atoms (e.g., a cyclopropyl group, a cyclopentyl group, a cyclohexyl group, a cyclooctyl group, an adamanthyl group, and a cyclododecyl group); a substituted or unsubstituted bicycloalkyl group having 5 to 30 carbon atoms (that is, a monovalent group formed by removing one hydrogen atom from a bicycloalkane having 5 to 30 carbon atoms, e.g., a bicyclo[1,2,2]heptane-2-yl group, a bicyclo[2,2,2]octane-3-yl group); and a tricycloalkyl group and the like, which may have more ring structures. Examples of the alkenyl group include an alkenyl group having 2 to 16 carbon atoms (e.g., an allyl group, a 2-butenyl group and a 3-pentenyl group). Examples of the alkynyl group include an alkynyl group having 2 to 10 carbon atoms (e.g., a propargyl group, and a 3-pentynyl group). Preferred examples of the aryl group include a substituted or unsubstituted aryl group having 6 to 30 carbon atoms; e.g., phenyl, p-tolyl, naphthyl, m-chlorophenyl, o-hexadecanoylaminophenyl. The heterocyclic group means a 5- to 7-membered, substituted or unsubstituted, and saturated or unsaturated heterocyclic group containing at least one nitrogen, oxygen or sulfur atom. These may be monocyclic, or further form a condensed ring together with other aryl or heterocyclic ring. Preferable examples of the heterocyclic group include a 5- to 6-membered heterocyclic group, e.g. a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, quinolyl group, an isoquinolyl group, an indolyl group, an indazolyl group, a benzoimidazolyl group, a furyl group, a pyranyl group, a chromenyl group, a thienyl, an oxazolyl group, an oxadiazolyl group, a thiazolyl group, a thiadiazolyl group, a benzoxazolyl group, a benzothiazolyl group, a morpholino group, and a morpholinyl group.

$Z^1$, and $R^1$ to $R^3$ each may have a substituent. Examples of the substituent include a halogen atom (e.g. fluorine atom, chlorine atom, bromine atom, and iodine atom), an alkyl group, an alkenyl group, an alkynyl group, an aryl group, a heterocyclic group, an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group (including its salt), an oxalyl group, an oxamoyl group, a cyano group, a formyl group, a hydroxy group, an alkoxy group (including a group containing an ethyleneoxy group or propyleneoxy group unit repeatedly), an aryloxy group, a heterocyclic oxy group, an acyloxy group, an alkoxycarbonyloxy group, an aryloxycarbonyloxy group, a carbamoyloxy group, a sulfonyloxy group, a silyloxy group, a nitro group, an amino group, an alkyl-, aryl- or heterocyclic-amino group, an acylamino group, a sulfonamido group, a ureido group, a thioureido group, an N-hydroxyureido group, an imido group, an alkoxycarbonylamino group, an aryloxycarbonylamino group, a sulfamoylamino group, a semicarbazide group, a thiosemicarbazide group, a hydrazino group, an ammonio group, an oxamoylamino group, an N-(alkyl or aryl)-sulfonylureido group, an N-acylureido group, an N-acylsulfamoylamino group, a hydroxyamino group, a heterocyclic group containing a quaternary nitrogen atom (e.g., a pyridinio group, an imidazolio group, a quinolinio group and an isoquinolinio group), an isocyano group, an imino group, an alkylthio group, an arylthio group, a heterocyclic thio group, an alkyl-, aryl- or heterocyclic-dithio group, an alkyl- or arylsulfonyl group, an alkyl- or aryl-sulfinyl group, a sulfo group (including its salt), a sulfamoyl group, an N-acylsulfamoyl group, an N-sulfonylsulfamoyl group (including its salt), and a silyl group. Herein, the term "salt" means salts of a cation, such as an alkali metal, alkali earth metal and heavy metal, or of an organic cation, such as an ammonium ion and phosphonium ion.

In formula (2), in the present invention, $Z^1$ is preferably an alkyl group, an aryl group, or a heterocyclic group; and more preferably an alkyl group or an aryl group.

Next, formula (3) will be explained. In formula (3), the divalent linking group represented by $L^1$ preferably represents an aliphatic group having 2 to 20 carbon atoms; more preferably represents a straight-chain, branched or cyclic alkylene group having 2 to 10 carbon atoms (e.g., ethylene, propylene, cyclopentylene and cyclohexylene), an alkenylene group (e.g., vinylene), or an alkynylene group (e.g., propynylene); and is further preferably represents a group of the formula (LA) or (LB).

In formulae (LA) and (LB), $G^1$ to $G^4$ each independently represent a hydrogen atom, an alkyl group having 1 to 10 carbon atoms, an aryl group having 6 to 20 carbon atoms, or a heterocyclic group having 1 to 10 carbon atoms. $G^1$ to $G^4$ each may have a substituent. Examples of the substituent include the same substituents mentioned in the above. $G^1$ and $G^2$, or $G^2$ and $G^3$ may bond together, to form a ring. $G^1$ to $G^4$ each are preferably a hydrogen atom, an alkyl group or an aryl group, and more preferably a hydrogen atom or an alkyl group. Moreover, the case where $G^1$ and $G^2$, or $G^2$ and $G^3$ bond together to form a ring, is still more preferable.

In formula (3), EWG represents an electron-withdrawing group. The term "electron-withdrawing group" so-called herein means a group having a positive value of Hammett's substituent constant $\sigma_m$ value (or $\sigma_p$ value), and preferably a $\sigma_m$ value of 0.12 or more (or a $\sigma_p$ value of 0.2 or more), with its upper limit being 1.0 or less. Specific examples of the electron-withdrawing group having a positive $\sigma_m$ value, include an alkoxy group (preferably an alkoxy group substituted with at least two or more halogen atoms), an aryloxy group (preferably an aryloxy group substituted with at least two or more halogen atoms), an alkylthio group (preferably an alkylthio group substituted with at least two or more halogen atoms), an arylthio group (preferably an arylthio group substituted with at least two or more halogen atoms), an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an imino group, an imino group substituted with an N atom, a carboxy group (or its salt), an alkyl group substituted with at least two or more halogen atoms, an acylamino group, an alkylamino group substituted with at least two or more halogen atoms, an aryl group substituted with other electron withdrawing group having a positive $\sigma_m$ value, a heterocyclic group, a halogen atom, an azo group, and a selenocyanate group. In the present invention, EWG is preferably an acyl group, a formyl group, an alkoxy group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom, a phosphoryl group, a carboxy group (or its salt), an alkyl group substituted with at least two or more halogen atoms, an aryl group substituted with other electron withdrawing group having a positive $\sigma_m$ value, a heterocyclic group, or a halogen atom; more preferably an acyl group, a formyl group, a carbamoyl group, an alkoxycarbonyl group, an aryloxycarbonyl group, a cyano group, a nitro group, an alkylsulfonyl group, an arylsulfonyl group, a carboxy group (or its salt), or an alkyl group substituted with at least two or more halogen atoms; and further preferably an acyl group, a formyl group, a cyano group, a nitro group, an alkylsulfonyl group, an arylsulfonyl group, or an alkyl group substituted with at least two or more halogen atoms.

In formula (3), EWG and any of $G^1$ to $G^3$ may bond together, to form a ring.

In formula (3), in the present invention, it is preferable that $L^1$ is represented by formula (LA) or (LB); $G^1$ to $G^4$ each are a hydrogen atom, an alkyl group or an aryl group; and EWG is an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms. It is more preferable that $L^1$ is represented by formula (LA); $G^1$ to $G^3$ each are a hydrogen atom, an alkyl group or an aryl group; and EWG is an acyl group, a formyl group, an alkoxy group, a cyano group, a nitro group, an alkylsulfonyl group, an arylsulfonyl group, or an alkyl group substituted with at least two or more halogen atoms. It is further preferable that $L^1$ is represented by formula (LA); $G^1$ to $G^3$ each are a hydrogen atom or an alkyl group; and EWG is an acyl group, a formyl group, an alkoxy group, a cyano group, a nitro group, an alkylsulfonyl group, an arylsulfonyl group, or an alkyl group substituted with at least two or more halogen atoms.

Next, formula (4) will be explained. In formula (4), $R^4$ to $R^7$ each independently represent a hydrogen atom, an alkyl group, an alkenyl group, an alkynyl group, an aryl group or a heterocyclic group. The alkyl group so-called herein has the same meaning as the aforementioned alkyl group, and the preferable range is also the same. Likewise, the alkenyl group, alkynyl group, aryl group and heterocyclic group have the same meanings as the aforementioned alkenyl group, alkynyl group, aryl group and heterocyclic group, respectively; and the preferable ranges are also the same.

$R^4$ and $R^5$, $R^4$ and $R^6$, or $R^4$ and $R^7$ may bond together, to form a ring.

In the present invention, $R^4$ is preferably an alkyl group. $R^5$ and $R^6$ each are preferably a hydrogen atom, an alkyl group or an aryl group, and more preferably a hydrogen atom or an alkyl group. The case where one of $R^5$ and $R^6$ is a hydrogen atom and the other is a hydrogen atom or an alkyl group is still more preferable. $R^7$ is preferably a hydrogen atom, an alkyl group or an aryl group, more preferably a hydrogen atom or an alkyl group, and still more preferably an alkyl group.

In formula (4), $A^2$ represents an oxygen atom, a sulfur atom, or $NR^7$. In the present invention, $A^2$ is preferably an oxygen atom or a sulfur atom, and more preferably an oxygen atom.

In formula (4), in the present invention, it is preferable that $A^1$ represents an oxygen atom or a sulfur atom; $R^4$ represents an alkyl group or an aryl group; and $R^5$ and $R^6$ each represent a hydrogen atom, an alkyl group, an aryl group or a heterocyclic group. It is more preferable that $A^1$ represents an oxygen atom or a sulfur atom; $R^4$ is an alkyl group or an aryl group; and $R^5$ and $R^6$ each are a hydrogen atom or an alkyl group. It is further preferable that $A^1$ represents an oxygen atom; $R^4$ is an alkyl group; and $R^5$ and $R^6$ each are a hydrogen atom or an alkyl group.

Next, formula (5) will be explained. In formula (5), the alkyl group, alkenyl group, alkynyl group, aryl group and heterocyclic group represented by $R^8$ to $R^{11}$ have the same meanings as those mentioned above, respectively; and the preferable ranges are also the same. The acyl group represented by $R^8$ is preferably a substituted or unsubstituted acyl group having 2 to 30 carbon atoms, and examples of the acyl group include an acetyl group, pivaloyl group, 2-chloroacetyl group, stearoyl group, benzoyl group and p-n-octyloxyphenylcarbonyl group.

In the present invention, $R^8$ is preferably a hydrogen atom, an alkyl group, an aryl group or an acyl group; more preferably a hydrogen atom, an alkyl group or an acyl group; and further preferably an alkyl group. $R^9$ and $R^{10}$ each are preferably a hydrogen atom, an alkyl group or an aryl group, more preferably a hydrogen atom or an alkyl group, and still more preferably the case where one of $R^9$ and $R^{10}$ is a hydrogen atom and the other is a hydrogen atom or an alkyl group. $R^{11}$ is preferably a hydrogen atom, an alkyl group or an aryl group; more preferably a hydrogen atom or an alkyl group; and further preferably an alkyl group.

In formula (5), $A^2$ represents an oxygen atom, a sulfur atom, or $NR^{11}$. Among these, in the present invention, $A^2$ is preferably an oxygen atom or a sulfur atom, and more preferably an oxygen atom.

In formula (5), $X^1$ represents a substituent. Examples of the substituent include the same as those described above. In the present invention, preferable examples of $X^1$ include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, N-sulfamoylcarbamoyl group, a carbazoyl group, a carboxy group including a salt thereof, a cyano group, a formyl group, a hydroxy group, an alkoxy group, an aryloxy group, a heterocyclic oxy group, an acyloxy group, a nitro group, an amino group, an alkyl-, aryl- or heterocyclic-amino group, an acylamino group, a sulfonamido group, a ureido group, a thioureido group, an alkylthio group, an arylthio group, a heterocyclic thio group, an alkyl- or aryl-sulfonyl group, an alkyl- or aryl-sulfinyl group, a sulfo group including a salt thereof, and a sulfamoyl group. More preferable examples thereof include a halogen atom, an alkyl group, an aryl group, a heterocyclic group, a carboxy group including a salt thereof, a hydroxy group, an alkoxy group, an aryloxy group, a heterocyclic oxy group, an acyloxy group, an amino group, an alkyl-, aryl- or heterocyclic-amino group, an acylamino group, a ureido group, a thioureido group, an alkylthio group, an arylthio group, a heterocyclic thio group, and a sulfo group including a salt thereof. Further more preferred examples thereof include an alkyl group, an aryl group, a carboxy group including a salt thereof, a hydroxy group, an alkoxy group, an aryloxy group, an alkyl-, aryl- or heterocyclic-amino group, an acylamino group, a ureido group, an alkylthio group, an arylthio group, and a sulfo group including a salt thereof.

In formula (5), n represents an integer of from 0 to 4. In the present invention, n is preferably an integer of from 0 to 2, and more preferably an integer of 0 or 1.

In formula (5), in the present invention, it is preferable that $A^2$ is an oxygen atom or a sulfur atom; $R^8$ is a hydrogen atom, an alkyl group, an aryl group or an acyl group; $R^9$ and $R^{10}$ each are a hydrogen atom, an alkyl group or an aryl group; n is an integer of 0 to 2; and $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group, or a sulfo group (including its salt). It is more preferable that $A^2$ is an oxygen atom; $R^8$ is an alkyl group, an aryl group or an acyl group; $R^9$ and $R^{10}$ each are a hydrogen atom, an alkyl group or an aryl group; n is an integer of 0 to 1; and $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group, or a sulfo group (including its salt). It is further preferable that $A^2$ is an oxygen atom; $R^8$ is an alkyl group, an aryl group or an acyl group; $R^9$ and $R^{10}$ each are a hydrogen atom, an alkyl group or an aryl group; and n is 0.

In the present invention, among the compounds represented by formula (1), it is preferable that $E^1$ is selected from the groups represented by any of formulae (2) to (5), and $E^2$ is selected from the groups represented by formula (5).

In formula (1), when $E^1$ is represented by formula (2) and $E^2$ is represented by formula (5), in the present invention, it is preferable that Ch represents a selenium atom or a tellurium atom, $A^2$ represents an oxygen atom or a sulfur atom, $R^8$ represents a hydrogen atom, an alkyl group, an aryl group or an acyl group, $R^9$ and $R^{10}$ each represent a hydrogen atom, an alkyl group or an aryl group, n denotes 0 to 2, $X^1$ represents an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), and $Z^1$ represents an alkyl group, an aryl group or a heterocyclic group; it is more preferable that Ch represents a selenium atom, $A^2$ represents an oxygen atom, $R^8$ represents an alkyl group, an aryl group or an acyl group, $R^9$ and $R^{10}$ each represent a hydrogen atom, an alkyl group or an aryl group, n denotes 0 to 1, $X^1$ represents an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), and $Z^1$ represents an alkyl group, an aryl group or a heterocyclic group; it is further preferable that Ch represents a selenium atom, $A^2$ represents an oxygen atom, $R^8$ represents an alkyl group, an aryl group or an acyl group, $R^9$ and $R^{10}$ each represent a hydrogen atom, an alkyl group or an aryl group, n denotes 0, and $Z^1$ represents an alkyl group or an aryl group.

In formula (1), when $E^1$ is represented by formula (3) and $E^2$ is represented by formula (5), it is preferable that Ch is a selenium atom or a tellurium atom, $A^2$ is an oxygen atom or a sulfur atom, $R^8$ is a hydrogen atom, an alkyl group, an aryl group or an acyl group, $R^9$ and $R^{10}$ each are a hydrogen atom, an alkyl group or an aryl group, n is an integer of 0 to 2, $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), $L^1$ is represented by formula (LA) or (LB), and EWG is an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; it is more preferable that Ch is a selenium atom, $A^2$ is an oxygen atom, $R^8$ is an alkyl group, an aryl group or an acyl group, $R^9$ and $R^{10}$ each are a hydrogen atom, an alkyl group or an aryl group, n is an integer of 0 to 1, $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), $L^1$ is represented by formula (LA), $G^1$ to $G^3$ each are a hydrogen atom, an alkyl group, or an alkyl group, and EWG is an acyl group, a formyl group, an alkoxy group, a cyano group, a nitro group, an alkylsulfonyl group, an arylsulfonyl group, or an alkyl group substituted with at least two or more halogen atoms; and it is further preferable that Ch is a selenium atom, $A^2$ is an oxygen atom, $R^8$ is an alkyl group, an aryl group or an acyl group, $R^9$ and $R^{10}$ each are a hydrogen atom, an alkyl group or an aryl group, n is 0, $L^1$ is represented by formula (LA), $G^1$ to $G^3$ each are a hydrogen atom or an alkyl group, and EWG is an acyl group, a formyl group, a cyano group, a nitro group, an alkylsulfonyl group, an arylsulfonyl group, or an alkyl group substituted with at least two or more halogen atoms.

In formula (1), when $E^1$ is represented by formula (4) and $E^2$ is represented by formula (5), it is preferable that Ch is a selenium atom or a tellurium atom, $A^2$ is an oxygen atom or a sulfur atom, $R^8$ is a hydrogen atom, an alkyl group, an aryl group or an acyl group, $R^9$ and $R^{10}$ each are a hydrogen atom, an alkyl group or an aryl group, n is an integer of 0 to 2, $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), $A^1$ is an oxygen atom or a sulfur atom, $R^4$ is an alkyl group or an aryl group, and $R^5$ and $R^6$ each are a hydrogen atom, an alkyl group, an aryl group or a heterocyclic group; it is more preferable that Ch is a selenium atom, $A^2$ is an oxygen atom, $R^8$ is an alkyl group, an aryl group or an acyl group, $R^9$ and $R^{10}$ each are a hydrogen atom, an alkyl group or an aryl group, n is an integer of 0 to 1, $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group or a sulfo group (including its salt), $A^1$ is an oxygen atom or a sulfur atom, $R^4$ is an alkyl group or an aryl group, and $R^5$ and $R^6$ each are a hydrogen atom, an alkyl group, an aryl group or a heterocyclic group; and it is further preferable that Ch is a selenium atom, $A^2$ is an oxygen atom, $R^8$ is an alkyl group, an aryl group or an acyl group, $R^9$ and $R^{10}$ each are a hydrogen atom, an alkyl group or an aryl group, n is 0, $A^1$ is an oxygen atom; $R^4$is an alkyl group or an aryl group, and $R^5$ and $R^6$ each are a hydrogen atom, an alkyl group or an aryl group.

In formula (1), when $E^1$ and $E^2$ each are represented by formula (5), it is preferable that Ch is a selenium atom or a tellurium atom, $A^2$ is an oxygen atom or a sulfur atom, $R^8$ is a hydrogen atom, an alkyl group, an aryl group or an acyl group, $R^9$ and $R^{10}$ each are a hydrogen atom, an alkyl group or an aryl group, n is an integer of 0 to 2, and X1 is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group, or a sulfo group (including its salt); it is more preferable that Ch is a selenium atom, $A^2$ is an oxygen atom, $R^8$ is an alkyl group, an aryl group or an acyl group, $R^9$ *and* $R^{10}$ each are a hydrogen atom, an alkyl group or an aryl group, n is an integer of 0 to 1, and $X^1$ is an alkyl group, an aryl group, a carboxy group (including its salt), a hydroxy group, an alkoxy group, an aryloxy group, an alkyl-, aryl- or heterocyclic-amino group, an acylamino group, a ureido group, an alkylthio group, an arylthio group, or a sulfo group (including its salt); and it is further preferable that Ch is a selenium atom, $A^2$ is an oxygen atom, $R^8$ is an alkyl group, an aryl group or an acyl group, $R^9$ and $R^{10}$ each are a hydrogen atom, an alkyl group or an aryl group, and n is 0.

Among the compounds represented by formula (1), when $E^2$ is represented by formula (5), in the present invention, $E^1$ is preferably selected from the groups represented by any of formulae (3) to (5), $E^1$ is more preferably selected from the groups represented by formula (4) or (5), and $E^1$ is further preferably selected from the groups represented by formula (5).

In the present invention, among the compounds represented by formula (1), those in which $E^1$is selected from the groups represented by formula (2) and $E^1$ is selected from the groups represented by formula (4), are also preferable. In this case, when $R^4$ is an alkyl group, $R^4$ has no halogen atom (e.g. fluorine, chlorine, bromine and iodine) as a substituent thereon. This is because, $R^4$ preferably has the action of donating electrons in the compound for use in the present invention, but this effect is decreased when the alkyl group represented by $R^4$ is substituted with a halogen atom.

Among the compounds represented by formula (1), when $E^1$is represented by formula (2) and $E^2$ is represented by formula (4), in the present invention, $R^4$ is preferably an alkyl group. $R^5$ and $R^6$ each are preferably a hydrogen atom, an alkyl group or an aryl group, more preferably a hydrogen atom or an alkyl group, and still more preferably the case where one of $R^5$ and $R^6$ is a hydrogen atom and the other is a hydrogen atom or an alkyl group.

Among the compounds represented by formula (1), when $E^1$ is represented by formula (2) and $E^2$ is represented by formula (4), in the present invention, $A^1$ is preferably an oxygen atom or a sulfur atom, and more preferably an oxygen atom.

Among the compounds represented by formula (1), when $E^1$ is represented by formula (2) and $E^2$ is represented by formula (4), in the present invention, $Z^1$ is preferably an alkyl group, an aryl group, a heterocyclic group, $OR^1$, or $NR^2R^3$, more preferably an alkyl group, an aryl group, $OR^1$, or $NR^2R^3$, and further preferably an alkyl group or an aryl group.

Among the compounds represented by formula (1), when $E^1$ is represented by formula (2) and $E^2$ is represented by formula (4), in the present invention, it is preferable that Ch is a selenium atom or a tellurium atom, $A^1$ is an oxygen atom or a sulfur atom, $R^4$ is an alkyl group or an aryl group, $R^5$ and $R^6$ each are a hydrogen atom, an alkyl group, an aryl group or a heterocyclic group, and $Z^1$ is an alkyl group, an aryl group, a heterocyclic group, $OR^1$, or $NR^2R^3$. It is more preferable that Ch is a selenium atom; $A^1$ is an oxygen atom or a sulfur atom; $R^4$ is an alkyl group or an aryl group; $R^5$ and $R^6$ each are a hydrogen atom or an alkyl group; and $Z^1$ is an alkyl group, an aryl group, $OR^1$ or $NR^2R^3$. It is further preferable that Ch is a selenium atom; $A^1$ is an oxygen atom; $R^4$ is an alkyl group; one of $R^5$ and $R^6$ is a hydrogen atom, and the other is an alkyl group; and $Z^1$s an alkyl group or an aryl group.

In the compound represented by formula (1) for use in the present invention, when $E^1$ is a group represented by formula (2), $E^2$ is not any group represented by formula (3).

In the present invention, among the compounds represented by formula (1), those in which $E^1$ and $E^2$ each are selected from the groups represented by formula (4), are also preferable.

Among the compounds represented by formula (1), when $E^1$ and $E^2$ each are represented by formula (4), in the present invention, $R^4$ is preferably an alkyl group or an aryl group, and more preferably an alkyl group. $R^5$ to $R^7$ each are preferably a hydrogen atom, an alkyl group or an aryl group, and more preferably a hydrogen atom or an alkyl group. Further, the case where one of $R^5$ and $R^6$ is a hydrogen atom and the other is a hydrogen atom or an alkyl group is preferable, and the case where $R^5$ and $R^6$ each are a hydrogen atom is most preferable.

Among the compounds represented by formula (1), when $E^1$ and $E^2$ each are represented by formula (4), in the present invention, when $R^4$ is an alkyl group, an alkenyl group or a heterocyclic group, there is no case where two $R^4$s bond together to form a six-membered cyclic structure containing the Ch. This is because, the case where $R^4$ has electron-donating nature is preferable in the present invention, but when two $R^4$s bond together to form a six-membered cyclic structure containing the Ch, it leads to the result that $R^4$ is substituted with $A^1$ having electron-withdrawing nature, which is unpreferable.

Among the compounds represented by formula (1), when $E^1$ and $E^2$ each are represented by formula (4), in the present invention, $A^1$ is preferably an oxygen atom or a sulfur atom, and more preferably an oxygen atom.

Among the compounds represented by formula (1), when $E^1$ and $E^2$ each are represented by formula (4), in the present invention, it is preferable that Ch is a selenium atom or a tellurium atom, $A^1$ is an oxygen atom or a sulfur atom, $R^4$ is an alkyl group or an aryl group, and $R^5$ and $R^6$ each are a hydrogen atom, an alkyl group, an aryl group or a heterocyclic group. It is more preferable that Ch is a selenium atom; $A^1$ is an oxygen atom or a sulfur atom; $R^4$ is an alkyl group or an aryl group; and $R^5$ and $R^6$ each are a hydrogen atom or an alkyl group. It is further preferable that Ch is a selenium atom; $A^1$ is an oxygen atom; $R^4$ is an alkyl group; and $R^5$ and $R^6$ each are a hydrogen atom or an alkyl group.

In the present invention, among the compounds represented by formula (1), those in which $E^1$ is selected from the groups represented by formula (3) and $E^2$ is selected from the groups represented by formula (4), are also preferable.

Among the compounds represented by formula (1), when $E^1$ is represented by formula (3) and $E^2$ is represented by formula (4), in the present invention, EWG is preferably an acyl group, a formyl group, an alkoxy group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom, a phosphoryl group, a carboxy group (or its salt), an alkyl group substituted with at least two or more halogen atoms, an aryl group substituted with other electron-withdrawing group having a positive $\sigma_m$ value, a heterocyclic group, or a halogen atom;

more preferably an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group (or its salt), or an alkyl group substituted with at least two or more halogen atoms; and further preferably an acyl group, a formyl group, a cyano group, a nitro group, an alkylsulfonyl group, an arylsulfonyl group, or an alkyl group substituted with at least two or more halogen atoms.

Among the compounds represented by formula (1), when $E^1$ is represented by formula (3) and $E^2$ is represented by formula (4), in the present invention, $R^4$ is preferably an alkyl group. $R^5$ and $R^6$ each are preferably a hydrogen atom, an alkyl group or an aryl group, and more preferably a hydrogen atom or an alkyl group. It is further preferable that one of $R^5$ and $R^6$ is a hydrogen atom, and the other is a hydrogen atom or an alkyl group. $R^7$ is preferably a hydrogen atom, an alkyl group or an aryl group, more preferably a hydrogen atom or an alkyl group, and further preferably an alkyl group.

Among the compounds represented by formula (1), when $E^1$ is represented by formula (3) and $E^2$ is represented by formula (4), in the present invention, $A^1$ is preferably an oxygen atom or a sulfur atom, and more preferably an oxygen atom.

Among the compounds represented by formula (1), when $E^1$ is represented by formula (3) and $E^2$ is represented by formula (4), in the present invention, it is preferable that Ch is a selenium atom or a tellurium atom; $A^1$ is an oxygen atom or a sulfur atom; $R^4$ is an alkyl group or an aryl group; $R^5$ and $R^6$ each are a hydrogen atom, an alkyl group, an aryl group or a heterocyclic group; EWG is an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; $L^1$ is a divalent linking group represented by formula (LA) or (LB); and $G^1$ to $G^4$ each are a hydrogen atom, an alkyl group or an aryl group. It is more preferable that Ch is a selenium atom; $A^1$ is an oxygen atom or a sulfur atom; $R^4$ is an alkyl group or an aryl group; $R^5$ and $R^6$ each are a hydrogen atom or an alkyl group; EWG is an acyl group, a formyl group, an alkoxy group, a cyano group, a nitro group, an alkylsulfonyl group, an arylsulfonyl group, or an alkyl group substituted with at least two or more halogen atoms; $L^1$ is a divalent linking group represented by formula (LA); and $G^1$ to $G^3$ each are a hydrogen atom, an alkyl group or an aryl group. It is further preferable that Ch is a selenium atom; $A^1$ is an oxygen atom; $R^4$ is an alkyl group; one of $R^5$ and $R^6$ is a hydrogen atom, and the other is an alkyl group; EWG is an acyl group, a formyl group, an alkoxy group, a cyano group, a nitro group, an alkylsulfonyl group, an arylsulfonyl group, or an alkyl group substituted with at least two or more halogen atoms; $L^1$s a divalent linking group represented by formula (LA); and $G^1$ to $G^3$ each are a hydrogen atom or an alkyl group.

In the present invention, among the compounds represented by formula (1), those in which $E^1$ and $E^2$ each are selected from the groups represented by formula (3), are also preferable.

Among the compounds represented by formula (1), when $E^1$ and $E^2$ each are represented by formula (3), in the present invention, EWG is preferably an acyl group, a formyl group, an alkoxy group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom, a phosphoryl group, a carboxy group (or its salt), an alkyl group substituted with at least two or more halogen atoms, an aryl group substituted with other electron-withdrawing group having a positive $\sigma_m$ value, a heterocyclic group, or a halogen atom; more preferably an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group (or its salt), or an alkyl group substituted with at least two or more halogen atoms; and further preferably an acyl group, a formyl group, a cyano group, a nitro group, an alkylsulfonyl group, an arylsulfonyl group, or an alkyl-group substituted with at least two or more halogen atoms.

Among the compounds represented by formula (1), when $E^1$ and $E^2$ each are represented by formula (3), in the present invention, $L^1$ is preferably a divalent linking group represented by formula (LA). In this case, $G^1$ to $G^3$ each are preferably a hydrogen atom, an alkyl group, an aryl group or a heterocyclic group; and more preferably a hydrogen atom, an alkyl group, or an aryl group. Further, the case where $G^1$ and $G^2$ or $G^2$ and $G^3$ bond together to form a ring, is preferable.

Among the compounds represented by formula (1), when $E^1$ and $E^2$ each are represented by formula (3), in the present invention, it is preferable that Ch represents a selenium atom or a tellurium atom, EWG is an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two halogen atoms, $L^1$is a linking group represented by formula (LA) or (LB), and $G^1$ to $G^4$ each represent a hydrogen atom, an alkyl group or an aryl group. It is more preferable that Ch represents a selenium atom, EWG is an acyl group, a formyl group, an alkoxy group, a cyano group, a nitro group, an alkylsulfonyl group, an arylsulfonyl group, or an alkyl group substituted with at least two halogen atoms, $L^1$ is a linking group represented by formula (LA), and $G^1$ to $G^3$ each represent a hydrogen atom, an alkyl group or an aryl group. It is further preferable that Ch represents a selenium atom, EWG is an acyl group, a formyl group, an alkoxy group, a cyano group, a nitro group, an alkylsulfonyl group, an arylsulfonyl group, or an alkyl group substituted with at least two halogen atoms, $L^1$ is a linking group represented by formula (LA), and $G^1$ to $G^3$ each represent a hydrogen atom or an alkyl group. It is most preferable that Ch represents a selenium atom, EWG is an acyl group, a formyl group, a cyano group, a nitro group, an alkylsulfonyl group, an arylsulfonyl group, or an alkyl group substituted with at least two halogen atoms, $L^1$ is a linking group represented by formula (LA), and $G^1$ to $G^3$ each represent a hydrogen atom or an alkyl group, in which $G^1$ and $G^2$, or $G^2$ and $G^3$ bond together to form a ring.

Next, specific examples of the compound represented by formula (1) will be shown below, but the present invention is not limited to these. Further, with respect to the compounds that may have a plurality of stereoisomers, their stereostructure is not limited to these.

In the following exemplified examples, Me denotes a methyl group, Et denotes an ethyl group, Pr denotes a propyl group, Bu denotes a butyl group, Ph denotes a phenyl group, Ac denotes an acetyl group, and Bn denotes a benzyl group, respectively.

1
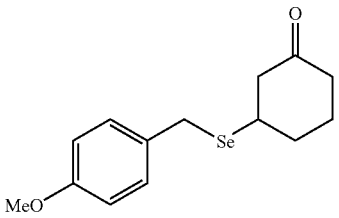
2
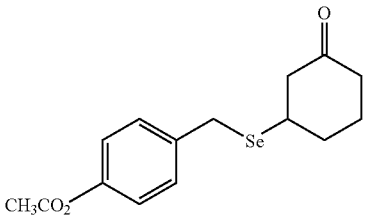
3
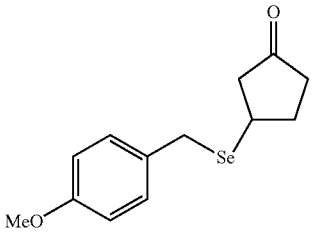
4
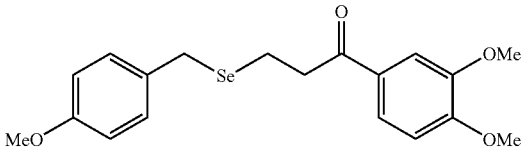
5
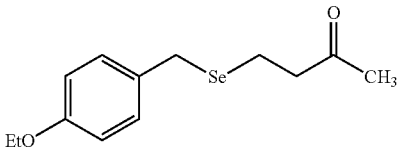
6
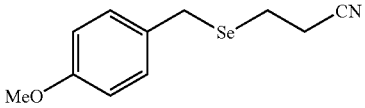
7
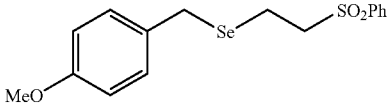
8
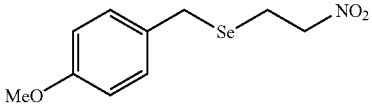
9
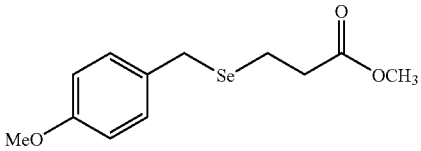

-continued
10
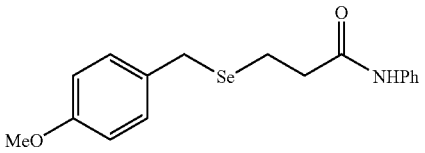
11
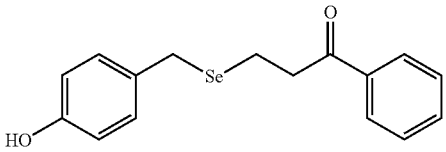
12
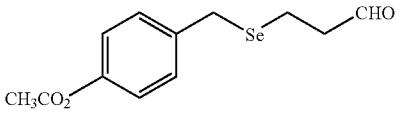
13
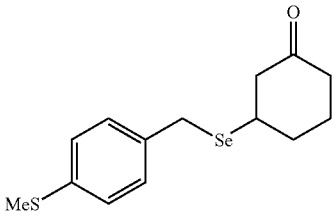
14
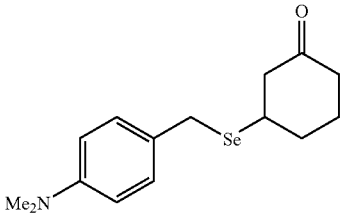
15
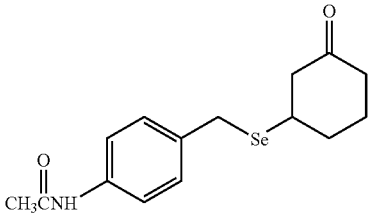
16
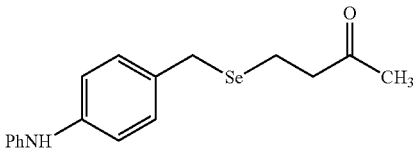
17
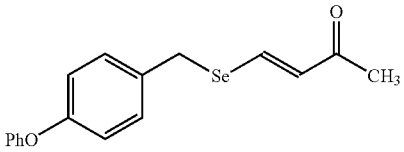

-continued
18
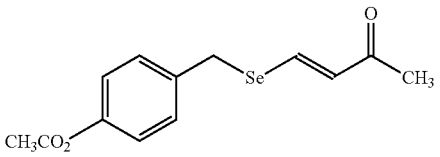
19
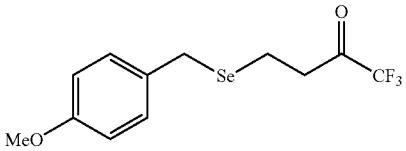
20
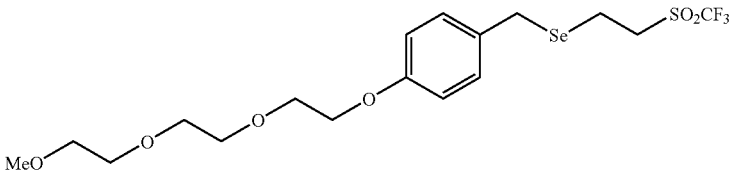
21
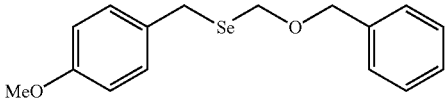
22
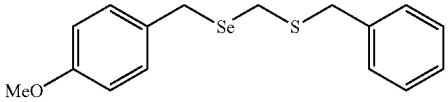
23
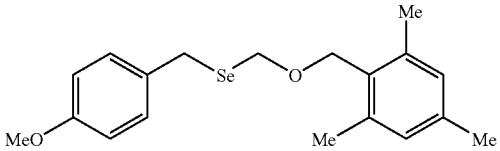
24
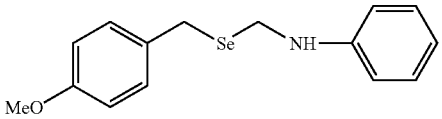
25
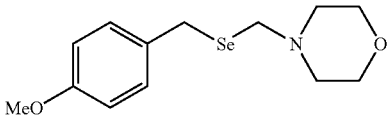
26
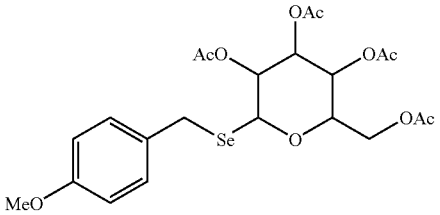
27
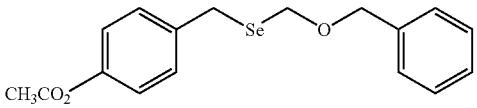

-continued
28
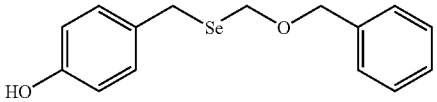
29
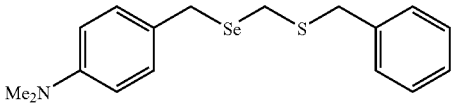
30
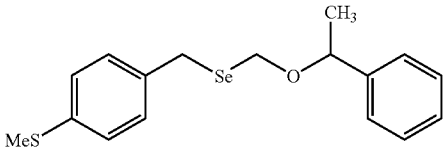
31
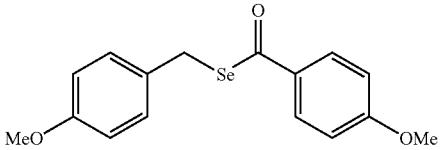
32
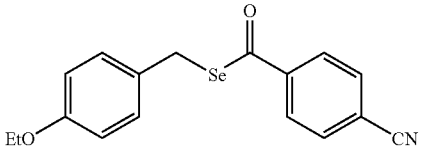
33
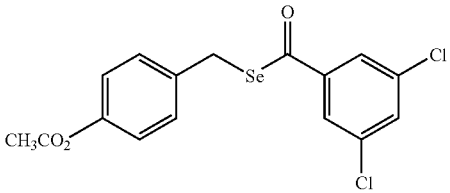
34
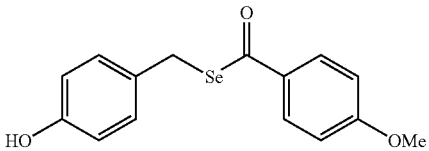
35
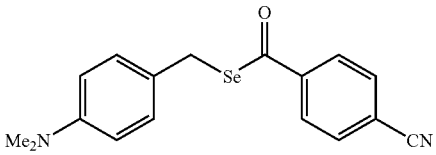
36
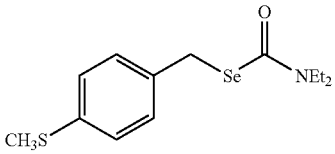
37
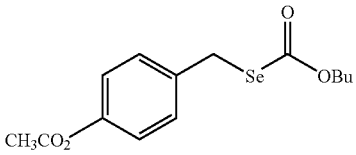

-continued
38
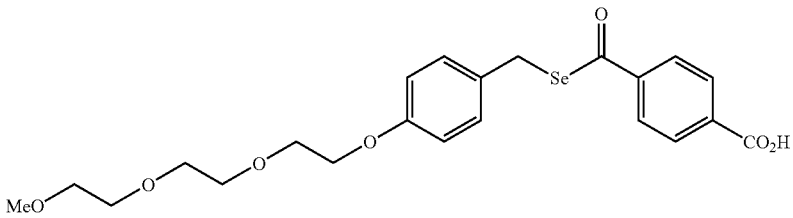
39
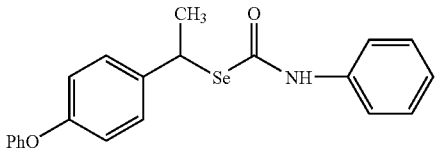
40
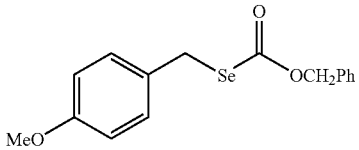
41
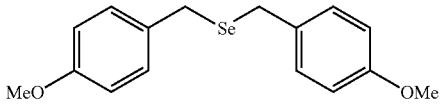
42
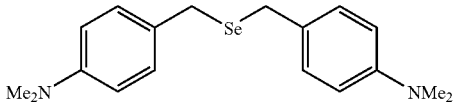
43
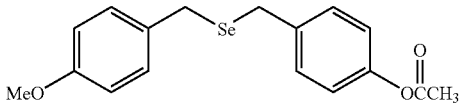
44
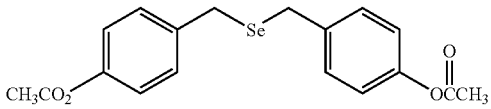
45
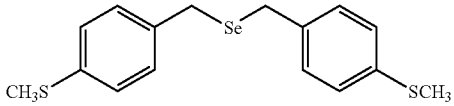
46
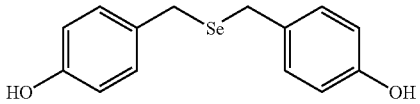
47
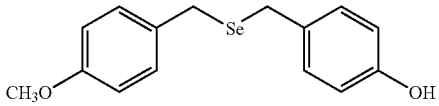
48
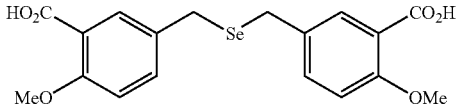

-continued
49
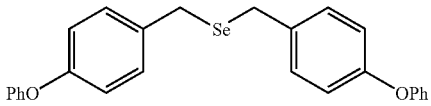
50
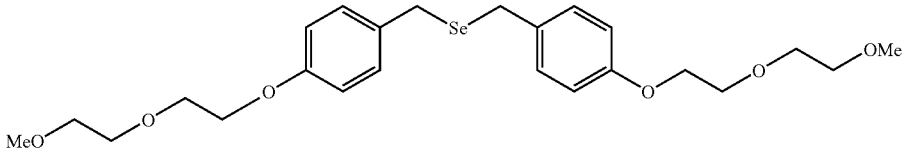
51
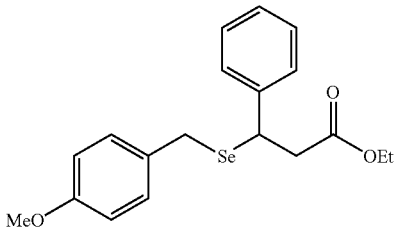
52
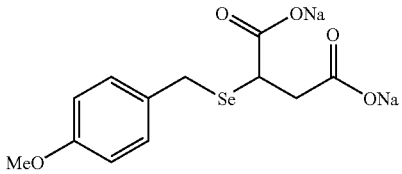
53
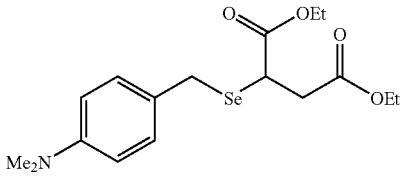
54
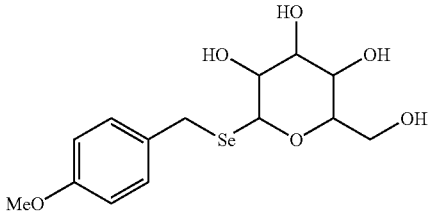
55
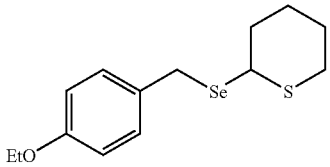
56
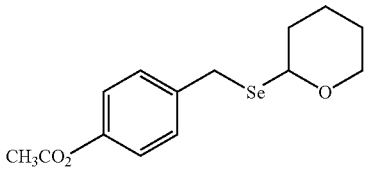

-continued
57
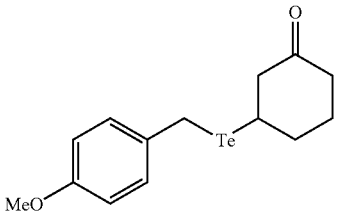
58
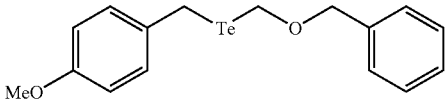
59
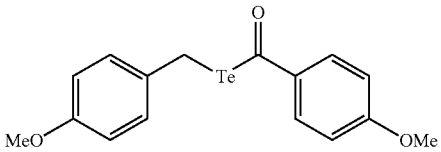
60
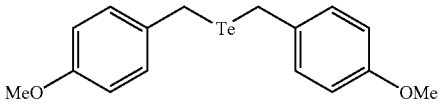
61
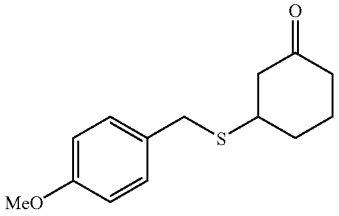
62
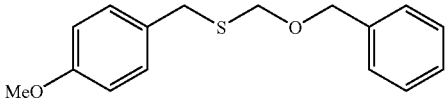
63
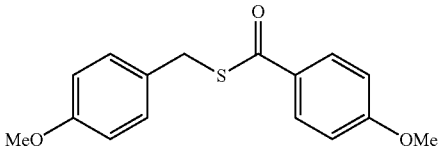
64
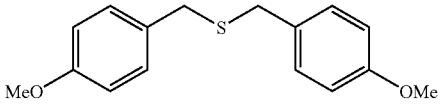
65
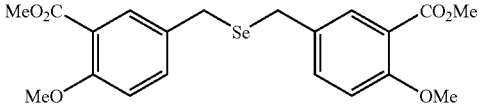
66
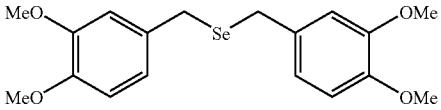

-continued
67 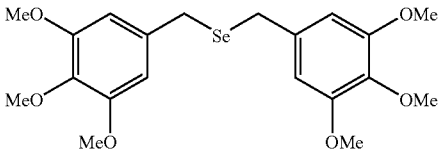
68 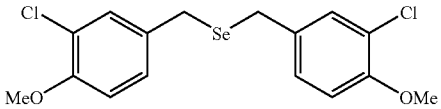
69 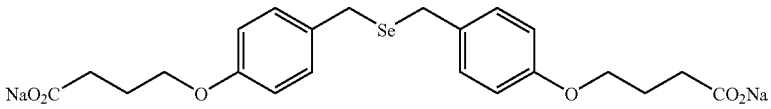
70 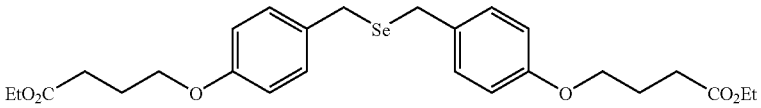
71 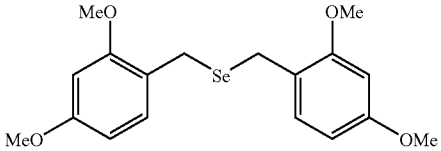
72 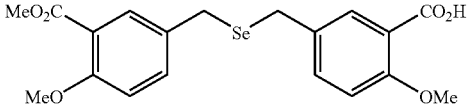
73 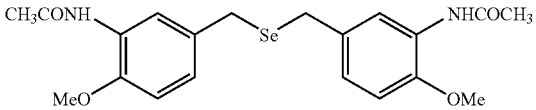
74 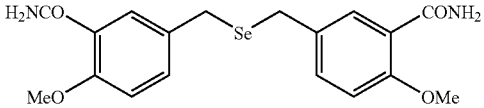
75 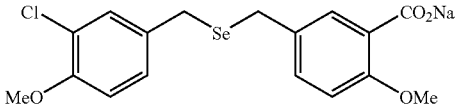
76 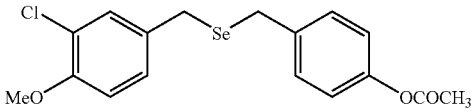
77 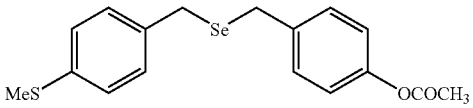
78 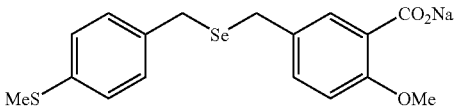

-continued
79 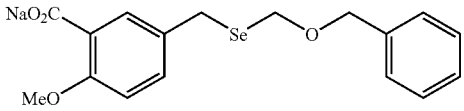
80 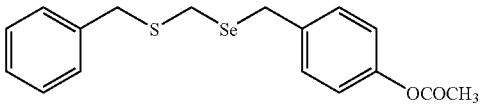
81 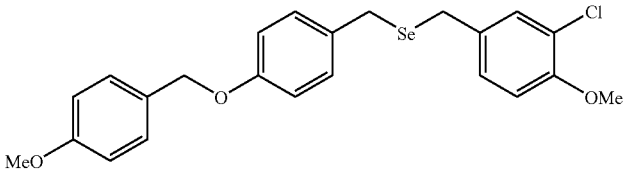
82 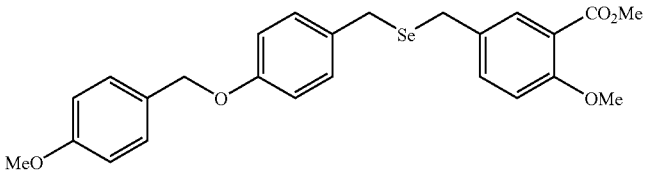
83 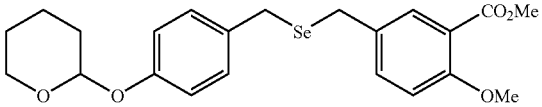
84 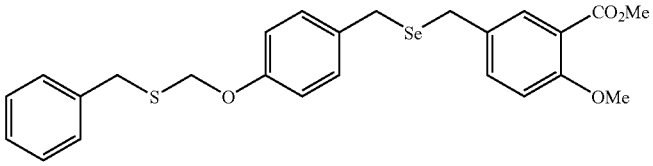
85 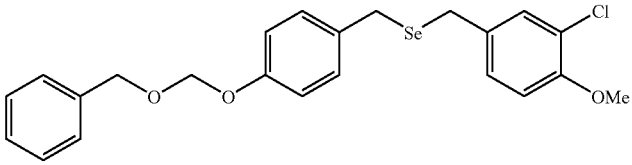
86 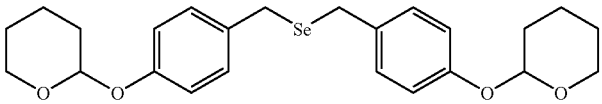
87 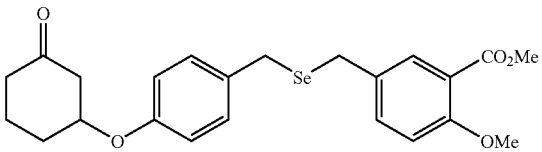
88 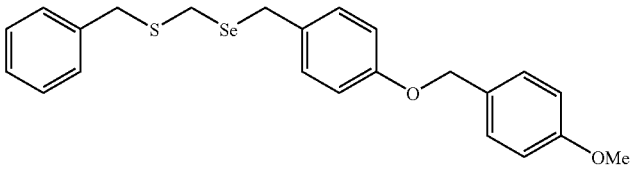

-continued
89 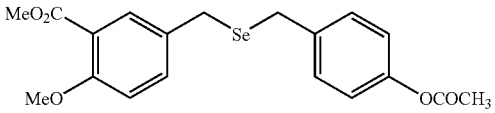
90 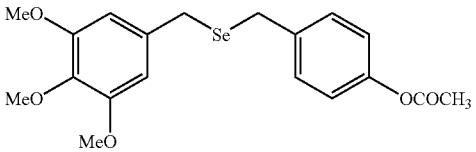
91 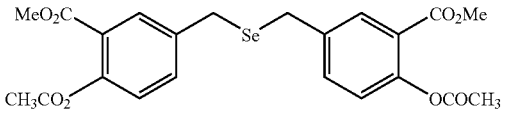
101 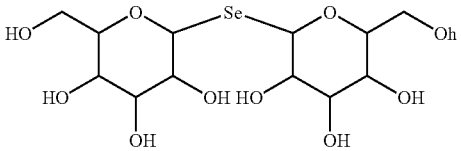
102 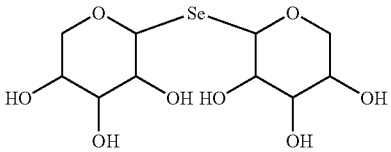
103 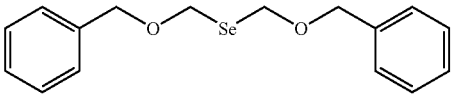
104 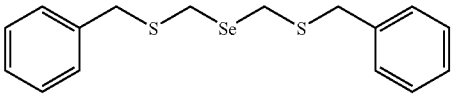
105 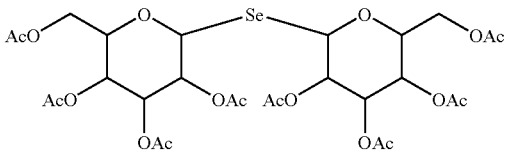
106 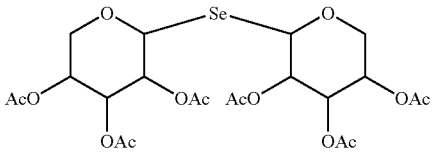
107 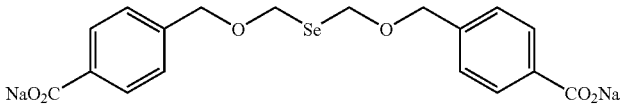
108 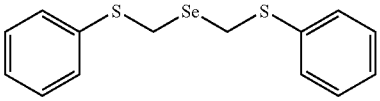

-continued
109
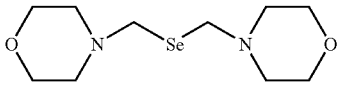
110
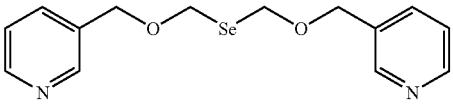
111
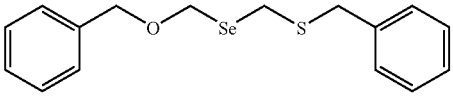
112
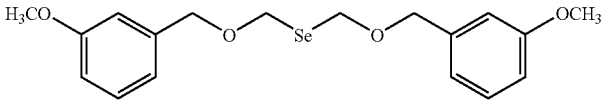
113
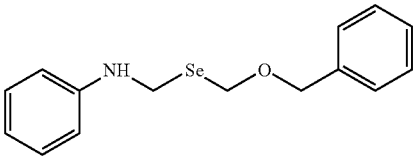
114
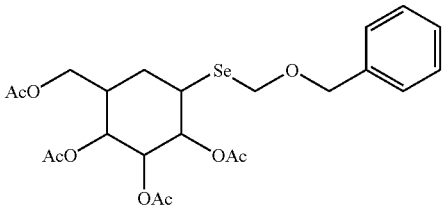
115
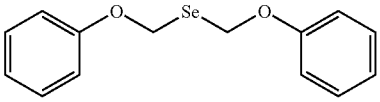
116
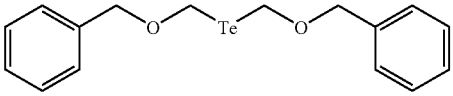
117
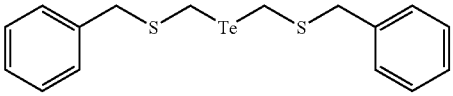
118
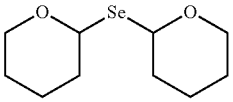
119
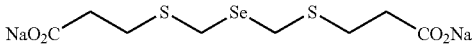
120
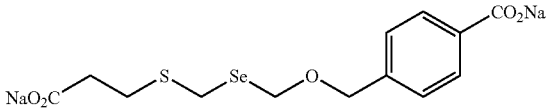

-continued
121
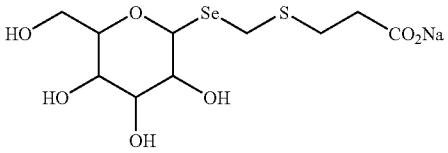
122
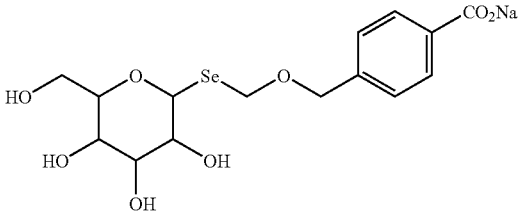
123
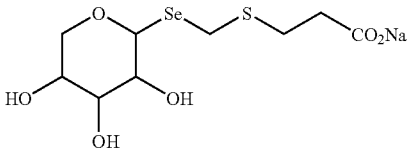
124
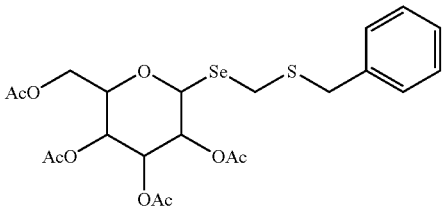
125
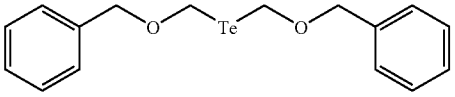
126
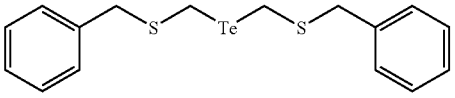
127
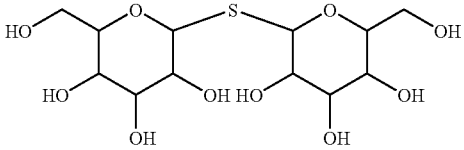
128
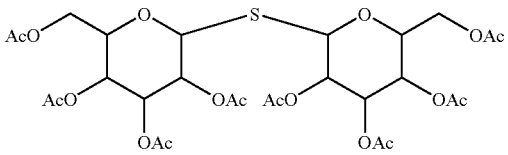
129
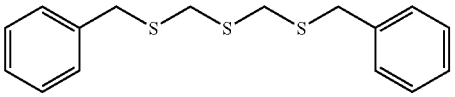
130
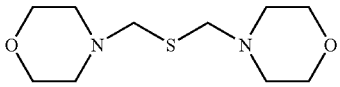

-continued
201
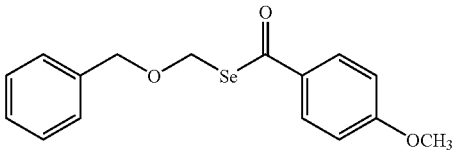
202
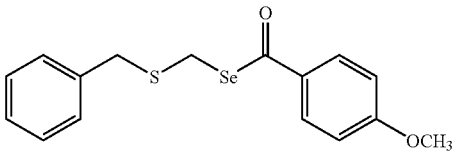
203
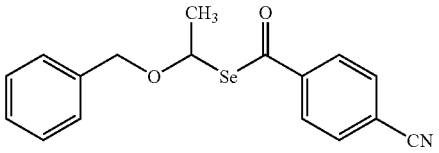
204
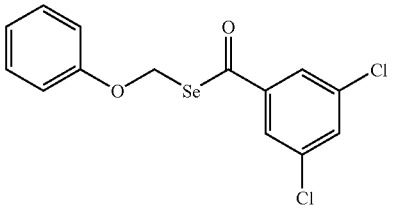
205
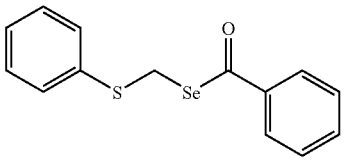
206
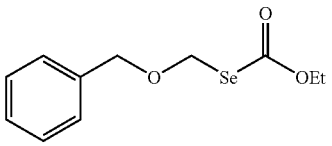
207
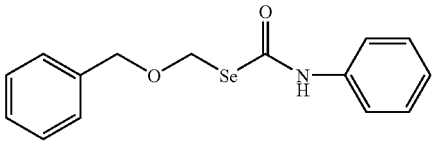
208
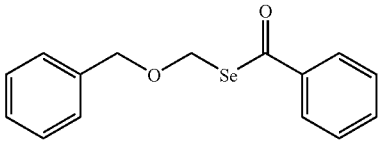
209
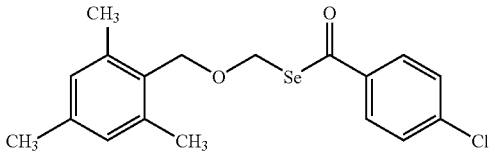

-continued
210
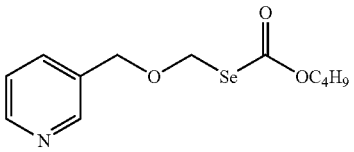
211
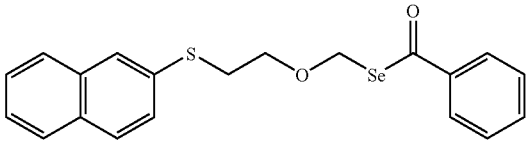
212
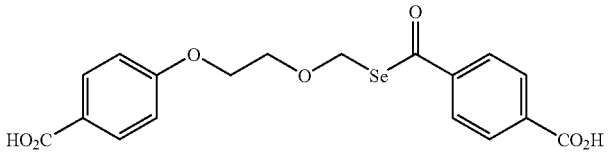
213
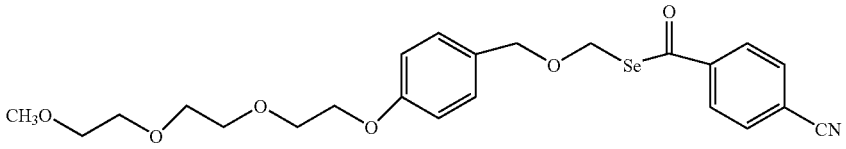
214
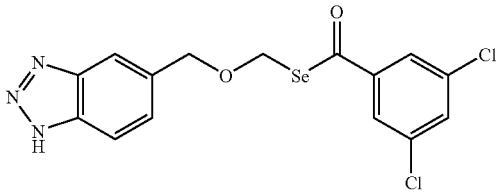
215
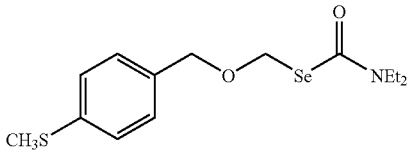
216
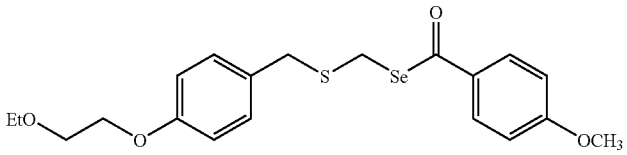
217
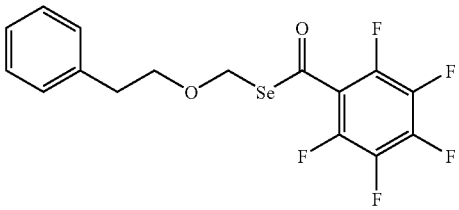

-continued
218
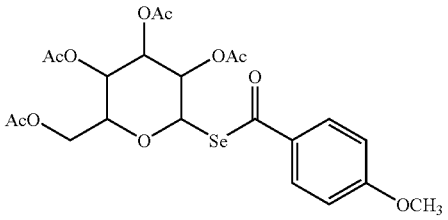
219
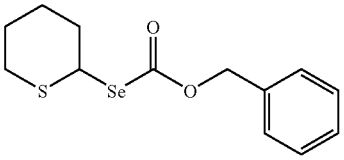
220
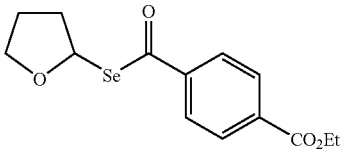
221
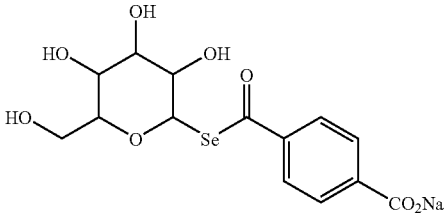
222
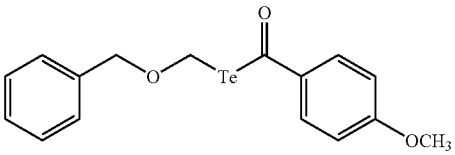
223
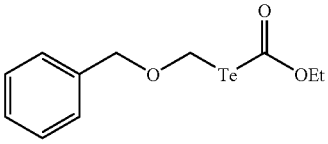
224
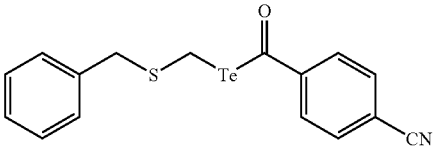
225
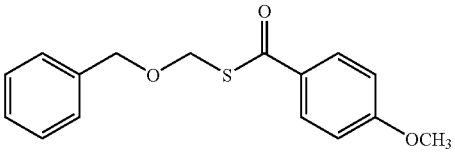
226
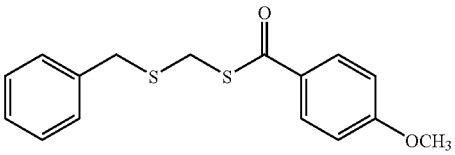

-continued
301
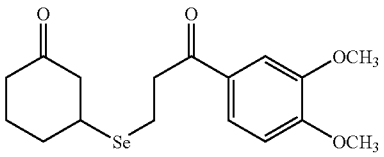
302
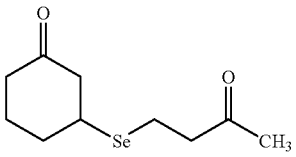
303
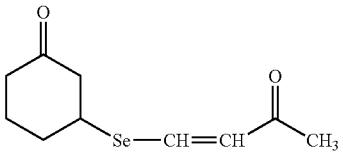
304
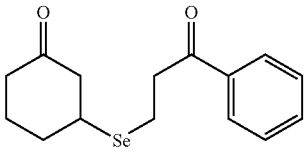
305
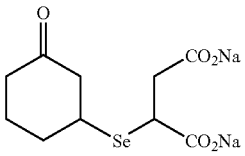
306
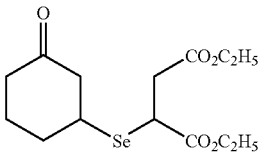
307
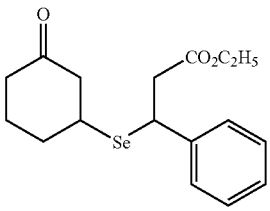
308
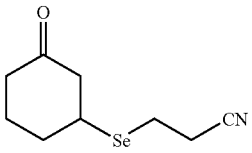
309
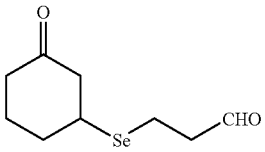

-continued
310
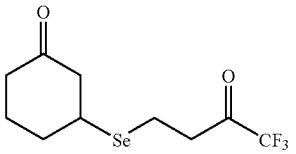
311
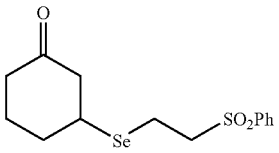
312
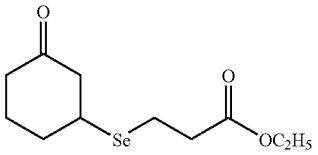
313
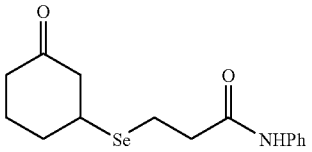
314
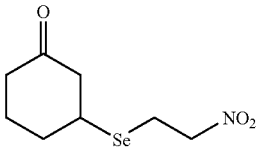
315
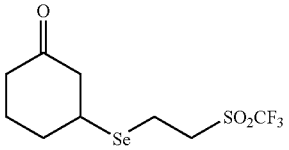
316
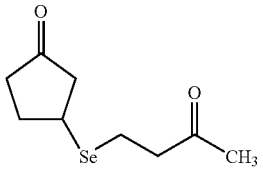
317
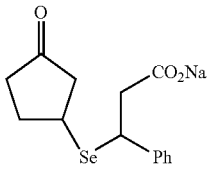
318
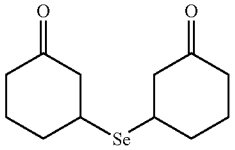

-continued
319
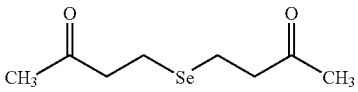
320
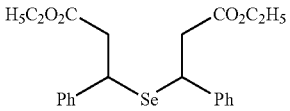
321
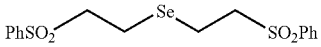
322
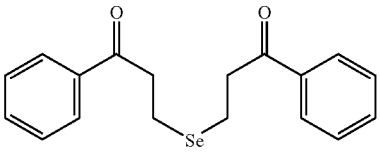
323
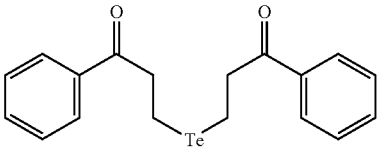
324
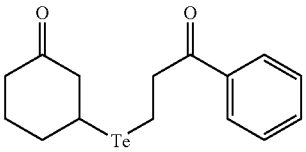
325
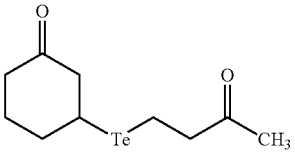
326
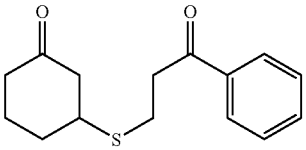
327
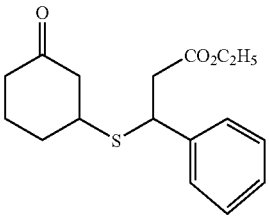
401
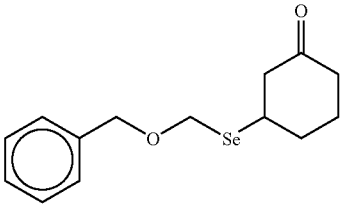

-continued
402
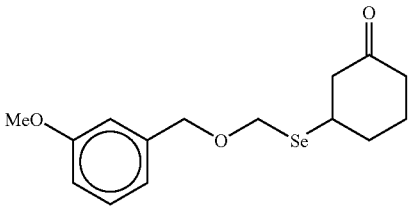
403
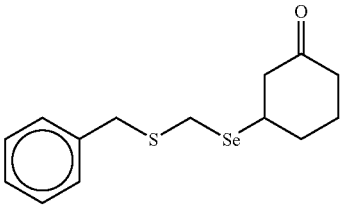
404
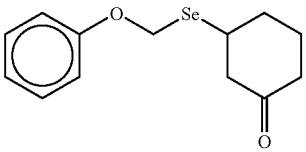
405
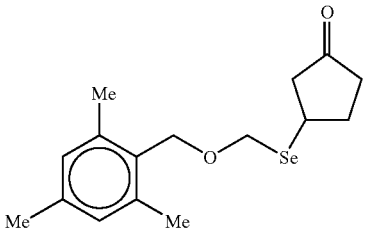
406
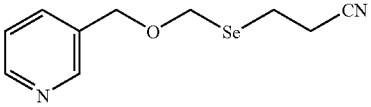
407
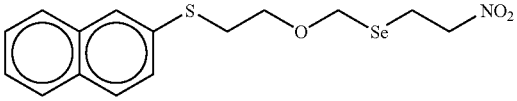
408
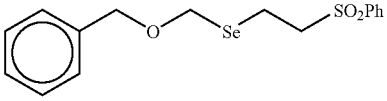
409
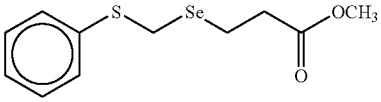
410
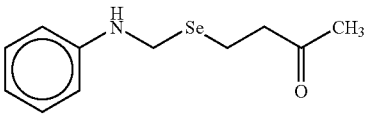
411
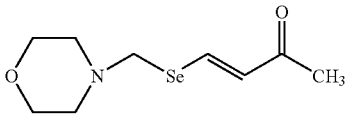

-continued
412
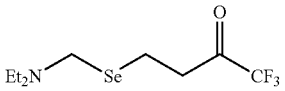
413
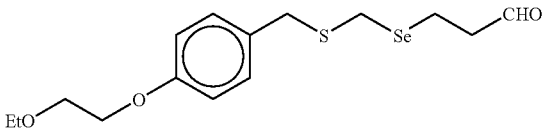
414
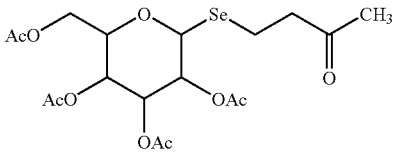
415
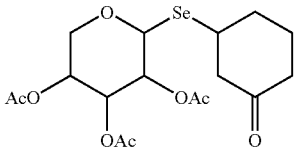
416
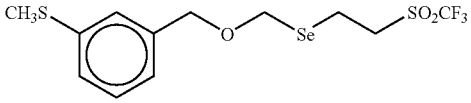
417
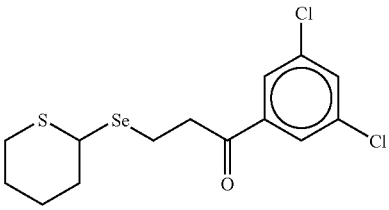
418
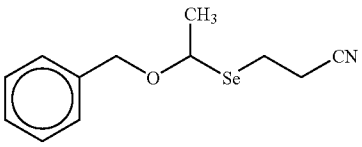
419
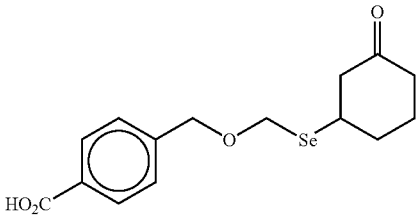
420
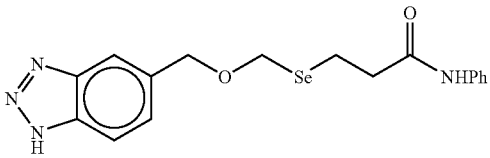

-continued
421
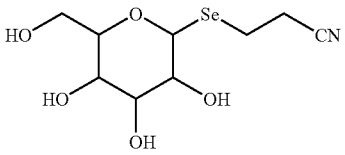
422
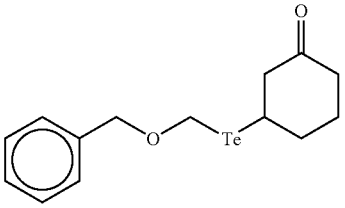
423
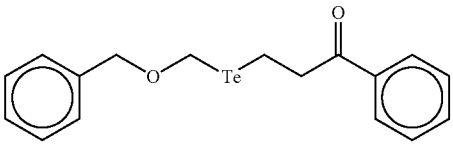
424
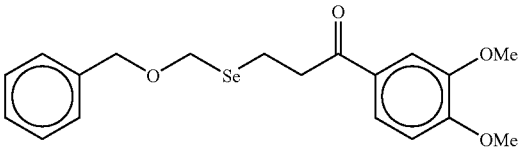
425
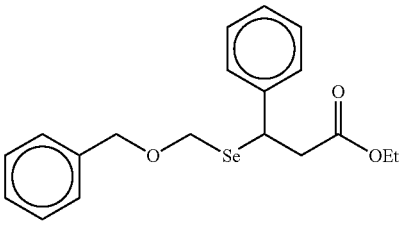
426
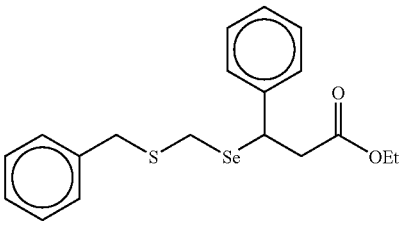
427
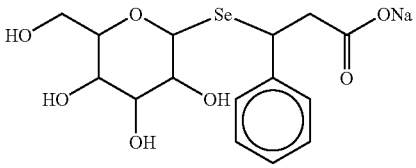
428
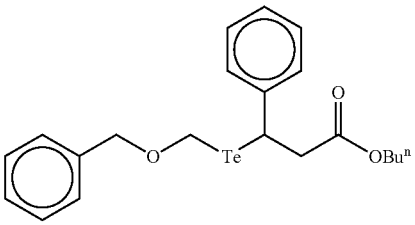

-continued

429

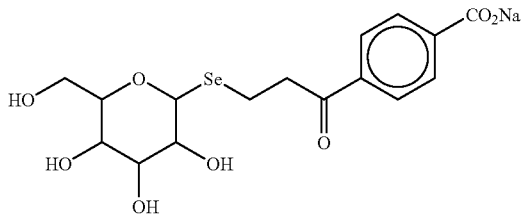

430

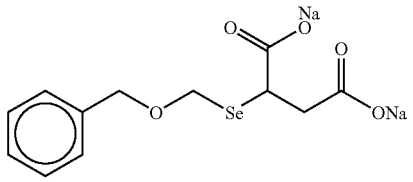

431

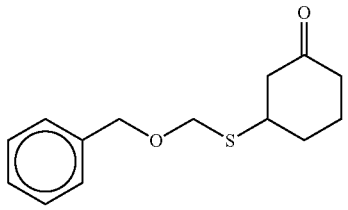

432

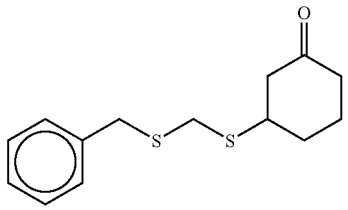

The compound represented by formula (1) according to the present invention can be synthesized by various known methods. Although no example of a synthetic method to be generalized can be given, because an optimum synthetic method is to be selected according to any individual compound, useful synthesis routes among these methods will be explained.

(Synthesis of Exemplified Compound 1)

To 2 g of p-methoxybenzyl chloride and 1.4 g of selenourea, was added 60 mL of acetone, and the resulting mixture was refluxed under heating for one hour, under a nitrogen atmosphere. The reaction solution was cooled, and the precipitated crystals were collected by filtration. 40 mL of methanol was added to 1.9 g of the resulting crystals, which were then cooled with ice. To these crystals were added 2.8 mL of a sodium methoxide methanol solution, 0.63 mL of trifluoroacetic acid, and then 0.65 g of cyclohexenone. The mixture was stirred at room temperature for 30 minutes. 100 mL of ethyl acetate and 100 mL of dilute hydrochloric acid were added to the mixture. The organic layer was separated and dried over magnesium sulfate, followed by concentrating under reduced pressure. The residue was purified by silica gel column chromatography, to give 1.2 g of Exemplified compound 1.

$^1$H NMR ($CDCl_3$) δ: 1.6-1.9 (m, 2H), 2.0-2.2 (m, 2H), 2.3-2.5 (m, 3H), 2.75 (m, 1H), 3.11 (m, 1H), 3.79 (s, 3H), 3.81 (s, 2H), 6.81 (d, 2H), 7.22 (d, 2H)

(Synthesis of Exemplified Compound 65)

To 54.6 g of 5-formylsalicylic acid, was added 500 mL of methanol, and then 36 mL of thionyl chloride was slowly added dropwise to the mixture. After the mixture was refluxed under heating for 5 hours, the solvents were distilled off. 600 mL of ethyl acetate and an aqueous sodium chloride solution were added to the mixture, to extract the organic phase, which was then dried over sodium sulfate, followed by distilling off the solvents, to give 58.7 g of methyl 5-formylsalicylate. 500 mL of acetone was added to this methyl ester, and then 67.6 g of potassium carbonate and 30 mL of methyl iodide were added to the mixture, which was then refluxed under heating for 6 hours. The precipitated salt was separated by filtration, and then the solvents were distilled off. Then, 200 mL of chloroform and 100 mL of an aqueous 5% potassium carbonate solution were added to the salt, to extract the organic phase, which was then dried over sodium sulfate, and then the solvents were distilled off. 100 mL of ethanol was added to the residue, and the precipitated crystals were collected by filtration, to give 14.5 g of methyl 5-formyl-2-methoxybenzoate. To the methyl 5-formyl-2-methoxybenzoate, was added 80 mL of methanol, and then gradually added 2.8 g of sodium borohydride under cooling with ice. The mixture was stirred at room temperature for 4 hours, and then the solvent was distilled off. Ethyl acetate and dilute hydrochloric acid were added to the residue, to extract the organic phase, which was then washed with an aqueous sodium chloride solution. Then, sodium sulfate was added, to dry the organic phase. The solvents were distilled off, to give 12.8 g of methyl 5-hydroxymethyl-2-methoxybenzoate. A solution prepared by dissolving 1.8 g of thionyl chloride and 1.8 g of 1,2,3-benzotriazole in 10 mL of methylene chloride was added to a solution prepared by adding 10 mL of methylene chloride to 2 g of methyl 5-hydroxymethyl-2-methoxybenzoate. The precipitated depositions were separated by filtration, and then an aqueous sodium chloride solution was added thereto, to wash the organic phase, which was then dried by adding sodium sulfate, followed by distilling solvents, to give 2 g of methyl 5-chloromethyl-2-methoxybenzoate. To the resulting product, were added 20 mL of acetone and 920 mg of selenourea. The mixture was refluxed under heating for one hour and then cooled with ice. The precipitated crystals were collected by filtration. To 3.8 g of the resulting crystals were added 2.42 g of methyl 5-chloromethyl-2-methoxybenzoate and 100 mL of acetone. Then, a solution prepared by dissolving 1.27 g of potassium hydroxide in 10 mL of water was added dropwise to the mixture, which was then stirred at room temperature for 0.5 hours, followed by distilling the solvents off. Ethyl acetate and an aqueous sodium chloride solution were added thereto, to extract the organic phase, which was then dried over magnesium sulfate, followed by distilling the solvents off. The residue was purified by silica gel column chromatography, to give 3.7 g of Exemplified compound 65.

$^1$H NMR ($CDCl_3$) δ: 3.67 (s, 4H), 3.89 (s, 6H), 3.90 (s, 6H), 6.90 (d, 2H), 7.38 (d, 2H), 7.69 (s, 2H)

(Synthesis of Exemplified Compound 48)

To 0.7 g of Exemplified compound 65 was added 5 mL of methanol, thereto was then added dropwise a solution prepared by dissolving 0.26 g of sodium hydroxide in 4 mL of water. The mixture was stirred at 70° C. for one hour. Then, dilute hydrochloric acid was added thereto, to precipitate crystals. The crystals were collected by filtration, to give 0.26 g of Exemplified compound 48.

$^1$H NMR ($D_2O$) δ: 3.84 (s, 6H), 3.859 (s, 4H), 7.01 (d, 2H), 7.22 (d, 2H), 7.30 (s, 2H)

(Synthesis of Exemplified Compound 72)

To 0.8 g of Exemplified compound 65, was added 20 mL of methanol, then was added thereto, dropwise, 0.4 mL of an aqueous 5M sodium hydroxide solution, and the resulting mixture was stirred at 70° C. for one hour. After distilling the solvents off, ethyl acetate and dilute hydrochloric acid were added to the mixture, to extract the organic phase, and then was added thereto magnesium sulfate, to dry the organic phase. After distilling the solvents off, the residue was purified by silica gel column chromatography, to give 0.11 g of Exemplified compound 72.

$^1$H NMR ($CDCl_3$) δ: 3.69 (s, 4H), 3.89 (s, 6H), 4.09 (s, 3H), 6.94 (d, 1H), 6.98 (d, 1H), 7.39 (d, 1H), 7.49 (s, 1H), 7.66 (s, 1H), 8.03 (s, 1H)

(Synthesis of Exemplified Compound 67)

To 10 g of 3,4,5-trimethoxybenzyl alcohol, was added 80 mL of methylene chloride, then was added thereto, dropwise, a solution prepared by dissolving 4.8 mL of thionyl chloride and 7.8 g of 1,2,3-benzotriazole in 40 mL of methylene chloride. After the mixture was stirred at room temperature for 2.5 hours, insoluble matter was separated by filtration, followed by addition of water, and the organic phase was washed with the added water. After the organic phase was dried over magnesium sulfate, solvents were distilled off, to thereby give 3,4,5-trimethoxybenzyl chloride. 1.34 g of selenourea and 80 mL of acetone were added to 2.6 g of 3,4,5-trimethoxybenzyl chloride, the mixture was refluxed under heating for 1.5 hours, and the precipitated crystals were collected by filtration. 40 mL of methanol was added to 2.2 g of these crystals. Thereto, 2.6 mL of a 28% sodium methoxide methanol solution was added dropwise, and then 1.4 g of 3,4,5-trimethoxybenzyl chloride was added to the methanol solution. The mixture was stirred for 0.5 hours and then solvents were distilled off. Ethyl acetate and dilute hydrochloric acid were added to the residue, to extract the organic phase, and the organic phase was then dried over magnesium sulfate, followed by distilling solvents off. The crystals precipitated by adding ethanol to the residue were collected by filtration, to give 1 g of Exemplified compound 67.

$^1$H NMR ($CDCl_3$) δ: 3.70 (s, 4H) 3.86 (s, 18H) 6.50 (s, 4H)

(Synthesis of Exemplified Compound 201)

Exemplified compound 201 was synthesized according to the scheme 1.

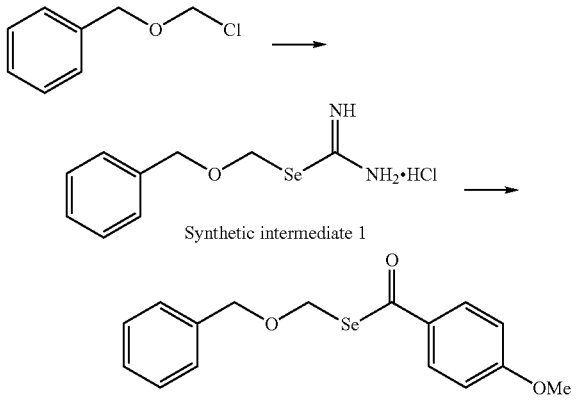

Exemplified compound 201

In 20 mL of acetone, was dissolved 3.2 g of benzyl chloromethyl ether, then was added thereto 80 mL of an acetone solution containing 2 g of selenourea, and the mixture was stirred at room temperature for one hour. The precipitated solid was collected by filtration, to give 4.6 g of Synthetic intermediate 1. To 2 g of Synthetic intermediate 1, were added 40 mL of water and 0.2 g of benzyltriethylammonium chloride, and then 4 mL of an aqueous 5M NaOH solution was added. 10 mL of an ethyl acetate solution containing 1.2 g of p-methoxybenzoyl chloride was added to the mixture, which was then stirred at room temperature for one hour. 80 mL of ethyl acetate and 100 mL of dilute hydrochloric acid were added to the mixture, to separate the organic phase, and the organic phase was washed with water and then concentrated under reduced pressure. The obtained residue was purified by column chromatography, to give 1.8 g of Exemplified compound 201.

$^1$H NMR ($CDCl_3$) δ: 3.85 (s, 3H), 4.56 (s, 2H), 5.62 (s, 2H), 6.93 (d, 2H), 7.2-7.4 (m, 5H), 7.94 (d, 2H)

(Synthesis of Exemplified Compound 202)

Exemplified compound 202 was obtained in the similar manner as in the synthesis of Exemplified compound 201, except that benzylchloromethyl sulfide was used instead of benzyl chloromethyl ether.

$^1$H NMR ($CDCl_3$) δ: 3.81 (s, 2H), 3.83 (s, 3H), 4.12 (s, 2H), 6.93 (d, 2H), 7.2-7.4 (m, 5H), 7.86 (d, 2H)

(Synthesis of Exemplified Compound 218)

To 60 ml of a methylene chloride solution containing 13 g of 1,2,3,4,6-pentaacetyl-β-D-glucopyranose, was added 25 g of a 30% hydrogen bromide acetic acid solution. The mixture was stirred at room temperature overnight, and then 100 mL of ice water and 100 mL of methylene chloride were added to the mixture, to separate the solution into two phases. The organic phase was washed with 30 mL of an aqueous saturated sodium bicarbonate solution and 30 mL of an aqueous saturated sodium chloride solution. The organic phase was dried over sodium sulfate, and then concentrated under reduced pressure. 60 mL of ethanol was added to the resulting oily product, and the precipitated crystals were collected by filtration, to give 11 g of 1-bromo-2,3,4,6-pentaacetyl-β-D-glucopyranose. 10.5 g of 1-bromo-2,3,4,6-pentaacetyl-β-D-glucopyranose and 3.1 g of selenourea were added to 100 mL of acetone, and the mixture was refluxed under heating for one hour. The reaction solution was cooled with ice, and subjected to filtration, to give crystals. 30 ml of water was added to 3.1 g of the crystals, then were added thereto 5 mL of an aqueous solution containing 1.6 g of potassium carbonate and then 18 mL of THF (tetrahydrofuran). 5 mL of an ethyl acetate solution containing 1 g of p-methoxybenzoyl chloride was added dropwise to the mixture, which was then stirred at room temperature for one hour. Then, 100 mL of ethyl acetate and 100 mL of dilute hydrochloric acid were added to the mixture, to separate the organic phase, which was then washed with water and then concentrated under reduced pressure. The resulting residue was purified by column chromatography, to give 2 g of Exemplified compound 218.

$^1$H NMR ($CDCl_3$) δ: 1.98 (s, 3H), 2.00 (s, 3H), 2.03 (s, 3H), 2.08 (s, 3H), 3.86 (s, 3H), 3.87 (m, 1H), 4.12 (d, 1H), 4.35 (d, 1H), 5.17 (m, 1H), 5.33 (m, 2H), 5.52 (m, 1H), 6.91 (d, 2H), 7.81 (d, 2H)

(Synthesis of Exemplified Compound 105)

Exemplified compound 105 was synthesized according to the following scheme.

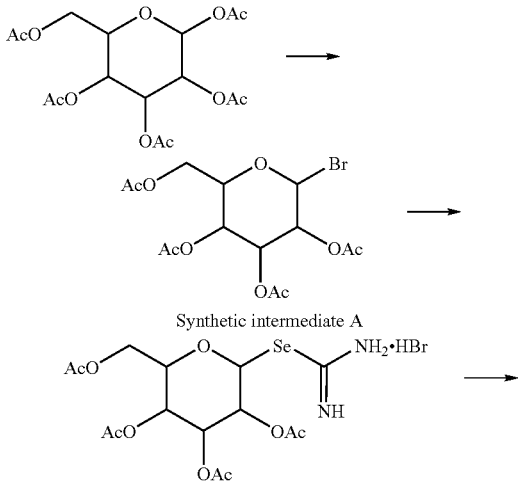

-continued

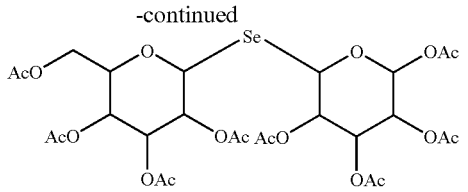

Exemplified compound 105

(Synthesis of Synthetic Intermediate A)

To 74 g of 1,2,3,4,6-pentaacetyl-β-D-glucopyranose was added 170 mL of a 25% hydrogen bromide acetic acid solution, and the mixture was stirred for 4 hours. 400 mL of ethyl acetate and 500 mL of ice water were added to the mixture, to wash the organic phase. The organic phase was then washed with 50 mL of a saturated sodium bicarbonate solution and finally with 300 mL of ice water. The organic phase was dried over magnesium sulfate, and then the solvents were distilled off. 200 mL of ethanol was added to the residue, to precipitate crystals, which were then collected by filtration, to give 62 g of Synthetic intermediate A.

(Synthesis of Synthetic Intermediate B)

To 16.7 g of Synthetic intermediate A and 5 g of selenourea was added 100 mL of acetone, and the mixture was refluxed under heating for 30 minutes. The reaction solution was cooled with ice, and the precipitated crystals were collected by filtration, to give 5 g of Synthetic intermediate B.

(Synthesis of Exemplified Compound 105)

To 1.15 g of Synthetic intermediate A and 1.5 g of Synthetic intermediate B were added 10 mL of acetone and then 2 mL of an aqueous 2.8 M KOH solution, and the mixture was stirred at room temperature for 5 minutes, followed by distilling solvents off. 30 mL of methylene chloride was added to the residue, which was then washed with water three times. The residue was dried over magnesium sulfate, and then the solvents were distilled off. Methanol was added to the residue, to precipitate crystals, which were then collected by filtration, to give 1 g of Exemplified compound 105.

$^1$H NMR ($CDCl_3$) δ: 2.01 (s, 6H), 2.03 (s, 6H), 2.04 (s, 6H), 2.12 (s, 6H), 3.69 (m, 2H), 4.21 (m, 4H), 5.0-5.2 (m, 8H)

(Synthesis of Exemplified Compound 101)

To 1 g of Exemplified compound 105 was added 4 mL of methanol, and then to the mixture was added 1 mL of a 28% sodium methoxide methanol solution. The precipitated crystals were collected by filtration, to give 0.5 g of Exemplified compound 101.

$^1$H NMR ($D_2O$) δ: 3.3-3.6 (m, 8H), 3.65 (dd, 2H), 3.90 (d, 2H), 5.07(d, 2H)

(Synthesis of Exemplified Compound 401)

In 20 mL of acetone was dissolved 3.2 g of benzyl chloromethyl ether, and 80 mL of an acetone solution containing 2 g of selenourea was added to the mixture, which was then stirred at room temperature for one hour. The precipitated solid was collected by filtration and dried, and 4.0 g of the solid was added to 80 mL of methanol. Under cooling with ice, to the solution, were added 5.2 mL of a sodium methoxide methanol solution, and then a solution prepared by adding 0.89 mL of acetic acid in 4 mL of methanol. Then, a solution prepared by adding 1.24 g of cyclohexenone in 5 mL of methanol was added dropwise to the mixture, which was then stirred at room temperature for 30 minutes. Then, 100 mL of ethyl acetate and 100 mL of dilute hydrochloric acid were added to the solution, to separate the organic phase, which was then dried over magnesium sulfate and concentrated under reduced pressure. The residue was purified by silica gel column chromatography, to give 2 g of Exemplified compound 401.

$^1$H NMR ($CDCl_3$) δ: 1.75 (m, 1H), 1.8-2.2 (m, 2H), 2.2-2.5 (m, 3H), 2.59 (dd, 1H), 2.87 (dd, 1H), 3.42 (m, 1H), 4.56 (s, 2H), 5.11 (s, 2H), 7.2-7.4 (m, 5H)

(Synthesis of Exemplified Compound 301)

Exemplified compound 301 was synthesized according to the following scheme.

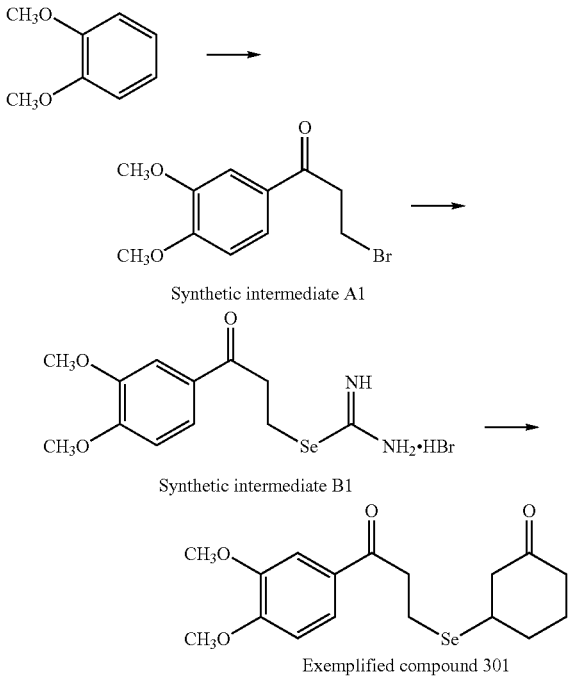

(Synthesis of Synthetic Intermediate A1)

In 80 mL of methylene chloride was dissolved 15 mL of 3-bromopropionyl chloride, and under cooling with ice, to the mixture, were added 25 g of aluminum chloride and then 40 mL of a methylene chloride solution of 20 g of 1,2-dimethoxybenzene. After stirring for one hour, ice was added to the solution. Then, a saturated aqueous sodium chloride solution was added to the solution, to separate the organic phase. The organic phase was dried over magnesium sulfate, and then the solvents were distilled off. Methanol and a small amount of hexane were added to the residue, followed by cooling. Then, the precipitated crystals were collected by filtration, to give 18 g of Synthetic intermediate A1.

(Synthesis of Synthetic Intermediate B1)

To 4 g of Synthetic intermediate A1 and 1.6 g of selenourea was added 60 mL of acetone, and the mixture was refluxed under heating for 6 hours under a nitrogen atmosphere. The reaction solution was cooled with ice, and the precipitated crystals were collected by filtration, to give 2.7 g of Synthetic intermediate B1.

(Synthesis of Exemplified Compound 301)

To 1.6 g of Synthetic intermediate B1, 20 mL of methanol was added. The solution was cooled with ice, and 1.6 mL of a 28% sodium methoxide methanol solution was added thereto. After 0.3 mL of acetic acid was added to the reaction solution, 0.4 g of 2-cyclohexenone was added thereto, followed by stirring at room temperature for one hour. To the reaction solution, ethyl acetate and a saturated aqueous sodium chloride solution were added, to separate the organic phase. The organic phase was dried over sodium sulfate, and then the solvents were distilled off. The residue was purified by silica gel column chromatography, to give 0.5 g of Exemplified compound 301.

In the present invention, the addition amount of the compound represented by formula (1) can vary in a wide range depending on the occasions, and it is generally in the range of $1\times10^{-7}$ to $5\times10^{-3}$ mol, preferably in the range of $5\times10^{-7}$ to $5\times10^{-4}$ mol, per mol of silver halide.

In the present invention, the compound represented by formula (1) may be added by dissolving in a solvent, for example, of water, an alcohol (e.g., methanol and ethanol), a ketone (e.g., acetone), an amide (e.g., dimethylformamide), a glycol (e.g., methylpropylene glycol), or an ester (e.g., ethyl acetate).

In the present invention, the compound represented by formula (1) may be added in any stage of the production of the emulsion. It is preferable to add the compound at an appropriate time after the silver halide grains are formed but before the chemical sensitization step is completed.

The compound represented by formula (6-1) or (6-2) is described below.

In formulae (6-1) and (6-2), Au represents a monovalent or trivalent gold ion. In the present invention, Au is preferably a monovalent gold ion.

In formulae (6-1) and (6-2), $X^2$ represents a monovalent anion. Preferable examples of the monovalent anion include a halogen ion (e.g., $F^-$, $Cl^-$, $Br^-$ and $I^-$), tetrafluoroboronate ion ($BF_4^-$), hexafluorophosphonate ion ($PF_6^-$), hexafluoroantimonate ion ($SbF_6^-$), arylsulfonate ion (e.g., p-toluenesulfonate ion), alkylsulfonate ion (e.g., methanesulfonate ion and trifluoromethanesulfonate ion), and carboxy ion (e.g., acetic acid ion, trifluoroacetic acid ion, and benzoic acid ion). It is not preferable that any of these monovalent anions has a group, which is an adsorbing group to gold, represented by a mercapto group (—SH), a thioether group (—S—), a selenoether group (—Se—), and a telluroether group (—Te—).

In the present invention, $X^2$ is preferably a halogen ion, a tetrafluoroboronate ion, a hexafluorophosphonate ion, an arylsulfonate ion, or an alkylsulfonate ion; more preferably a halogen ion, a tetrafluoroboronate ion, or a hexafluorophosphonate ion; and further preferably a halogen ion. Among the halogen ion, $Cl^-$, $Br^-$ or $I^-$ is preferably, $Cl^-$ or $Br^-$ is more preferably, and $Cl^-$ is further preferably.

In formulae (6-1) and (6-2), m represents an integer of from 1 to 3. In the present invention, m is preferably 1.

In formulae (6-1) and (6-2), $W^1$ is selected from the compounds represented by any of formulae (S1) to (S3). When Au is trivalent, $W^1$ is selected from the compounds represented by formula (S1) or (S3). $W^2$ is selected from the compounds represented by formula (S3).

In formula (S1), Ch represents a sulfur atom, a selenium atom or a tellurium atom. In the present invention, Ch is preferably a sulfur atom or a selenium atom, more preferably a selenium atom.

In formula (S1), the alkyl, alkenyl, alkynyl, aryl and heterocyclic groups represented by $M^1$ to $M^5$ or Q have the same meanings as those mentioned above, and the preferable ranges thereof are also the same.

Examples of the acyl group represented by $M^1$ and $M^2$ in formula (S1) include an acetyl group, formyl group, benzoyl group, pivaloyl group, caproyl group and n-nonanoyl group; examples of the amino group include an unsubstituted amino group, methylamino group, hydroxyethylamino group, n-octylamino group, dibenzylamino group, dimethylamino group and diethylamino group; examples of the alkoxy group include a methoxy group, ethoxy group, n-butyloxy group, cyclohexyloxy group, n-octyloxy group and n-decyloxy group; and examples of the carbamoyl group include an unsubstituted carbamoyl group, N,N-diethylcarbamoyl group and N-phenylcarbamoyl group.

In formula (S1), $M^1$ and $M^2$, Q and $M^1$, or Q and $M^2$ may bond together to form a cyclic structure. Moreover, when Q represents $NM^4M^5$, $M^4$ and $M^5$ may bond together to form a cyclic structure.

$M^1$ to $M^5$ and Q in formula (S1) may have a substituent(s) as many as possible, and examples of the substituent include the same examples that are mentioned above.

As the compound represented formula (S1), the following case is preferable: Ch is a sulfur atom or a selenium atom; $M^1$ and $M^2$ each are a hydrogen atom, a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted aryl group having 6 to 10 carbon atoms, a heterocyclic group, or an acyl group; and Q is a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted aryl group having 6 to 10 carbon atoms, or $NM^4M^5$, in which $M^4$ and $M^5$ each represent a hydrogen atom, a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted aryl group having 6 to 10 carbon atoms, or a heterocyclic group.

As the compound represented formula (S1), the following case is more preferable: Ch is a sulfur atom or a selenium atom; $M^1$ and $M^2$ each are a hydrogen atom, a substituted or unsubstituted, straight-chain or branched alkyl group having 1 to 6 carbon atoms, an alkenyl group having 2 to 6 carbon atoms, or a substituted or unsubstituted aryl group having 6 to 10 carbon atoms; and Q is a substituted or unsubstituted, straight-chain or branched alkyl group having 1 to 6 carbon atoms, a substituted or unsubstituted aryl group having 6 to 10 carbon atoms, or $NM^4M^5$, in which $M^4$ and $M^5$ each represent a hydrogen atom, a substituted or unsubstituted, straight-chain or branched alkyl group having 1 to 6 carbon atoms, an alkenyl group having 2 to 6 carbon atoms, or a substituted or unsubstituted aryl group having 6 to 10 carbon atoms.

As the compound represented formula (S1), the following case is further preferable: Ch is a selenium atom; $M^1$ and $M^2$ each are a hydrogen atom, a substituted or unsubstituted, straight-chain or branched alkyl group having 1 to 6 carbon atoms, or a substituted or unsubstituted aryl group having 6 to 10 carbon atoms; and Q is $NM^4M^5$, in which $M^4$ and $M^5$ each represent a hydrogen atom, a substituted or unsubstituted, straight-chain or branched alkyl group having 1 to 6 carbon atoms, or a substituted or unsubstituted aryl group having 6 to 10 carbon atoms.

The compound represented by formula (S2) is described below.

In formula (S2), Ch represents a sulfur atom, a selenium atom or a tellurium atom. In the present invention, Ch is preferably a sulfur atom or a selenium atom, more preferably a selenium atom.

The alkyl, alkenyl, alkynyl, aryl and heterocyclic groups represented by $V^1$ to $V^3$ and $J^1$ to $J^3$ in formula (S2) have the same meanings as those represented by $R^1$ to $R^3$ in formula (2). $V^1$ to $V^3$ and $J^1$ to $J^3$ each may have a substituent(s) as many as possible, and examples of the substituent include the same examples that are mentioned above.

As the compound represented formula (S2), the following case is preferable: Ch is a sulfur atom or a selenium atom; and $V^1$ to $V^3$ each are a substituted or unsubstituted, straight-chain or branched alkyl group having 1 to 6 carbon atoms, a substituted or unsubstituted aryl group having 6 to 10 carbon atoms, or a heterocyclic group. As the compound represented formula (S2), the following case is more preferable: Ch is a selenium atom; and $V^1$ to $V^3$ each are a substituted or unsubstituted aryl group having 6 to 10 carbon atoms.

The compound represented by formula (S3) is described below.

In formula (S3), Ch represents a sulfur atom, a selenium atom or a tellurium atom. In the present invention, Ch is preferably a selenium atom or a tellurium atom, more preferably a selenium atom.

In formula (3), $E^3$ and $E^4$ each are selected from the groups represented by any of formulae (2) to (5). $E^3$ and $E^4$ may be the same or different from each other.

In formula (S3), when $E^3$ or $E^4$ is represented by formula (2), in the present invention, $Z^1$ is preferably an alkyl group, an alkenyl group, an alkynyl group, an aryl group, or a heterocyclic group; and more preferably an alkyl group or an aryl group.

In formula (S3), when $E^3$ or $E^4$ is represented by formula (3), in the present invention, it is preferable that EWG is an acyl group, a formyl group, an alkoxy group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; $L^1$ represents a divalent linking group represented by formula (LA) or (LB); and $G^1$ to $G^4$ each are a hydrogen atom or an alkyl group. It is more preferable that EWG is an acyl group, a formyl group, an alkoxy group, a cyano group, a nitro group, an alkylsulfonyl group, an arylsulfonyl group, or an alkyl group substituted with at least two or more halogen atoms; $L^1$ represents a linking group represented by formula (LA); and $G^1$ to $G^3$ each are a hydrogen atom, an alkyl group, or an aryl group. It is further preferable that EWG is an acyl group, a formyl group, an alkoxy group, a cyano group, a nitro group, an alkylsulfonyl group, an arylsulfonyl group, or an alkyl group substituted with at least two or more halogen atoms; $L^1$ represents a divalent linking group represented by formula (LA); and $G^1$ to $G^3$ each are a hydrogen atom, or an alkyl group. It is most preferable that EWG is an acyl group, a formyl group, a cyano group, a nitro group, an alkylsulfonyl group, an arylsulfonyl group, or an alkyl group substituted with at least two or more halogen atoms; $L^1$ represents a divalent linking group represented by formula (LA); $G^1$ to $G^3$ each are a hydrogen atom or an alkyl group; and $G^1$ and $G^2$ or $G^2$ and $G^3$ bond together to form a ring.

In formula (S3), when $E^3$ or $E^4$ is represented by formula (4), in the present invention, it is preferable that $A^1$ is an oxygen atom or a sulfur atom; $R^4$ is an alkyl group or an aryl group; and $R^5$ and $R^6$ each are a hydrogen atom, an alkyl group, an aryl group, or a heterocyclic group. It is more preferable that $A^1$ is an oxygen atom or a sulfur atom; $R^4$ is an alkyl group or an aryl group; and $R^5$ and $R^6$ each are a hydrogen atom or an alkyl group. It is further preferable that $A^1$ is an oxygen atom; $R^4$ is an alkyl group; and $R^5$ and $R^6$ each are a hydrogen atom or an alkyl group.

In formula (S3), when $E^3$ or $E^4$ is represented by formula (5), in the present invention, it is preferable that $A^2$ is an oxygen atom or a sulfur atom; $R^8$ is a hydrogen atom, an alkyl group, an aryl group or an acyl group; $R^9$ and $R^{10}$ each are a hydrogen atom, an alkyl group or an aryl group; n is an integer of 0 to 2; and $X^1$ is an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt). It is more preferable that $A^2$ is an oxygen atom; $R^8$ is an alkyl group, an aryl group or an acyl group; $R^9$ and $R^{10}$ each are a hydrogen atom, an alkyl group or an aryl group; n is an integer of 0 to 1; and $X^1$ is an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt). It is further preferable that $A^2$ is an oxygen atom; $R^8$ is an alkyl group, an aryl group or an acyl group; $R^9$ and $R^{10}$ each are a hydrogen atom, an alkyl group or an aryl group; and n is 0.

In the present invention, among the compounds represented by formula (S3), preferable compounds are the following case: Ch is a selenium atom or a tellurium atom, and $E^3$ and $E^4$ each are selected from the groups represented by any of formulae (3) to (5). In a more preferable case, Ch is a selenium atom, and one of $E^3$ and $E^4$ is selected from the group of formula (5) and the other is selected from the group of formula (3), (4) or (5). In a still more preferable case, Ch is a selenium atom, and one of $E^3$ and $E^4$ is selected from the group of formula (5) and the other is selected from the group of formula (4) or (5). In a most preferable case, Ch is a selenium atom, and $E^3$ and $E^4$ each are selected from the group of formula (5).

Further, preferable examples of the compound represented by formula (S3) include those mentioned as the preferable examples of the compound represented by formula (1).

In the present invention, among the compounds represented by formula (6-1) or (6-2), preferable compounds are the following case: Au is a monovalent gold ion; $X^2$ is a halogen ion, a tetrafluoroboronate ion, a hexafluorophosphonate ion, an arylsulfonate ion or an alkylsulfonate ion; m is 1; and $W^1$ is a compound selected from compounds represented by formula (S1) or (S3). In a more preferable case, Au is a monovalent gold ion; $X^2$ is a halogen ion, a tetrafluoroboronate ion or a hexafluorophosphonate ion; m is 1; and $W^1$ is a compound selected from compounds represented by formula (S3). In a still more preferable case, Au is a monovalent gold ion; $X^2$ is a halogen ion; m is 1; and $W^1$ is a compound selected from compounds represented by formula (S3).

Next, specific examples of the compound represented by formula (6-1) or (6-2) will be shown below, but the compound for use in the present invention is not limited to these. Further, with respect to the compounds that may have a plurality of stereoisomers, their stereostructure is not limited to these.

2-1

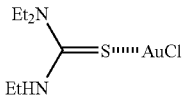

2-2

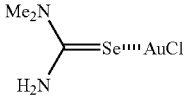

2-3

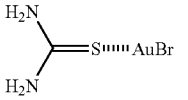

2-4

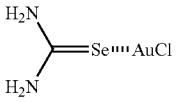

2-5

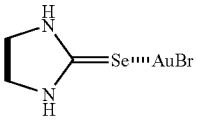

-continued
2-6
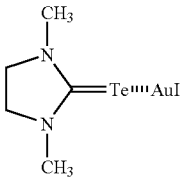
2-7
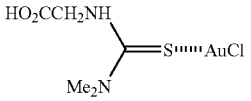
2-8
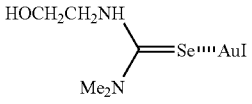
2-9
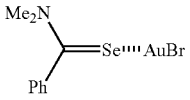
2-10
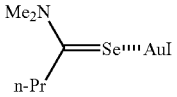
2-11
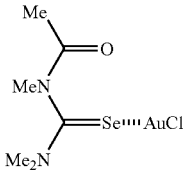
2-12
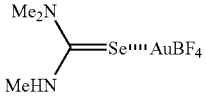
2-13
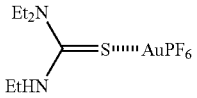
2-14
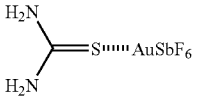
2-15
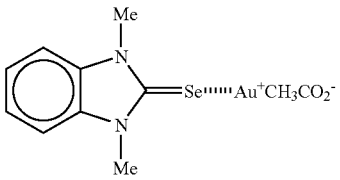
2-16
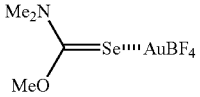

-continued
2-17 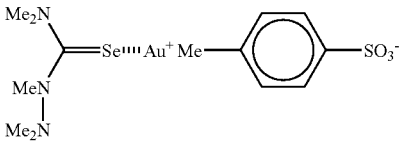
2-18 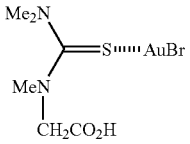
2-19 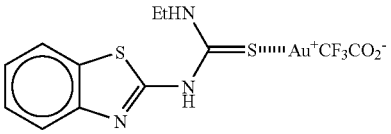
2-20 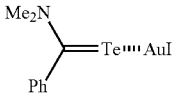
3-1 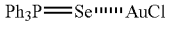
3-2 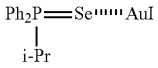
3-3 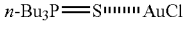
3-4 
3-5 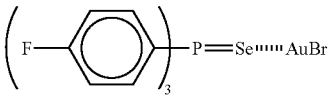
3-6 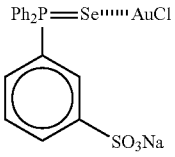
3-7 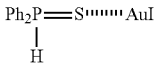
3-8 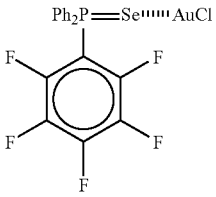
3-9 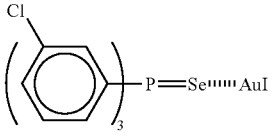

-continued
3-10 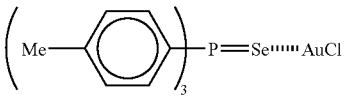
3-11 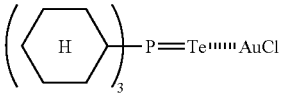
3-12 $Ph_3P{=}Se{\cdots}Au^+CH_3SO_3^-$
3-13 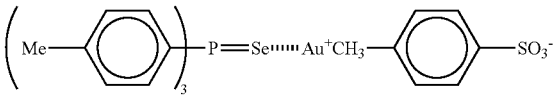
3-14 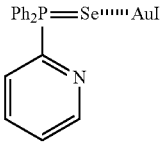
3-15 $Ph_2P{=}Se{\cdots}AuPF_6$ (NMe$_2$)
3-16 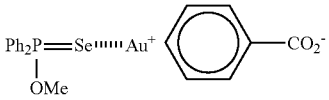
3-17 $(HOCH_2CH_2O)_3P{=}Se{\cdots}AuBr$
3-18 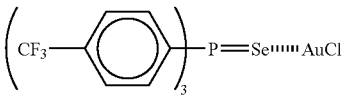
3-19 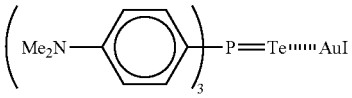
3-20 $(Me_2N)_3P{=}Te{\cdots}AuBF_4$
4-1 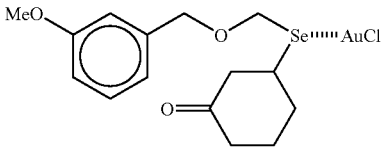
4-2 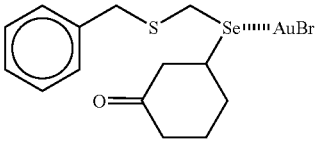
4-3 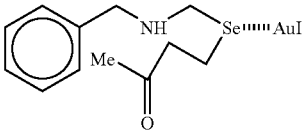

-continued
4-4
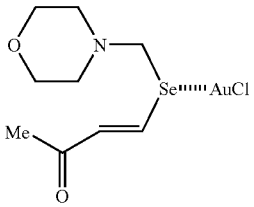
4-5
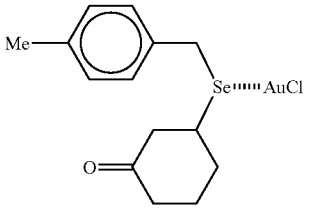
4-6
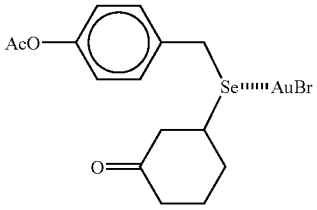
4-7
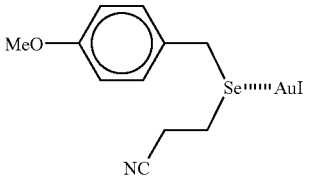
4-8
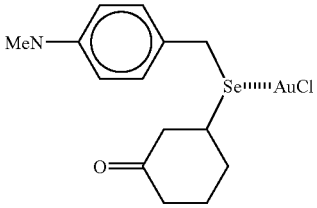
4-9
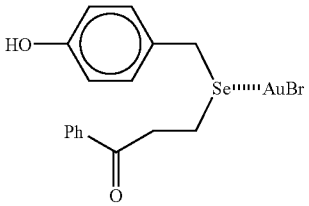
4-10
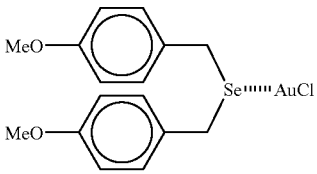

-continued
4-11
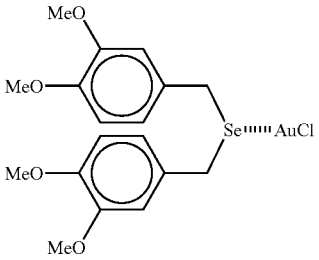
4-12
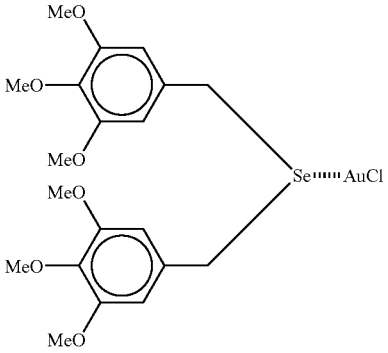
4-13
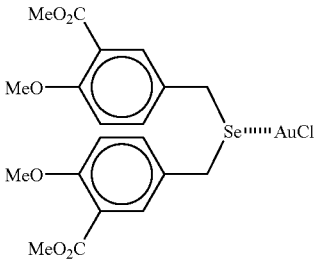
4-14
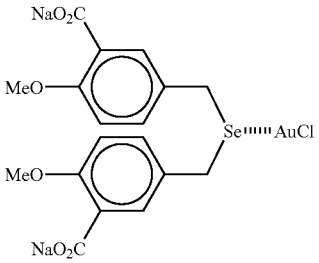
4-15
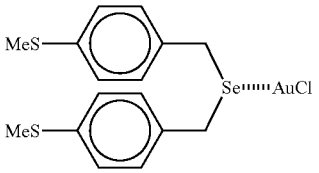
4-16
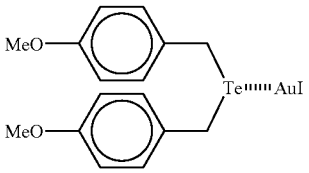

-continued
4-17
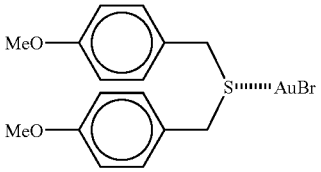
4-18
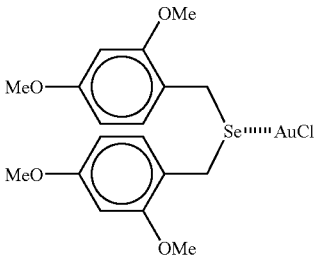
4-19
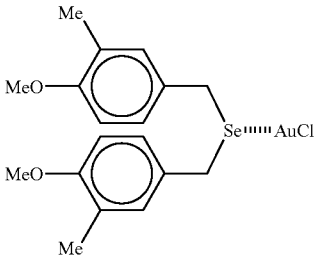
4-20
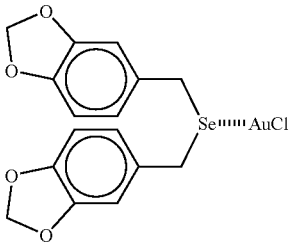
4-21
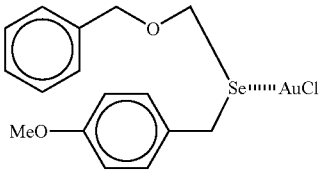
4-22
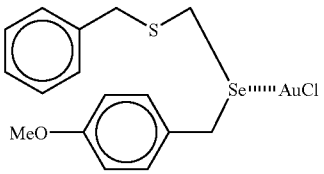
4-23
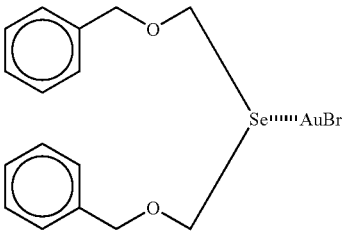

-continued
4-24
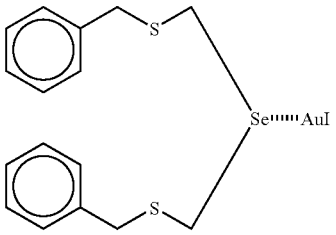
4-25
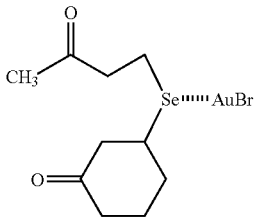
4-26
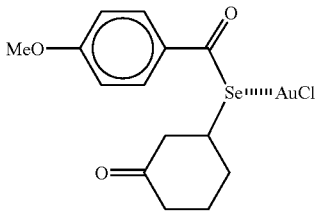
4-27
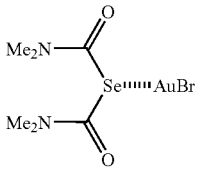
4-28
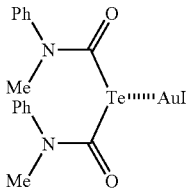
4-29
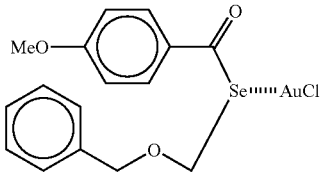
4-30
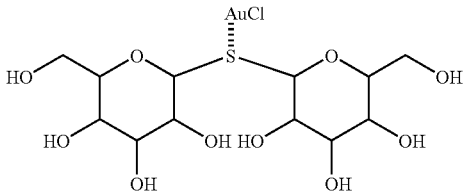

-continued
4-31
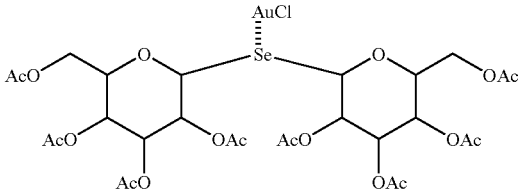
4-32
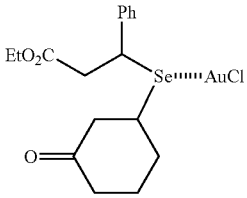
4-33
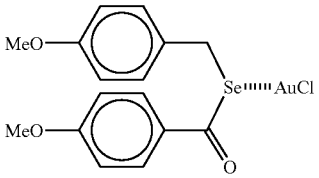
4-34
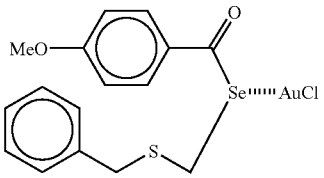
4-35
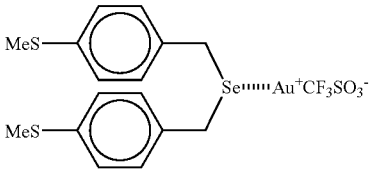
4-36
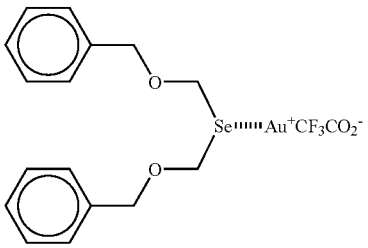
4-37
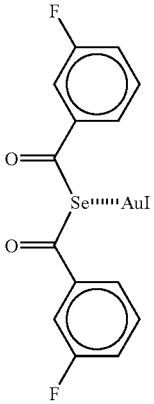

-continued
4-38
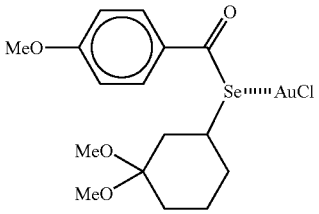
4-39
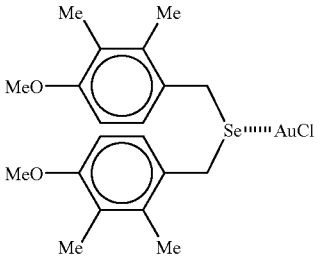
4-40
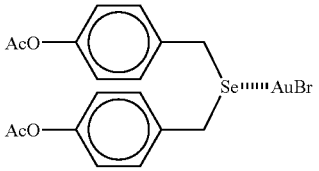
5-1
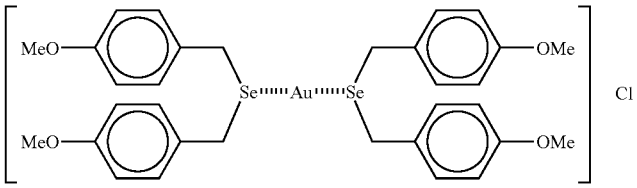
5-2
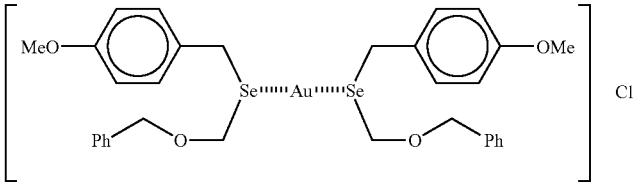
5-3
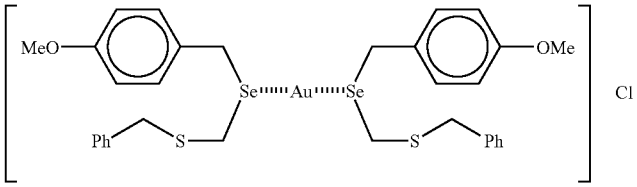
5-4
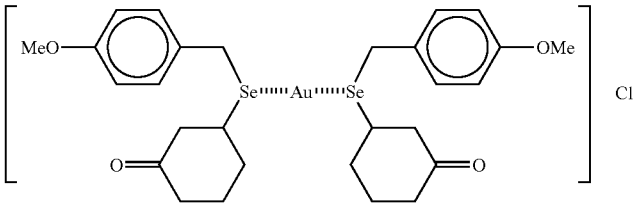

-continued
5-5
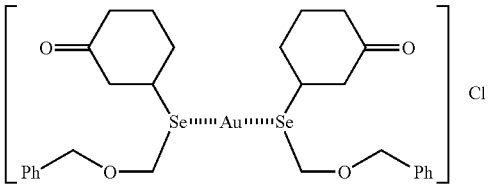
5-6
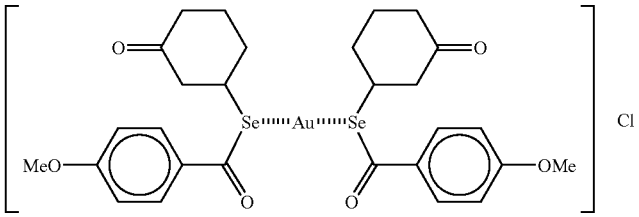
5-7
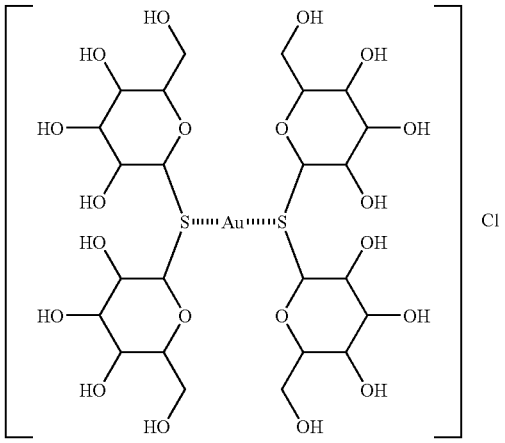
5-8
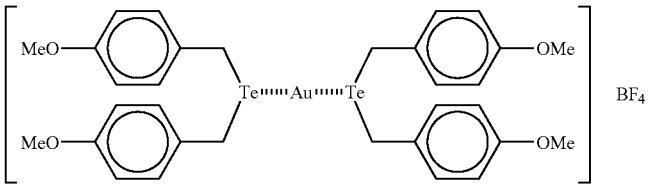
5-9
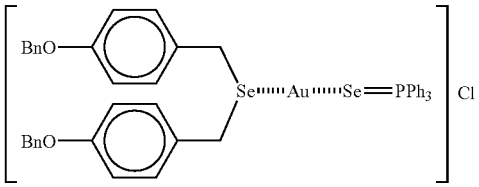
5-10
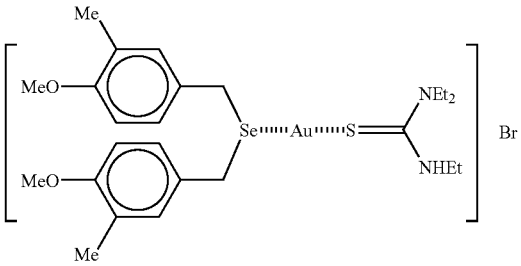

-continued 5-11

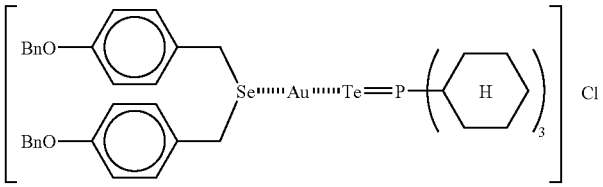

5-12

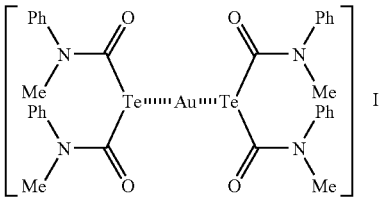

5-13

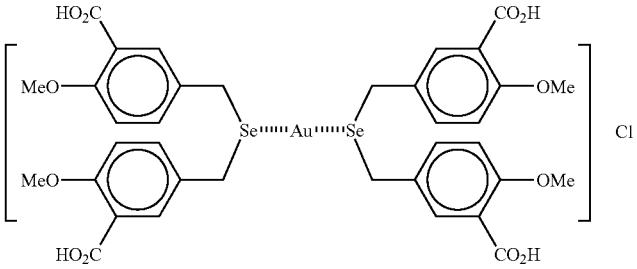

The compound represented by formula (6-1) or (6-2) for use in the present invention may be synthesized with reference to known various methods, such as the methods described in already known following documents: J. Coord. Chem., 51, 225-234 (2000), and J. Chem. Soc. Chem. Commun., 136-137 (1993). Although no example of a synthetic method to be generalized can be given, because an optimum synthetic method is to be selected according to an individual compound, useful synthesis routes among these methods will be explained.

(Synthesis of Exemplified Compound 2-2)

To 10 mL of acetone was added 744 mg of a gold chloride tetrahydrothiophene complex, and then a solution prepared by dissolving 369 mg of N,N-dimethylselenourea in 10 mL of acetone was added dropwise to the mixture. The resultant mixture was then stirred at room temperature for 30 minutes, and then cooled with ice. The precipitated solid was collected by filtration, to give 146 mg of Exemplified compound 2-2.

$^1$H NMR ($CD_3OD$) δ: 3.18 (s, 3H), 3.50 (S, 3H)

(Synthesis of Exemplified Compound 4-10)

In 20 mL of methanol was dissolved 453 mg of bis(p-methoxybenzyl)selenide, and then a solution prepared by dissolving 187 mg of sodium chloroaurate dihydrate in 4 mL of methanol was added dropwise to the mixture. The resultant mixture was then stirred at room temperature for 5 minutes. The precipitated crystals were collected by filtration, to give 238 mg of Exemplified compound 4-10.

$^1$H NMR ($CDCl_3$) δ: 3.81 (s, 6H), 4.19 (s, 4H), 6.89 (d, 4H), 7.32 (d, 4H)

(Synthesis of Exemplified Compound 4-11)

To 10 mL of acetone was added 164 mg of a gold chloride tetrahydrothiophene complex, and then to the mixture was added 205 mg of bis(3,4-dimethoxybenzyl)selenide in a solid state. The resultant mixture was stirred at room temperature for 5 minutes, and then cooled with ice. The precipitated crystals were collected by filtration, to give 86 mg of Exemplified compound 4-11.

$^1$H NMR ($CDCl_3$) δ: 3.88 (s, 6H), 3.93 (s, 6H), 4.19 (s, 4H), 6.80 (d, 2H), 6.89 (d, 2H), 7.06 (s, 2H)

(Synthesis of Exemplified Compound 5-13)

In 1 mL of methanol-$d_4$ was dissolved 58 mg of bis(3-carboxy-4-methoxybenzyl)selenide, and the resulting solution was mixed with a solution prepared by dissolving 17 mg of sodium chloroaurate in 1 mL of deuterium oxide, to give Exemplified compound 5-13.

$^1$H NMR ($CD_3OD$:$D_2O$=1:1) δ: 3.80 (s, 12H), 4.25 (s, 8H), 6.95 (d, 4H), 7.22 (d, 4H), 7.54 (s, 4H)

The compound represented by formula (S1) for use in the present invention may be synthesized with reference to known methods, for example, the methods described in Chem. Rev., 55, 181-228 (1955), J. Org. Chem., 24, 470-473 (1959), J. Heterocycl. Chem., 4, 605-609 (1967), J. Drug (Yakushi), 82, 36-45 (1962), JP-B-39-26203, JP-A-63-229449, and OLS-2,043,944.

The compound represented by formula (S2) for use in the present invention may be synthesized with reference to known methods, for example, the methods described in Organic Phosphorus Compounds, 4, 1-73; J. Chem. Soc. B, 1416 (1968); J. Org. Chem., 32, 1717 (1967); J. Org. Chem., 32, 2999 (1967); Tetrahedron, 20, 449, 1964; and J. Am. Chem. Soc., 91, 2915 (1969).

The compound represented by formula (S3) for use in the present invention may be synthesized according to the methods described in the following already known documents: The Chemistry of Organic Selenium and Tellurium Compounds, Vol. 1 (1986) and ibid. Vol. 2 (1987) edited by S. Patai and Z. Rappoport; and Organoselenium Chemistry (1987) by D. Liotta.

In the present invention, an addition amount of the compound represented by formula (6-1) or (6-2) can vary over a wide range according to the occasions, and the amount is generally in the range of $1\times10^{-7}$ to $5\times10^{-3}$ mol, preferably in the range of $5\times10^{-7}$ to $5\times10^{-4}$ mol, per mol of silver halide.

The compound represented by formula (6-1) or (6-2) for use in the present invention may be added by dissolving in a solvent, for example, of water, an alcohol (e.g., methanol and ethanol), a ketone (e.g., acetone), an amide (e.g., dimethylformamide), a glycol (e.g., methylpropylene glycol), or an ester (e.g., ethyl acetate).

The compound represented by formula (6-1) or (6-2) for use in the present invention may be added in any stage of the emulsion is produced, and it is preferably added at an appropriate time after silver halide grains are formed but before the chemical sensitization step is completed, more preferably added during the chemical sensitization or after-ripening.

The compound represented by formula (7) is described below. In formula (7), Au represents a monovalent or trivalent gold ion. In the present invention, Au is preferably a monovalent gold ion.

In formula (7), Ch represents a sulfur atom, a selenium atom or a tellurium atom. In the present invention, the case where Ch represents a sulfur atom or a selenium atom is preferable, and the case where Ch represents a selenium atom is more preferable. In formula (7), E is selected from the groups represented by formula (5).

In formula (7), L represents a compound that can coordinate with gold through a nitrogen atom, sulfur atom, selenium atom, tellurium atom or phosphorous atom. $L^2$ specifically represents any of amines, five- or six-membered nitrogen-containing hetero rings, thiols, thioethers, disulfides, thioamides, selenols, selenoethers, diselenides, selenoamides, tellurols, telluroethers, ditellurides, telluroamides, alkylphosphines, or arylphosphines, each of which may be substituted or unsubstituted. As $L^2$, the compounds represented by any of formulae (S1) to (S3) are also preferable. Also, in the case where charge is generated by the coordination of $L^2$, the compound represented by formula (7) may have a counter salt required to neutralize the charge of the compound. When the counter salt is an anion, specific examples of the anion include a halogen ion (e.g., $F^-$, $Cl^-$, $Br^-$ and $I^-$), tetrafluoroboronate ion ($BF_4^-$), hexafluorophosphonate ion ($PF_6^-$), hexafluoroantimonate ion ($SbF_6^-$), sulfuric acid ion ($SO_4^{2-}$), arylsulfonate ion (e.g., p-toluenesulfonate ion, and naphthalene-2,5-disulfonate ion), and carboxy ion (e.g., acetic acid ion, trifluoroacetic acid ion, oxalic acid ion, and benzoic acid ion). When the counter salt is a cation, specific examples of the cation include an alkali metal ion (e.g., lithium cation, sodium cation, and potassium cation), alkali earth metal ion (e.g., magnesium ion, and calcium ion), substituted or unsubstituted ammonium ion (e.g., ammonium, triethylammonium, and tetramethylammonium), and substituted or unsubstituted pyridinium ion (e.g., pyridinium, and 4-phenylpyridinium). In the present invention, the counter salt is preferably a cation, and more preferably an alkali metal ion, an alkali earth metal ion, or a substituted or unsubstituted ammonium ion.

In formula (7), when $L^2$ is an amine, preferable examples of the amine include primary, secondary or tertiary alkylamines having 1 to 30 carbon atoms, substituted or unsubstituted, and primary, secondary or tertiary anilines having 6 to 30 carbon atoms.

In formula (7), when $L^2$ is a five- or six-membered nitrogen-containing hetero ring, examples of the hetero ring include five- or six-membered nitrogen-containing hetero rings constituted of a combination of nitrogen, oxygen, sulfur and carbon. Also, this nitrogen-containing hetero rings may have a substituent. Examples of the substituent include the same groups as those explained as the substituent previously. This nitrogen-containing hetero ring may coordinate with gold through a nitrogen atom in the hetero ring, or alternatively, when the nitrogen-containing hetero ring has a substituent, the hetero ring may coordinate with gold through this substituent. Preferable examples of $L^2$ include benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine and morpholine, each of which may be substituted. $L^2$ is more preferably benzotriazole, triazole, tetrazole or indazole, each of which may be substituted; and most preferably benzotriazole, which may be substituted.

In formula (7), the thiol compound represented by $L^2$ is specifically any of alkylthiols, arylthiols or heterocyclic thiols. Also, these thiol compounds may be substituted. Examples of the substituent include the same groups as those explained as the substituent previously.

In formula (7), the alkyl group that the alkylthiol compound represented by $L^2$ has is a substituted or unsubstituted, straight-chain, branched or cyclic alkyl group having 1 to 30 carbon atoms, and preferably 1 to 20 carbon atoms.

In formula (7), the aryl group that the arylthiol compound represented by $L^2$ has is a substituted or unsubstituted, monocyclic or condensed-cyclic aryl group having 6 to 30 carbon atoms. Examples of the aryl group include a phenyl group or naphthyl group, and the aryl group is preferably a substituted or unsubstituted phenyl group.

In formula (7), the heterocyclic group that the heterocyclic thiol compound represented by $L^2$ has is a five- to seven-membered substituted or unsubstituted and saturated or unsaturated hetero ring containing at least one nitrogen atom, oxygen atom or sulfur atom. The heterocyclic group may be monocyclic or may form a condensed ring in combination with other aryl ring or hetero ring. The heterocyclic group is a preferably five- or six-membered cyclic group. Examples of the heterocyclic group include a pyrrolyl group, pyrrolidinyl group, pyridyl group, piperidyl group, piperazinyl group, imidazolyl group, pyrazolyl group, pyrazinyl group, pyrimidinyl group, triazinyl group, triazolyl group, tetrazolyl group, quinolyl group, isoquinolyl group, indolyl group, indazolyl group, benzoimidazolyl group, furyl group, pyranyl group, chromenyl group, thienyl group, oxazolyl group, oxadiazolyl group, thiazolyl group, thiadiazolyl group, benzoxazolyl group, benzothiazolyl group, morpholino group, or morpholinyl group.

In formula (7), the thioether represented by $L^2$ is a thioether compound in which an alkyl group, aryl group or heterocyclic group bonds to a sulfur atom, and in which the group may be either symmetrically or asymmetrically substituted with respect to the sulfur atom in the compound. Specific examples of the thioether include dialkyl thioethers, diaryl thioethers, diheterocyclic thioethers, alkyl aryl thioethers, alkyl heterocyclic thioethers and aryl heterocyclic thioethers. The alkyl group, aryl group or heterocyclic group that the thioether compound represented by $L^2$ has may be substituted. Examples of the substituent include the same groups as those explained as the substituent above.

In formula (7), the alkyl group that the thioether compound represented by $L^2$ has is a substituted or unsubstituted, straight-chain, branched or cyclic alkyl groups having 1 to 30 carbon atoms, and preferably 1 to 20 carbon atoms.

In formula (7), the aryl group that the thioether compound represented by $L^2$ has is a substituted or unsubstituted, monocyclic or condensed-cyclic aryl group having 6 to 30 carbon atoms. The aryl group is, for example, a phenyl group or naphthyl group, and is preferably a substituted or unsubstituted phenyl group.

In formula (7), the heterocyclic group that the thioether compound represented by $L^2$ has is a five- to seven-membered, substituted or unsubstituted, and saturated or unsaturated hetero ring containing at least one nitrogen atom, oxygen atom or sulfur atom. The heterocyclic group may be monocyclic, or may form a condensed ring in combination with other aryl ring or hetero ring. The heterocyclic group is preferably a five- or six-membered cyclic group. Examples of the heterocyclic group include a pyrrolyl group, pyrrolidinyl group, pyridyl group, piperidyl group, piperazinyl group, imidazolyl group, pyrazolyl group, pyrazinyl group, pyrimidinyl group, triazinyl group, quinolyl group, isoquinolyl group, indolyl group, indazolyl group, benzoimidazolyl group, pyranyl group, chromenyl group, thienyl group, oxazolyl group, thiazolyl group, benzoxazolyl group, benzothiazolyl group, morpholino group, and morpholinyl group.

The thioether compound for use in the present invention is preferably a symmetrical or asymmetrical dialkyl thioether, diaryl thioether or alkyl aryl thioether.

In formula (7), the disulfide represented by $L^2$ is a disulfide compound in which an alkyl group, aryl group or heterocyclic group bonds to a sulfur atom, and in which the group may be substituted either symmetrically or asymmetrically with respect to the disulfide group in the compound. Specific examples of the disulfide include dialkyldisulfides, diaryldisulfides, diheterocyclic disulfides, alkyl/aryldisulfides, alkyl/heterocyclic disulfides, and aryl/heterocyclic disulfides. The disulfide for use in the present invention is preferably a symmetrical or asymmetrical, dialkyldisulfide, diaryldisulfide, or alkyl/aryl disulfide. The alkyl group, aryl group or heterocyclic group that the disulfide compound represented by $L^2$ has may be substituted. Examples of the substituent include the same groups as those explained as the substituent above.

In formula (7), the alkyl group, aryl group or heterocyclic group that the disulfide compound represented by $L^2$ has, has the same meaning as that in the case where $L^2$ is the thioether compound, and the preferable ranges each are also the same.

In formula (7), when $L^2$ is a thioamide, the thioamido group may be either a part of a cyclic structure or a non-cyclic thioamido group. Useful thioamide compound may be selected from those disclosed in, for example, U.S. Pat. Nos. 4,030,925, 4,031,127, 4,080,207, 4,245,037, 4,255,511, 4,266,031 and 4,276,364, Research Disclosure, vol. 151, (November, 1976), Item 15162, and Research Disclosure, vol. 176 (December, 1978), Item 17626. When $L^2$ is a thioamide, preferable examples of the thioamide compound include thiourea, thiourethane, dithiocarbamate, 4-thiazoline-2-thion, thiazolidine-2-thion, 4-oxazoline-2-thion, oxazolidine-2-thion, 2-pyrazoline-5-thion, 4-imidazoline-2-thion, 2-thiohydantoin, rhodanine, isorhodanine, 2-thio-2,4-oxazolidinedione, thiobarbituric acid, tetrazoline-5-thion, 1,2,4-triazoline-3-thion, 1,3,4-thiadiazoline-2-thion, 1,3,4-oxadiazoline-2-thion, benzimidazoline-2-thion, benzoxazoline-2-thion, and benzothiazoline-2-thion, each of which may be substituted.

In formula (7), when $L^2$ represents a selenol compound, typical examples of the selenol compound include alkylselenols, arylselenols, and heterocyclic selenols. Examples of the selenol compound include compounds that can be obtained by the substitution of the thiol group with a selenol group, in the thiol compounds represented by $L^2$ as mentioned in the above.

In formula (7), the selenoether compound represented by $L^2$ is a selenoether compound in which an alkyl group, aryl group or heterocyclic group bonds to a selenium atom, and in which the group may be substituted either symmetrically or asymmetrically with respect to the selenium atom in the compound. Specific examples of the selenoether compound include dialkyl selenoethers, diaryl selenoethers, diheterocyclic selenoethers, alkyl aryl selenoethers, alkyl heterocyclic selenoethers, and aryl heterocyclic selenoethers. The selenoether compound for use in the present invention is preferably a symmetrical or asymmetrical dialkyl selenoether, diaryl selenoether, or alkyl aryl selenoether. The alkyl group, aryl group or heterocyclic group that the selenoether compound represented by $L^2$ has may be substituted. Examples of the substituent include the same groups as those explained as the substituent above.

In formula (7), the alkyl group, aryl group or heterocyclic group that the selenoether compound represented by $L^2$ has, has the same meaning as that in the case where $L^2$ is the thioether compound, and the preferable ranges each are also the same.

In formula (7), the diselenide compound represented by $L^2$ is a diselenide compound in which an alkyl group, aryl group or heterocyclic group bonds to a selenium atom, and in which the group may be substituted either symmetrically or asymmetrically with respect to the diselenide group in the compound. Specific examples of the diselenide compound include dialkyldiselenides, diaryldiselenides, diheterocyclic diselenides, alkyl/aryldiselenides, alkyl/heterocyclic diselenides, and aryl/heterocyclic diselenides. The diselenide for use in the present invention is preferably a symmetrical or asymmetrical dialkyl diselenide, diaryl diselenide, or alkyl/aryl diselenide. The alkyl group, aryl group or heterocyclic group that the diselenide compound represented by $L^2$ has may be substituted. Examples of the substituent include the same groups as those explained as the substituent above.

In formula (7), the alkyl group, aryl group or heterocyclic group that the diselenide compound represented by $L^2$ has, has the same meaning as that in the case where $L^2$ is the thioether compound, and the preferable ranges each are also the same.

In formula (7), when $L^2$ is a selenoamide compound, examples of $L^2$ include compounds obtained by replacing the sulfur atom with a selenium atom, in the thioamide compound represented by $L^2$.

In formula (7), when $L^2$ represents a tellurol compound, specific examples of the tellurol compound include alkyltellurols, aryltellurols, and heterocyclic tellurols. Examples of the tellurol compound include compounds obtained by replacing the thiol group with a tellurol group, in the above-described thiol compound represented by $L^2$.

In formula (7), when $L^2$ is a telluroether compound, examples of $L^2$ include compounds obtained by replacing the sulfur atom with a tellurium atom, in the thioether compound represented by $L^2$.

In formula (7), when $L^2$ is the ditelluride compound, examples of $L^2$ include compounds obtained by replacing the sulfur atom with a tellurium atom, in the disulfide compound represented by $L^2$.

In formula (7), when $L^2$ is a telluroamide compound, examples of $L^2$ include compounds obtained by replacing the sulfur atom with a tellurium atom, in the thioamide compound represented by $L^2$.

In formula (7), when $L^2$ is an alkylphosphine, the alkylphosphine is preferably a primary, secondary or tertiary alkylphosphine having 1 to 20 carbon atoms. When $L^2$ is an arylphosphine, the arylphosphine is preferably a primary, secondary or tertiary arylphosphine having 6 to 30 carbon atoms.

In the present invention, $L^2$ is preferably any of 5- to 6-membered nitrogen-containing hetero rings, thiols, thioethers, thioamides, selenols, selenoethers, selenoamides, alkylphosphines, or arylphosphines; more preferably any of five- or six-membered nitrogen-containing hetero rings, thiols, thioethers, thioamides, selenoethers, or selenoamides; still more preferably any of thiols, thioethers, thioamides, selenoethers, or selenoamides; and most preferably any of thioethers, thioamides, or selenoamides, each of which may have a substituent(s).

In the present invention, in formula (7), 1 denotes an integer from 0 to 3, and l is preferably 0 or 1, more preferably 0.

In the present invention, among the compounds represented by formula (7), it is preferable that Au is a monovalent gold ion, Ch represents a sulfur atom or selenium atom, $A^2$ represents an oxygen tom, a sulfur atom or $NR^{11}$, $R^8$ represents a hydrogen atom, an alkyl group, an aryl group or an acyl group, $R^9$ and $R^{10}$ each represent a hydrogen atom, an alkyl group or an aryl group, $R^{11}$ represents a hydrogen atom, an alkyl group or an aryl group, n denotes 0 to 2, $X^1$ represents an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt), 1 denotes 0 or 1, and $L^2$ represents a five- or six-membered nitrogen-containing hetero ring, a thiol, a thioether, a thioamide, a selenoether or a selenoamide. It is more preferable that Au is a monovalent gold ion, Ch represents a sulfur atom or selenium atom, $A^2$ represents an oxygen atom, a sulfur atom or $NR^{11}$, $R^8$ represents an alkyl group, $R^9$ and $R^{10}$ each represent a hydrogen atom or an alkyl group, $R^{11}$ represents an alkyl group or an aryl group, n denotes 0 to 2, $X^1$ represents an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt), 1 denotes 0 or 1, and $L^2$ represents a thiol, a thioether, a thioamide, a selenoether or a selenoamide. It is further preferable that Au is a monovalent gold ion, Ch represents a sulfur atom or selenium atom, $A^2$ represents an oxygen atom, a sulfur atom or $NR^{11}$, $R^8$ represents an alkyl group, $R^9$ and $R^{10}$ each represent a hydrogen atom or an alkyl group, $R^{11}$ represents an alkyl group, n denotes 0 to 2, $X^1$ represents an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt), and 1 denotes 0. It is most preferable that Au is a monovalent gold ion, Ch represents a sulfur atom or selenium atom, $A^2$ represents O, $R^8$represents an alkyl group, one of $R^9$ and $R^{10}$ is a hydrogen atom and the other is a hydrogen atom or an alkyl group, n denotes 0 to 1, $X^1$ represents an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group or a sulfo group (including its salt), and 1 denotes 0.

Next, specific examples of the compound represented by formula (7) will be shown below, but the present invention is not limited to these. Further, with respect to the compounds that may have a plurality of stereoisomers, their stereostructure is not limited to these.

A-1

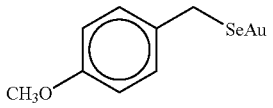

A-2

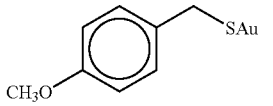

A-3

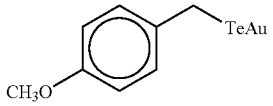

A-4

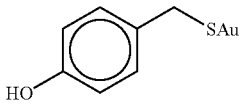

A-5

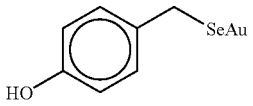

-continued
A-6
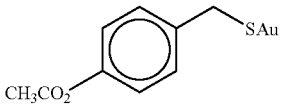
A-7
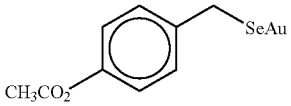
A-8
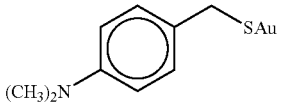
A-9
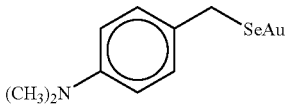
A-10
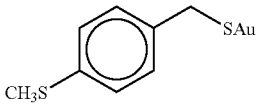
A-11
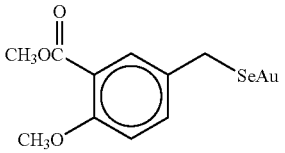
A-12
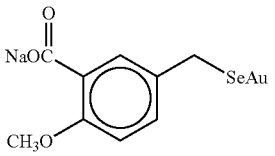
A-13
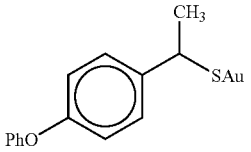
A-14
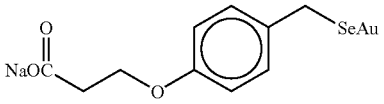
A-15
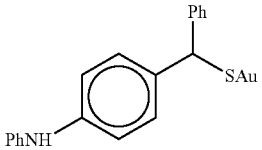
A-16
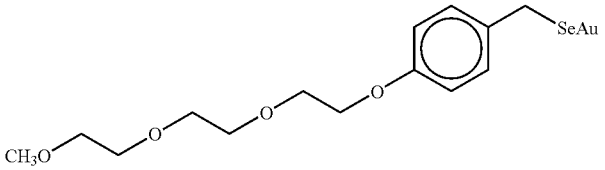

-continued
A-17
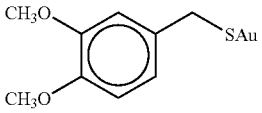
A-18
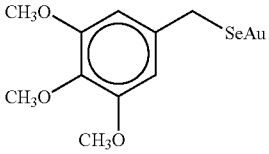
A-19
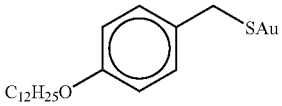
A-20
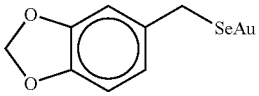
A-21
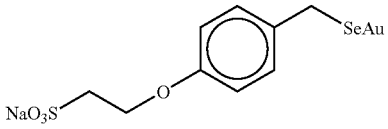
A-22
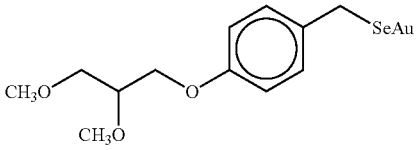
A-23
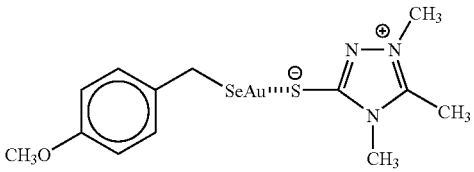
A-24
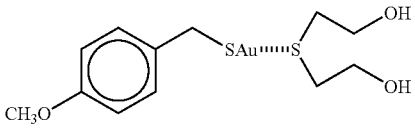
A-25
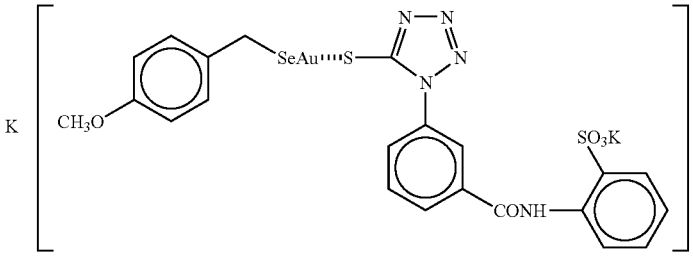
A-26
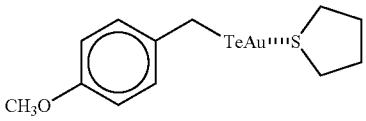

-continued
A-27
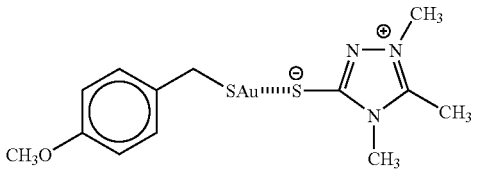
A-28
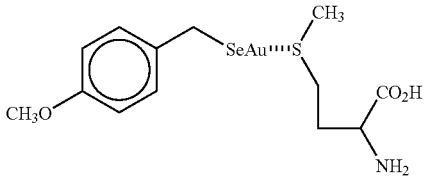
A-29
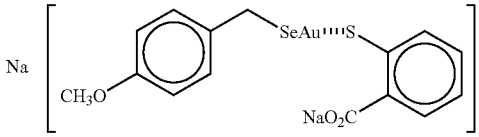
A-30
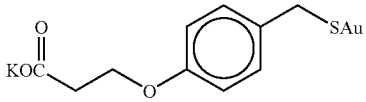
A-31
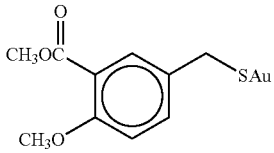
A-32
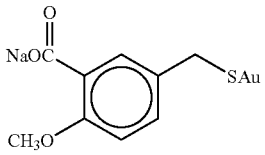
A-33
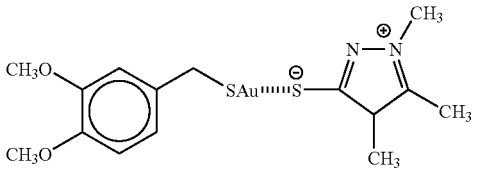
A-34
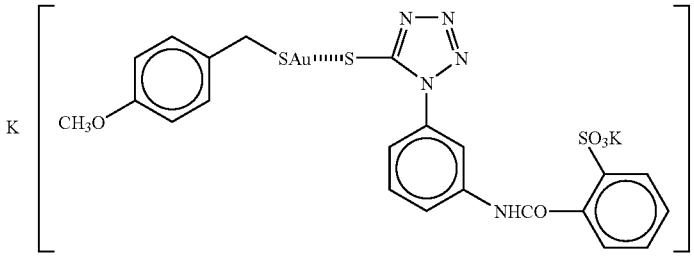
A-35
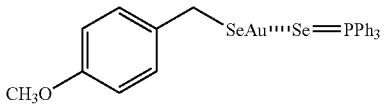

-continued
A-36
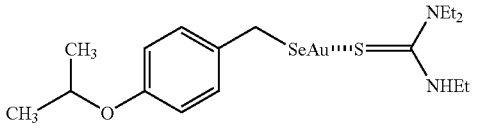
A-37
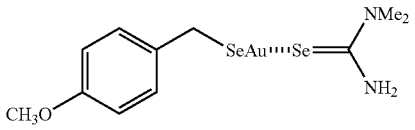
A-38
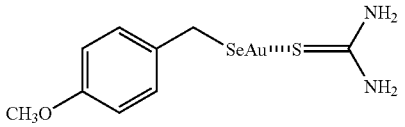
A-39
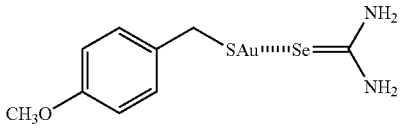
A-40
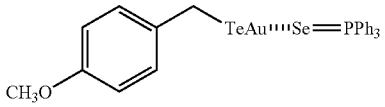
A-41
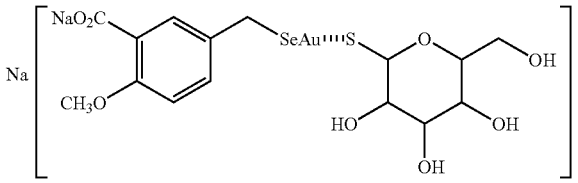
A-42
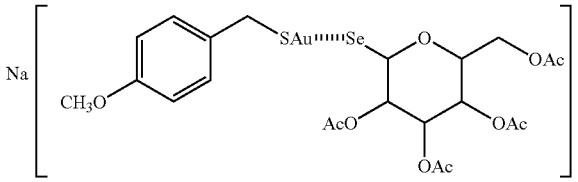
A-43
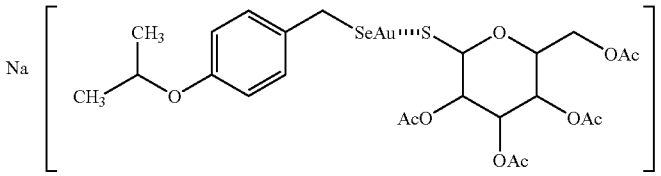
A-44
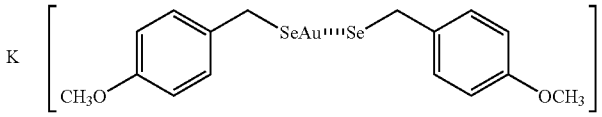
A-45
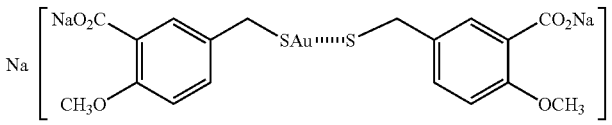

-continued

A-46

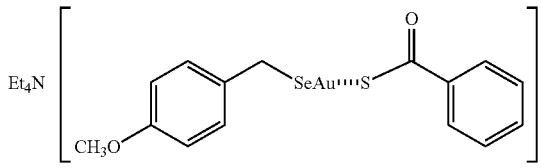

A-47

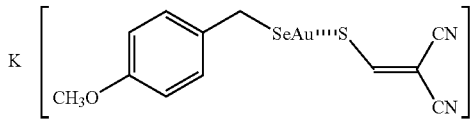

A-48

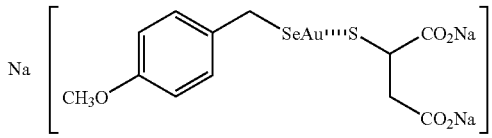

A-49

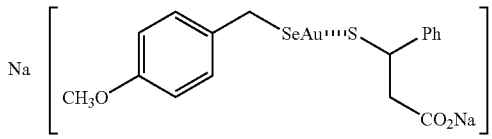

A-50

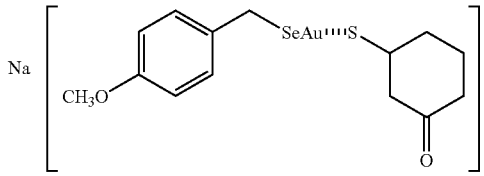

The compound represented by formula (7) for use in the present invention can be synthesized by known various methods. Although no example of a synthetic method to be generalized can be given because an optimum synthetic method is to be selected according to an individual compound, useful synthesis routes among these methods will be explained.

(Synthesis of Exemplified Compound A-1)

One g of 4-methoxybenzyl chloride and 0.7 g of selenourea were added to 30 mL of acetone, and the mixture was stirred at 45° C. for one hour. The mixture was cooled to room temperature, and the precipitated crystals were collected by filtration. 0.41 g of the crystals were dissolved in 6 mL of methanol, to which was then added dropwise 0.6 mL of a 28% sodium methoxide methanol solution under cooling with ice. To the solution was added 40 mL of an acetone solution containing 0.42 g of gold (I) chloride tetrahydrothiophene complex. The mixture was stirred for 30 minutes, and the precipitated crystals were collected by filtration, to give 0.41 g of Exemplified compound A-1. m.p.: 135° C. (decomposed)

(Synthesis of Exemplified Compound A-11)

Fifty g of 5-formylsalicylic acid was dissolved in 500 mL of methanol, and 33 mL of thionyl chloride was added dropwise to the mixture at room temperature. After the reaction solution was refluxed under heating for 3 hours, the solvents were distilled off, and 200 mL of ethyl acetate and 100 mL of an aqueous sodium chloride solution were added to the residue, to extract the organic phase, which was then dried over sodium sulfate, followed by distilling the solvents off. 500 mL of acetone, 67.6 g of potassium carbonate and 30 mL of methyl iodide were added to the residue, and the mixture was refluxed under heating for 6 hours. After the precipitated solid was removed by filtration, the solvents were distilled off. 200 mL of chloroform and 100 mL of an aqueous 5% potassium carbonate solution were added to the residue, to extract the organic phase. Then, the organic phase was washed with an aqueous sodium chloride solution, and dried over sodium sulfate, followed by distilling the solvents off. The crystals precipitated by adding 95% ethanol were collected by filtration. To 14.5 g of the crystals were added 80 mL of methanol and 2.8 g of sodium borohydride, and the mixture was stirred at room temperature for 4 hours. The solvents were distilled off, and 100 mL of ethyl acetate and 100 mL of dilute hydrochloric acid were added to the residue, to extract the organic phase. The organic phase was washed with an aqueous sodium chloride solution, and dried over sodium sulfate, followed by distilling the solvents off. 100 mL of methylene chloride was added to the residue, to which was then added dropwise 50 mL of a methylene chloride solution containing 5.9 mL of thionyl chloride and 9.7 g of benzotriazole under cooling with ice. The precipitated crystals were separated by filtration, and 100 mL of water was added to the crystals to wash the organic phase, which was then dried over magnesium sulfate, followed by distilling the solvents off. 120 mL of acetone and 4 g of selenourea were added to 7.8 g of this residue, and the mixture was stirred under heating for one hour. After the reaction solution was cooled with ice, the precipitated crystals were collected by filtration. 0.5 g of the crystals were dissolved in 6 mL of methanol, and 0.6 mL of a 28% sodium methoxide methanol solution was added dropwise to the crystals, under cooling with ice. 40 mL of an acetone solution containing 0.42 g of gold (I) chloride tetrahydrothiophene complex was added to the solution. The mixture was stirred for 30 minutes, and the precipitated crystals were collected by filtration, to give 0.39 g of Exemplified compound A-11.

An addition amount of the compound represented by formula (7) for use in the present invention can vary over a wide range according to the occasions, but the amount is generally in the range of $1\times10^{-6}$ to $5\times10^{-3}$ mol, preferably in the range of $5\times10^{-6}$ to $5\times10^{-4}$ mol, per mol of silver halide.

The compound represented by formula (7) for use in the present invention may be added by dissolving in a solvent, for example, of water, an alcohol (e.g., methanol and ethanol), a ketone (e.g., acetone), an amide (e.g., dimethylformamide), a glycol (e.g., methylpropylene glycol), or an ester (e.g., ethyl acetate).

The compound represented by formula (7) for use in the present invention may be added in any stage of the production of the emulsion. It is preferable to add the compound at an appropriate time after the silver halide grains are formed but before the chemical sensitization step is completed.

The silver halide grain for use in the silver halide color photographic light-sensitive material of the present invention is described in detail below.

The silver halide emulsion according to the present invention is not particularly limited from the viewpoint of grain shape. In the present invention, use can be preferably made of a silver halide emulsion comprising silver halide grains composed of cubic, tetradecahedral or octahedral crystal grains substantially having (100) planes, which grains may be rounded at the apexes thereof and may have planes of higher order, in which emulsion the proportion of the grains accounts for 50% or more in terms of the total projected area of all the silver halide grains. Alternatively, use can also be preferably made of a silver halide emulsion, in which the proportion of silver halide grains composed of tabular grains having an aspect ratio of 2 or more (preferably 5 to 200) and being composed of (100) or (111) planes as the main face, accounts for 50% or more in terms of the total projected area of all the silver halide grains. The term "aspect-ratio" refers to the value obtained by dividing the diameter of a circle having an area equivalent to the projected area of an individual grain, by the thickness of the grain.

Next, tabular grains having an aspect ratio of 2 or more whose main face is composed of a (111) plane, which can be preferably used in the present invention, is described below.

Tabular grains for use in the present invention each have one twin plane or two or more parallel twin planes. The term "twin plane" means a (111) plane that ions at all lattice points on the both sides of the (111) plane have a mirror image relationship. When this tabular grain is viewed in a direction perpendicular to the main planes of the grain, it has any of triangular, hexagonal, and intermediate truncated triangular shapes, each having outer surfaces parallel to each other.

The silver halide grains not comprehended in the tabular grains include regular crystal grains, and grains having two or more nonparallel twin planes. The grains having two nonparallel twin planes include those having the configuration of a triangular pyramid or a rod. These are collectively referred to as "nontabular grains".

In the measurement of the equivalent circle diameter and thickness of the tabular grains, a transmission electron micrograph according to the replica method is taken, from which the diameter of a circle having an area equal to the projected area of the parallel external surfaces of an individual grain (this diameter is referred to an equivalent circle diameter) and the thickness thereof are determined. The grain thickness is calculated from the length of the shadow of the replica. With respect to the nontabular grains, the equivalent circle diameter is defined as the diameter of a circle having an area equal to the maximized projected area of an individual grain. When there is no plane parallel to a base as encountered in, for example, grains having the shape of a triangular pyramid among the nontabular grains, the thickness of the nontabular grains is defined as the distance between the base and the vortex thereof.

The silver halide tabular grain for use in the present invention is preferably comprised of: a core portion of silver iodobromide which is free of growth ring structure and has a thickness of 0.1 μm or less; and 10 or more dislocation lines (preferably in a shell portion).

The silver iodide content of the core portion of the tabular grains for use in the present invention is preferably from 1 to 40 mol %, more preferably from 1 to 20 mol %, and most preferably from 1 to 10 mol %.

The tabular grains for use in the present invention are preferably that no growth ring structure is observed in the core portion. The growth ring structure refers to a growth ring pattern observed when tabular grains are subjected to growth of silver iodobromide according to a usual DJ (double jet) method. The growth ring structure is presumed to be dislocation of twinned crystal introduced by the presence of iodide ions, and also presumed to provide unnecessary electron traps on grain surfaces. The growth ring structure is observed as lines parallel to grain sides. The growth ring structure can be observed in the same manner as employed in the observation of dislocation lines described later.

The tabular grains free of the above growth ring structure can be obtained by carrying out the grain growth according to the fine grain addition growth method in place of the usual DJ method. With respect to this fine grain addition growth method, reference can be made to, for example, JP-A-10-43570.

In the present invention, the dislocation line(s) can be introduced, for example, into the fringe portion of an individual tabular grain. In this case, the dislocations are almost perpendicular to the outer surface (outer circumference), and dislocation lines are generated in a direction from a position away from the center of the tabular grain by a distance that is x % of a length between the center and an edge (outer surface), to the outer surface. A value of x is preferably 10 or more but less than 100, more preferably 30 or more but less than 99, and most preferably 50 or more but less than 98. In this case, a shape that is obtained by connecting positions at which dislocation lines start is close to a similar figure of the grain, but is not always a completely similar figure, i.e., sometimes the shape is distorted. A dislocation line of this type is not viewed in a center region of the grain. The direction of dislocation lines is crystallographically about the direction of (211), but sometimes the dislocation lines extend in a zigzag manner, or cross each other.

When an extremely thin section of tabular grains having dislocation lines introduced in the fringe portions is observed through a transmission electron microscope, generally four contrast straight lines parallel to the main planes are observed. These are classified into two lines close to the grain surface and two inner lines.

The two inner lines are attributed to twin planes. Most of the tabular grains contain two twin planes, so that the two lines corresponding thereto are observed. In such rare cases that there are three twin planes, three lines corresponding thereto are observed. In these cases, five dislocation lines are observed on the extremely thin section of tabular grains.

The two lines close to the main planes are attributed to the step of epitaxial growth of silver halide on fringe portions at the time of dislocation introduction. The silver halides subjected to the epitaxial growth have a silver iodide content higher than that of the core grains and are grown under such conditions that deposition occurs mainly on the fringe portions. Under such conditions as well, however, a small amount of phase with high silver iodide content is also formed on the main plane portions. This phase with high silver iodide content, because of the halogen composition difference from that of the surrounding portions, is observed as straight lines. That is, on the basis of these two lines as a border, the grain inner portions and the grain surface-side portions can be identified as the core portions and the shell portions, respectively.

Dislocation lines of tabular grains can be observed by a direct method using a transmission-type electron microscope at low temperatures, as described, for example, by J. F. Hamilton in Phot. Sci. Eng., 11, 57 (1967), or by T. Shiozawa in J. Soc. Phot. Sci. Japan, 35, 213 (1972). That is, silver halide grains, carefully taken out from the emulsion in such a way that pressure is not applied to generate dislocation lines in the grains, are placed on a mesh for electron microscope observation and are observed by the transmission method, with the sample cooled to prevent it from suffering damage (e.g. print-out) by the electron beam. In this case, the greater the thickness of the grains is, the more difficult it is for the electron beam to be transmitted. Therefore, clearer observation can be effected using an electron microscope of a high-pressure type (200 kv or over acceleration voltage for grains having a thickness of 0.25 μm). From the photograph of the grains obtained in this way, the locations and the number of dislocation lines of the individual grains, seen in the direction vertical to the main (principal) planes, can be found.

The silver halide tabular grains for use in the present invention have preferably 10 or more dislocation lines. When the dislocation lines exist in a crowded condition, or are viewed as being crossed with each other, it is sometimes difficult to exactly count the number of dislocation lines per grain. However, it is possible to count them with such accuracy as identifying about 10, 20, or 30 lines, even in these cases, which can be clearly distinguished from there being only several dislocation lines present. The average number of dislocation lines per grain is determined by counting the number of dislocation lines with respect to 100 grains or more, and then averaging them in number. In some cases, it is observed that several hundreds of dislocation lines exist.

Further, the tabular grain may have the dislocation lines almost uniformly at all through the outer surface or at a localized region on the outer surface. That is, taking hexagonal tabular silver halide grains as an example, the dislocation lines may be limited to only a vicinity of 6 apices, or to only a vicinity of 1 apex among the 6 apices. On the contrary, the dislocation lines can be limited to only the sides excluding a vicinity of the 6 apices.

Further, the dislocation lines may be formed over the region including a center of two parallel main planes of the tabular grain. When the dislocation lines are formed all over the region of the main planes, a direction of the dislocation lines, when viewed from the direction perpendicular to the main plane, is usually crystallographically almost the direction of (211), but sometimes the direction is of (110) or at random. Furthermore, each length of the dislocation lines is also random. Therefore, some dislocation lines are observed as a short line on the main plane, and other dislocation lines are observed as a long line extending to the side (outer surface). Some dislocation lines are straight, but many others extend in a zigzag manner. Further, in many cases, they are crossed each other.

The position of dislocation lines may be limited to on the outer surface, the main plane, or a localized region, as mentioned above, or the dislocation lines may be formed at a combination thereof. That is to say, the dislocation lines may exist simultaneously on both the outer surface and the main plane.

The introduction of dislocation lines in the tabular grains can be accomplished by disposing a specified phase of high silver iodide content within the grains. In this case, the phase of high silver iodide content may be provided with discontinuous regions of high silver iodide content. Specifically, the phase of high silver iodide content within the grains can be obtained by first preparing base grains (core portions), then providing them with a phase of high silver iodide content, and thereafter covering the outside thereof with a phase of silver iodide content lower than that of the phase of high silver iodide content. The silver iodide content of tabular grains as core portions is lower than that of the phase of high silver iodide content, and is preferably 0 to 20 mol %, more preferably 0 to 15 mol %.

The "high-silver iodide phase in the grain (in an internal portion of the grain)" referred to means a silver halide solid solution containing silver iodide. In this case, preferred examples of the silver halide include silver iodide, silver iodobromide, and silver chloroiodobromide, and more preferably silver iodide or silver iodobromide (silver iodide content is 10 to 40 mol % to the silver halide contained in the high-silver iodide phase). In order to form a high-silver iodide phase in an internal selective position of the grain (hereinafter referred to as an internal high-silver iodide phase), i.e., on an edge, a corner or a plane of the substrate grains, it is preferable that such localization can be formed by controlling conditions for forming the substrate grains, for forming the internal high-silver iodide phase and for forming a phase covering the outer side thereof. of the conditions for forming the substrate grains, there can be recited pAg (the cologarithm of silver ion concentration); a presence or absence, a kind, and an amount of a silver halide solvent; and temperature, as important factors. By adjusting pAg to 8.5 or less, more preferably 8 or less, at the time of forming the substrate grains, it is possible to selectively form the internal high-silver iodide phase on the plane or at the vicinity of corners of the substrate grains, at the later time of forming the internal high-silver iodide phases.

On the other hand, by adjusting pAg to 8.5 or more, more preferably 9 or more, when the substrate grains are growing, it is possible to form internal high-silver iodide phases on the edges of the substrate grains, at the later time of growing the internal high-silver iodide phases. The threshold value of the pAg varies up and down depending on temperature and on the presence or absence, the kind, and the amount of the silver halide solvent. For example, when thiocyanate is used as the silver halide solvent, the threshold of the pAg inclines upward. The pAg at the final stage of the growth is particularly important among pAg's at the time of growing of the substrate grains. On the other hand, even when the pAg at the step of the growth is outside of the above given value, the selective location of the internal high-silver iodide phase can be controlled by adjusting the pAg to the above given value after the substrate grains have grown, followed by ripening. In this case, ammonia, amine compounds, thiourea derivatives, and thiocyanate salts are useful as the silver halide solvent. The internal high-silver iodide phase can be formed by a so-called conversion method. In this method, in the course of a grain formation process, halide ions having a lower solubility of salt forming silver ion than that of silver halide that forms a grain or a portion close to the surface of grain at this time, are added. In the present invention, an amount of the halide ions having a lower solubility to be added is preferably larger than a value (associated with a halide composition) with respect to a surface area of the grain at this time. For example, in the course of the grain formation, KI is preferably added in an amount larger than a certain value with respect to a surface area of a silver halide grain at this time. Specifically, iodide salt is preferably added in an amount of $8.2\times10^{-5}$ mol/m$^2$ or more.

A more preferable method of producing an internal high-silver iodide phase is a method in which fine grains of silver iodobromide are added. The grain size of these fine grains is generally 0.01 μm or more but 0.1 μm or less. However, it is possible to use fine grains having a grain size of 0.01 μm or less, or 0.1 μm or more. These fine-grain silver halide grains can be prepared with reference to methods described in JP-A-1-183417, JP-A-2-44335, JP-A-1-183644, JP-A-1-183645, JP-A-2-43534, and JP-A-2-43535. An internal high-silver iodide phase can be formed by adding these fine-grain silver halides, and then ripening. The above-mentioned silver halide solvent may be used, to solve the fine grains by ripening. All of these fine grains added are not necessary to be instantly solved and vanished; rather it is adequate that they are completely solved and vanished when the final grains have been formed.

The location of internal high-silver iodide phases, when measured from a center of a hexagonal, etc., formed by a projection of the grain, preferably exists in a range of 5 mol % or more, but less than 100 mol %; more preferably 20 mol % or more, but less than 95 mol %; and particularly preferably 50 mol % or more, but less than 90 mol %, with respect to the silver amount of the entire grain. The amount of the silver halide that constitutes the internal high-silver iodide phase is preferably 50 mol % or less, and more preferably 20 mol % or less, of the entire grain in terms of the silver amount. The above-mentioned amounts with respect to the high-silver iodide phase are based on a formulation for the production of silver halide emulsions, but are not based on the values observed by a measurement according to various analytical methods of a halide composition of the final grains. This is because the internal high-silver iodide phase in the final grains often vanishes during a recrystallization step or the like in shelling process. The above-mentioned silver amounts each refer to those in the production method.

Accordingly, the internal silver iodide phase formed to introduce dislocation lines into the final grains is often difficult to observe as a definite phase, even though the dislocation lines in the final grains can be easily observed according to the above-mentioned methods, since the silver iodide composition at the boundary successively varies. The halogen composition in a specific portion of the grain can be identified by a combination of an X-ray diffraction, an EPMA (also called as an XMA) method (in which silver halide grains are scanned by an electron beam, to detect a silver halide composition), an ESCA (also called as an XPS) method (in which X rays are radiated, to perform spectroscopy for photoelectrons emitted from the grain surface), and the like.

The silver iodide content of an outer phase with which an internal high-silver iodide phase is covered, is preferably lower than that of the internal high-silver iodide phase, and such a silver iodide content in the external phase covering the internal phase is preferably lower by 0 to 30 mol %, more preferably by 0 to 20 mol %, and most preferably by 0 to 10 mol %, than the silver iodide content in the internal high-silver iodide phase.

The temperature and the pAg to be set at the formation of the external phases covering the internal high-silver iodide phases are arbitrary, but a preferable temperature is 30° C. or more, but 80° C. or less; and most preferably 35° C. or more, but 70° C. or less. A preferable pAg is 6.5 or more, but 11.5 or less. Use of the above-mentioned silver halide solvent is sometimes preferred, and the most preferred silver halide solvent is a thiocyanate salt.

Further, as another method of introducing the dislocation lines into the tabular grains, there is a method by use of an iodide ion-releasing agent, as described in JP-A-6-11782. This method can also be preferably used.

It is also possible to introduce the dislocation lines by properly using this method and the aforementioned method of introducing the dislocation lines in combination.

In the chemical sensitization of the silver halide grains, non-uniformity among grains in, for example, the size thereof, would cause attaining the optimum sensitization of the individual grains to be difficult, which may result in deterioration of photographic sensitivity. From this viewpoint, it is preferred that the equivalent circle diameter and thickness of the tabular grains according to the present invention be monodisperse. With respect to all the silver halide grains for use in the present invention, the variation coefficient of equivalent circle diameter is preferably 40% or less, more preferably 30% or less, and even more preferably 20% or less. With respect to all the silver halide grains, the variation coefficient of thickness is preferably 20% or less. The terminology "variation coefficient of equivalent circle diameter" used herein means the value obtained by dividing a standard deviation of equivalent circle diameters of individual silver halide grains by an average equivalent circle diameter and by multiplying the quotient by 100. On the other hand, the terminology "variation coefficient of thickness" used herein means the value obtained by dividing a standard deviation of thickness of individual silver halide grains by an average thickness and by multiplying the quotient by 100.

The twin plane spacing (interval) of the tabular grains is preferably 0.014 μm or less, more preferably 0.012 μm or less. In the formation of fringe dislocation type grains, uniformity of the side faces of the tabular grains is important because it influences the uniformity of fringe dislocation among grains. From this viewpoint, with respect to the twin plane spacing, it is preferred that the variation coefficient of the twin plane spacing of the tabular grains is 40% or less, more preferably 30% or less. The terminology "fringe dislocation type grains" used herein means grains having dislocation lines at fringe portions thereof upon viewing the tabular grains from the main plane side thereof.

The tabular grains having (111) faces as main planes generally have the shape of a hexagon, a triangle or an intermediate triangle with angle portions cut off, and have three-fold symmetry. With respect to the six sides, the ratio of the length of three relatively long sides to that of three relatively short sides is referred to as the ratio of long side/short side. The triangle with angle portions cut off refers to the shape resulting from cutting off of angle portions of a.triangle. In the formation of fringe dislocation type grains, it has been observed that the density of dislocation lines at the fringe portions is lower in the grains having a shape close to a triangle than in the grains having a shape close to a hexagon. It is preferred that the ratio of long side/short side of the tabular grains be close to 1. The average of the ratio of long side/short side of the tabular grains is preferably 1.6 or less, more preferably 1.3 or less.

The tabular grains for use in the present invention are generally formed via nucleation, Ostwald ripening, and growth process. Each of these processes is important for restraining a spread of grain size distribution. In this connection, because it is difficult, in the later process, to reduce the spread of size distribution having already occurred in the preceding process, attention must be given so that the size distribution does not spread in the first nucleation step. In the nucleation step, a relation of a nucleus-forming time and a temperature of a reaction solution for addition of silver ions and bromide ions to the reaction solution by a double jet process thereby to generate precipitates, is important. As described by Saitoh in JP-A-63-92942, the temperature of the reaction solution at the time of nucleation is preferably in the range of from 20° C. to 45° C. for improvement of mono-dispersion property. In addition, as described by Zola et al in JP-A-2-222940, a preferable temperature at the time of nucleation is 60° C. or less.

For the purpose of obtaining monodispersed tabular grains whose grain thickness is thin, a gelatin is further added during grain formation in some case. As gelatin to be used at this time, it is preferable to use a chemically modified gelatin, as described in JP-A-10-148897 and JP-A-11-143002. The chemically modified gelatin is a gelatin having at least two carboxyl groups newly introduced by chemical modification of amino groups in the gelatin. As the chemically modified gelatin, a trimellitated gelatin is preferably used, and a succinated gelatin is also preferably used. The gelatin is preferably added before growth process. More preferably, it is added just after nucleation. The addition amount of the gelatin is preferably 60% or more, more preferably 80% or more, and especially preferably at 90% or more, based on the mass of entire dispersion media during grain formation.

The composition of the tabular grain for use in the present invention is not limited, and it is preferably silver iodobromide or silver chloroiodobromide.

The silver chloride content of the tabular grain for use in the present invention is preferably 8 mol % or less, more preferably 3 mol % or less, and most preferably 0 mol %. A coefficient of variation of grain size distribution of the tabular grain emulsion is preferably 30 mol % or less. Therefore, the content of silver iodide is preferably 20 mol % or less. Reduction in the content of silver iodide makes it easy to reduce the variation coefficient of distribution of circle-equivalent diameter of the tabular grains.

Particularly, the coefficient of variation of grain size (e.g. equivalent-sphere diameter) distribution of the tabular grain is preferably 20% or less, and the content of the silver iodide is preferably 10 mol % or less.

The variation coefficient of intergrain silver iodide content distribution of the silver halide tabular grains for use in the present invention is preferably 20% or less, more preferably 15% or less, and especially preferably 10% or less. When the variation coefficient of intergrain silver iodide content distribution of the silver halide grains is too larger, the light-sensitive material using the same can not attain hard gradation, and reduction of sensitivity induced by pressure becomes larger, which are not preferable.

As the method of producing silver halide grains having a narrow silver iodide content distribution among tabular grains for use in the present invention, any known methods, such as a method in which fine grains are added, as described in JP-A-1-183417, and a method in which an iodide ion-releasing agent is used, as described in JP-A-2-68538, may be used singly or in combination thereof.

The silver iodide content of individual silver halide grains can be measured by a composition analysis of the individual silver halide grain by using X-ray micro analyzer. The coefficient of variation of intergrain silver iodide content distribution is a value determined by the steps of: the silver iodide contents of at least 100, more preferably 200 or more, and especially preferably 300 or more of emulsion grains are measured, to obtain the standard deviation of the silver iodide content and the average silver iodide content; and the coefficient of variation is calculated by using the following relation:

$$(\text{Standard deviation}/\text{Average silver iodide content})\times 100=\text{Coefficient of variation}.$$

The measurement of the silver iodide content of the individual grain is described, for example, in European Patent No. 147,868. Even though there is sometimes a relation between the silver iodide content Yi (mol %) of individual grain and an equivalent-sphere diameter Xi (μm) of individual grain, and there is sometimes no relation between them, but it is preferable that there is no relation between them. The structure relating to the silver halide composition of the tabular grains can be confirmed, for example, by a combination of X-ray diffraction, EPMA (or XMA) method (a method of detecting a silver halide composition by scanning of silver halide grains with electron beams), and ESCA (or XPS) method (a method of spectroscopic analyzing photoelectrons discharged from the grain surface upon X-ray radiation). In the present invention, when the silver iodide content is measured, the term "surface of grain" means a region in the depth of 5 nm from the grain surface, while the term "inside of grain" means the region other than the surface of the grain, which should be the deeper region. The halogen composition of the grain surface can be measured usually according to the ESCA method.

Next, the tetradecahedral or cubic crystal grains substantially having (100) planes, which grains can be preferably used in the present invention, is described below.

The silver chloride content of the silver halide emulsion that contains the tetradecahedral or cubic crystal grains substantially having (100) planes for use in the present invention, is preferably 95 mol % or more, and from the viewpoint of rapid processing property, it is more preferably 97 mol % or more, further preferably 98 mol % or more. The silver halide emulsion in the silver halide emulsion layer containing a yellow dye-forming coupler contains silver iodide in a content of preferably 0.1 mol % or more, more preferably 0.1 to 1 mol %, and further preferably 0.1 to 0.4 mol %. The silver halide emulsion in the silver halide emulsion layer containing a yellow dye-forming coupler may contain silver bromide, and the silver bromide content is preferably 0 to 4 mol %, more preferably 0.1 to 2 mol %. The silver halide emulsion in the silver halide emulsion layer containing a magenta dye-forming coupler and the silver halide emulsion in the silver halide emulsion layer containing a cyan dye-forming coupler each may contain silver bromide in a content of preferably 0 to 4 mol %, more preferably 0.5 to 3 mol %. The silver halide emulsion in the silver halide emulsion layer containing a magenta dye-forming coupler and the silver halide emulsion in the silver halide emulsion layer containing a cyan dye-forming coupler each may contain silver iodide in a content of preferably 0 to 1 mol %, more preferably 0.05 to 0.50 mol %, and most preferably 0.07 to 0.40 mol %.

The specific silver halide grains in the silver halide emulsion containing tetradecahedral or cubic crystal grains substantially having (100) planes for use in the present invention, each preferably have a silver bromide-containing phase and/or a silver iodide-containing phase. Herein, a term "a silver bromide- or silver iodide-containing phase" means a region where the content of silver bromide or silver iodide is higher than that in the surrounding regions. The halogen compositions of the silver bromide-containing phase or the silver iodide-containing phase and of the surrounding region (outer periphery) may vary either continuously or drastically. Such a silver bromide-containing phase or silver iodide-containing phase may form a layer which has an approximately constant concentration in a certain width at a portion in the grain, or it may form a maximum point having no spread. The local silver bromide content in the silver bromide-containing phase is preferably 5 mol % or more, more preferably from 10 to 80 mol %, and most preferably from 15 to 50 mol %. The local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form, within the grain. In this case, the phases may have different silver bromide or silver iodide contents from each other. The silver halide grain for use in the present invention preferably contains both of at least one silver bromide-containing phase and at least one silver iodide-containing phase.

It is preferable that the silver bromide-containing phase or silver iodide-containing phase that the silver halide emulsion grains of tetradecahedral or cubic crystal grains substantially having (100) planes for use in the present invention have, are each formed in the layer form so as to cover the grain. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or an edge of the grain can be different from that of a main plane of the grain. Further, aside from the silver bromide-containing phase and/or silver iodide-containing phase formed in the layer form so as to surround the grain, another silver bromide-containing phase and/or silver iodide-containing phase not surrounding the grain may exist in isolation at a specific portion of the surface of the grain.

In a case where the silver halide emulsion containing tetradecahedral or cubic crystal grains substantially having (100) planes for use in the present invention contains a silver bromide-containing phase, it is preferable that said silver bromide-containing phase is formed in a layer form so as to have a concentration maximum of silver bromide inside of the grain. Likewise, in a case where the silver halide emulsion of the present invention contains a silver iodide-containing phase, it is preferable that said silver iodide-containing phase is formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide grain of the silver halide emulsion containing tetradecahedral or cubic crystal grains substantially having (100) planes for use in the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide content and/or a silver iodide content necessary for exhibiting the effects of the present invention such as achievement of high sensitivity and realization of hard gradation, each increase with the silver bromide-containing phase and/or the silver iodide-containing phase being formed in more inside of the grain. This causes the silver chloride content to decrease to more than necessary, resulting in the possibility of impairing rapid processing suitability. Accordingly, for putting together these phases or functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To the silver halide emulsion containing tetradecahedral or cubic crystal grains substantially having (100) planes for use in the present invention, bromide ions or iodide ions are introduced to make the emulsion grain contain silver bromide or silver iodide. In order to introduce bromide ions or iodide ions, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high chloride emulsion may be limited. The deeper in the emulsion grain the iodide ion is introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight—Secondary Ion Mass Spectrometry) method by means of, for example, TRIFT II Model TOF-SIMS apparatus (trade name, manufactured by Phi Evans Co.). A TOF-SIMS method is specifically described in, Nippon Hyomen Kagakukai edited, *Hyomen Bunseki Gijutsu Sensho Niji Ion Shitsuryo Bunsekihb* (*Surface Analysis Technique Selection—Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion of the present invention has the maximum concentration of iodide ions at the surface of the grain, that the iodide ion concentration decreases inwardly in the grain, and that the bromide ions preferably have the maximum concentration in the inside of the grain. The local concentration of silver bromide can also be measured with X-ray diffractometry, as long as the silver bromide content is high to some extent.

In the present specification, the equivalent-sphere diameter is indicated by a diameter of a sphere having the same volume as that of individual grain. Preferably, the emulsion for use in the present invention comprises grains having a monodisperse grain size distribution. The variation coefficient of equivalent spherical diameter is preferably 20% or less, more preferably 15% or less, and still more preferably 10% or less. The variation coefficient of equivalent spherical diameter is expressed as a percentage of standard deviation of equivalent spherical diameter of each grain, to an average of equivalent spherical diameter. In this connection, for the purpose of obtaining broad latitude, it is preferred that the above-mentioned monodisperse emulsions be used as blended in the same layer, or coated by a multilayer coating method.

The silver halide emulsion of the present invention may contain silver halide grains chemically sensitized by a selenium sensitizer using an unstable-type (labile) selenium compound and/or a non-unstable-type selenium compound, as disclosed in known patent publications, besides the silver halide grains chemically sensitized by the compound represented by formula (1), (6-1), (6-2) or (7) for use in the present invention. The silver halide emulsion of the present invention may be chemically sensitized by a combination of the sensitizer represented by formula (1), (6-1), (6-2) or (7) for use in the present invention, and any of the above-mentioned selenium sensitizers. The selenium compound is generally utilized in such a manner that it is added to an emulsion, and the emulsion is stirred at a high temperature, preferably at a temperature of 40° C. or more, for a given time. As the labile selenium compounds, use can be made of the compounds described in JP-B-44-15748, JP-B-43-13489, JP-A-4-25832, JP-A-4-109240, and the like. The non-labile selenium sensitizer refers to a compound which causes, without use of any nucleophilic agent, silver selenide formed upon the addition of the non-labile selenium sensitizer only in an amount of 30% or less to the amount of the added non-labile selenium sensitizer. As the non-labile selenium sensitizer, there can be mentioned compounds described in, for example, JP-B-46-4553, JP-B-52-34492 and JP-B-52-34491. When the non-labile selenium sensitizer is used, it is preferred to use a nucleophilic agent in combination with the non-labile selenium sensitizer. As the nucleophilic agent, there can be mentioned compounds described in, for example, JP-A-9-15776.

The silver halide emulsion of the present invention may be additionally subjected to gold sensitization known in the field of arts concerned, in combination with the chemical sensitization by use of the compound represented by formula (1), (6-1), (6-2) or (7) according to the present invention. As a gold sensitizer for the gold sensitization, the oxidation number of gold may be either +1 valence or +3 valences, and various inorganic gold compounds, gold (I) complexes having inorganic ligands or gold (I) compounds having organic ligands may be utilized. Typical examples of the gold sensitizer include compounds such as a chloroaurate, potassium chloroaurate, auric trichloride, potassium auric thiocyanate, potassium iodoaurate, tetracyano auric acid, ammonium aurothiocyanate, pyridyl trichlorogold, gold sulfide, gold selenide; gold dithiocyanate compounds, e.g., potassium gold (I) dithiocyanate; and gold dithiosulfate compounds, e.g., trisodium gold (I) dithiosulfate. The amount of the gold sensitizing agent to be added varies depending on various conditions, but, as a standard, the amount thereof is generally $1\times10^{-7}$ to $5\times10^{-3}$ mol, preferably $5\times10^{-6}$ to $5\times10^{-4}$ mol, per mol of the silver halide.

As the gold (I) compounds each having an organic ligand (an organic compound), used can be made of bis-gold (I) mesoionic heterocycles described in JP-A-4-267249, e.g. bis(1,4,5-trimethyl-1,2,4-triazolium-3-thiolato) aurate (I) tetrafluoroborate; organic mercapto gold (I) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen compound anion coordinated therewith, as described in JP-A-4-268550, e.g. bis (1-methylhydantoinato) gold (I) sodium salt tetrahydrate. As these gold (I) compounds having organic ligands, use can be made of those which are synthesized in advance and isolated, as well as those which are generated by mixing an organic ligand and an Au compound (e.g., chlroauric acid or its salt), to add to an emulsion without isolating the Au compound. Moreover, an organic ligand and an Au compound (e.g., chlroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

The amount of the above compound to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

Further, in the present invention, colloidal gold sulfide can also be used, for example, to subject the silver halide emulsion of the present invention to gold sensitization. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1996). In the above Research Disclosure, a method is described in which a thiocyanate ion is used in the production of colloidal gold sulfide. It is, however, possible to use a thioether compound, such as methionine or thiodiethanol, instead.

Colloidal gold sulfide having various grain sizes are applicable, and it is preferable to use those having an average grain diameter of 50 nm or less, more preferably 10 nm or less, and further preferably 3 nm or less. The grain diameter can be measured from a TEM photograph. Also, the composition of the colloidal gold sulfide may be $AU_2S_1$ or may be sulfur-excess compositions such as $Au_2S_1$ to $Au_2S_2$ which are preferable. $Au_2S_{1.1}$ to $AU_2S_{1.8}$ are more preferable.

The composition of the colloidal gold sulfide can be analyzed in the following manner: for example, gold sulfide grains are taken out, to find the content of gold and the content of sulfur, by utilizing analysis methods such as ICP and iodometry, respectively. If gold ions and sulfur ions (including hydrogen sulfide and its salt) dissolved in the liquid phase exist in the gold sulfide colloid, this affects the analysis of the composition of the gold sulfide colloidal grains. Therefore, the analysis is made after the gold sulfide grains have been separated by ultrafiltration or the like. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

The emulsion used in the present invention may be additionally subjected to sulfur sensitization in the chemical sensitization.

The sulfur sensitization is generally carried out by adding a sulfur sensitizer, and stirring the resulting emulsion for a certain period at a high temperature, preferably at 40° C. or higher.

In the above sulfur sensitization, known sulfur sensitizers can be used. Examples thereof include thiosulfates, ally thiocarbamidethiourea, allyl isothiocyanate, cystine, p-toluenethiosulfonates, and rhodanine. In addition, sulfur sensitizers described, for example, in U.S. Pat. Nos. 1,574,944, 2,410,689, 2,278,947, 2,728,668, 3,501,313 and 3,656,955, German Patent No. 1,422,869, JP-B-56-24937, and JP-A-55-45016, can also be used. The amount of the sulfur sensitizer to be added is suitably an amount sufficient to effectively increase the sensitivity of the emulsion. That amount varies in a substantially wide range depending on various conditions, such as the pH, the temperature, and the size and type of the silver halide grains, and preferably the amount is $1\times10^{-7}$ mol or more but $5\times10^{-5}$ mol or less, per mol of the silver halide.

Chalcogen sensitization and gold sensitization can be conducted by using the same molecule such as a molecule capable of releasing $AuCh^-$, in which Au represents Au (I), and Ch represents a sulfur atom, a selenium atom or a tellurium atom. Examples of the molecule capable of releasing $AuCh^-$ include gold compounds represented by AuCh-L, in which L represents a group of atoms bonding to AuCh to form the molecule. Further, one or more ligands may coordinate to Au together with Ch-L. The gold compounds represented by AuCh-L have a tendency to form AgAuS when Ch is S, AgAuSe when Ch is Se, or AgAuTe when Ch is Te, when the gold compounds are reacted in a solvent in the presence of silver ions. Examples of these compounds include those in which L is an acyl group. In addition, gold compounds represented by formula (AuCh1), formula (AuCh2), or formula (AuCh3) are exemplified.

$R_1$—X-M-ChAu Formula (AuCh1)

In formula (AuCh1), Au represents Au (I); Ch represents a sulfur atom, a selenium atom or a tellurium atom; M represents a substituted or unsubstituted methylene group; X represents an oxygen atom, a sulfur atom, a selenium atom or $NR_2$; $R_1$ represents a group of atoms bonding to X to form the molecule (e.g., an organic group, such as an alkyl group, an aryl group or a heterocyclic group); $R_2$ represents a hydrogen atom or a substituent (e.g., an organic group, such as alkyl, aryl or heterocyclic group); and $R_1$ and M may combine together to form a ring.

Regarding the compound represented by formula (AuCh1), Ch is preferably a sulfur atom or a selenium atom; X is preferably an oxygen atom or a sulfur atom; and $R_1$ is preferably an alkyl group or an aryl group. Examples of more specific compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Herein, the terms "thiosugar," "selenosugar" and "tellurosugar" each mean the compound in which a hydroxy group in the anomer position of the sugar is substituted with a SH group, a SeH group or a TeH group.

$W_1W_2C{=}CR_3ChAu$ Formula (AuCh2)

In formula (AuCh2), Au represents Au(I); Ch represents a sulfur atom, a selenium atom or a tellurium atom; $R_3$ and $W_2$ each independently represent a hydrogen atom or a substituent (e.g., a halogen atom, and an organic group such as alkyl, aryl or heterocyclic group); $W_1$ represents an electron-withdrawing group having a positive value of the Hammett's substituent constant $\sigma_p$ value; and $R_3$ and $W_1$, $R_3$ and $W_2$, or $W_1$ and $W_2$ may bond together to form a ring.

In the compound represented by formula (AuCh2), Ch is preferably a sulfur atom or a selenium atom; $R_3$ is preferably a hydrogen atom or an alkyl group; and $W_1$ and $W_2$ each are preferably an electron-withdrawing group having the Hammett's substituent constant $\sigma_p$ value of 0.2 or more.

Examples of the specific compound include $(NC)_2C{=}CHSAu$, $(CH_3OCO)_2C{=}CHSAu$, and $CH_3CO(CH_3OCO)C{=}CHSAu$.

$W_3$-E-ChAu Formula (AuCh3)

In formula (AuCh3), Au represents Au(I); Ch represents a sulfur atom, a selenium atom or a tellurium atom; E represents a substituted or unsubstituted ethylene group; $W_3$ represents an electron-withdrawing group having a positive value of the Hammett's substituent constant $\sigma_p$ value.

In the compound represented by formula (AuCh3), Ch is preferably a sulfur atom or a selenium atom; E is preferably an ethylene group having thereon an electron-withdrawing group whose Hammett's substituent constant $\sigma_p$ value is a positive value; and $W_3$ is preferably an electron-withdrawing group having the Hammett's substituent constant $\sigma_p$ value of 0.2 or more.

An addition amount of these compounds can vary over a wide range according to the occasions, and the amount is generally in the range of $5\times10^{-7}$ to $5\times10^{-3}$ mol, preferably in the range of $3\times10^{-6}$ to $3\times10^{-4}$ mol, per mol of silver halide.

In the present invention, the above-mentioned gold sensitization may be combined with other sensitization, such as sulfur sensitization, selenium sensitization, tellurium sensitization, reduction sensitization, and noble metal sensitization using noble metals other than gold compounds. In particular, the gold sensitization is preferably combined with sulfur sensitization and/or selenium sensitization.

The selenium sensitization can be carried out in the presence of a silver halide solvent.

Examples of the silver halide solvent that can be used in the present invention include (a) organic thioethers described, for example, in U.S. Pat. Nos. 3,271,157, 3,531,289 and 3,574,628, JP-A-54-1019, and JP-A-54-158917; (b) thiourea derivatives described, for example, in JP-A-53-82408, JP-A-55-77737, and JP-A-55-2982; (c) silver halide solvents having a thiocarbonyl group between an oxygen or sulfur atom, and a nitrogen atom, as described in JP-A-53-144319; (d) imidazoles described in JP-A-54-100717; (e) sulfites; and (f) thiocyanates.

Preferable silver halide solvents are thiocyanates and tetramethylthiourea. The amount of the solvent to be used varies depending on the type of the solvent, and the amount to be used is preferably $1\times10^{-4}$ mol or more, but $1\times10^{-2}$ mol or less, per mol of the silver halide.

The silver halide emulsion for use in the present invention may be subjected to reduction sensitization during grain formation; after grain formation, but before or in the course of chemical sensitization; or after chemical sensitization.

As the reduction sensitization, any one may be selected from the followings: a method in which a reduction sensitizing agent is added to a silver halide emulsion; a so-called silver ripening method in which a silver halide is grown or ripened in the low pAg atmosphere with pAg of 1 to 7; and a so-called high-pH ripening method in which growth or ripening is carried out in the high pH atmosphere with pH of 8 to 11. Further, two or more of those methods may be used in combination.

The above method in which a reduction-sensitizing agent is added to a silver halide emulsion is preferable from the point that the revel of reduction sensitization can be delicately controlled.

Examples of known reduction-sensitizing agents include stannous salts, ascorbic acid and its derivatives, amines, polyamines, hydrazine derivatives, formamidine sulfinic acids, silane compounds, and borane compounds. The reduction-sensitizing agent for use in the present invention may be selected from these compounds, and two or more kinds of compounds may be used in combination. Preferable reduction-sensitizing agents for use in the present invention are stannous chloride, thiourea dioxide, dimethylamine borane, and ascorbic acid and its derivatives. The addition amount of the reduction-sensitizing agent varies depending on the conditions of producing emulsions, and therefore it is necessary to determine an addition amount thereof. A proper addition amount is generally in the range of from $10^{-7}$ to $10^{-}$mol, per mol of the silver halide.

A reduction sensitizer may be added in the course of the formation of silver halide grains, in the form of a solution having the reduction sensitizer dissolved in water or such an organic solvent as alcohols, glycols, ketones, esters, and amides. The reduction sensitizer may be added to a reaction vessel in advance, but preferably the reduction sensitizer is added at any proper stage during the formation of grains. Alternatively, use can be made of a method in which the reduction sensitizer is added to an aqueous solution of a water-soluble silver salt or a water-soluble alkali halide in advance, and then silver halide grains are precipitated by using these aqueous solutions. Further, a method in which a solution of the reduction sensitizer is added in parts or successively for a long period of time during the formation of silver halide grains, is also preferred.

In the present invention, preferably an oxidizing agent for silver is added, in the course of the process of the production of the emulsion. The oxidizing agent for silver refers to a compound that acts on metal silver to convert it to silver ion. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate. The oxidizing agent for silver may be inorganic or organic. Examples of inorganic oxidizing agents include ozone, hydrogen peroxide and its adducts (e.g. $NaBO_2.H_2O_2.3H_2O$, $2NaCO_3.3H_2O_2$, $Na_4P_2O_7.2H_2O_2$, and $2Na_2SO_4.H_2O_2.2H_2O$); oxygen acid salts, such as peroxyacid salts (e.g. $K_2S_2O_8$, $K_2C_2O_6$, and $K_2P_2O_8$), peroxycomplex compounds (e.g. $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganates (e.g. $KMnO_4$), and chromates (e.g. $K_2Cr_2O_7$); halogen elements, such as iodine and bromine; perhalates (e.g. potassium periodate), salts of metals having higher valences (e.g. potassium hexacyanoferrate (III)), and thiosulfonates.

Examples of the organic oxidizing agents include quinones, such as p-quinone; organic peroxides, such as peracetic acid and perbenzoic acid; and compounds that can release active halogen (e.g. N-bromosuccinimido, chloramine T, and chloramine B).

Further, preferable examples of the oxidizing agents for use in the present invention include inorganic oxidizing agents selected from ozone, hydrogen peroxide and its adducts, halogen elements, and thiosulfinates; and organic oxidizing agents selected from quinones.

In a preferable embodiment, the above-described reduction sensitization is effected in combination with an oxidizing agent for silver. Use can be made of a method in which reduction sensitization is effected after use of the oxidizing agent, a method in which the oxidizing agent is used after completion of the reduction sensitization, or alternatively a method in which reduction sensitization is effected in the presence of the oxidizing agent. These methods can be used in either the step of grain formation or the step of chemical sensitization.

In the silver halide emulsion for use in the present invention, a metal complex may be added and incorporated during grain formation; after grain formation, but before chemical sensitization; or during chemical sensitization. The metal complex may be separately added and incorporated in several times. However, 50% or more of the total metal complex incorporated in the silver halide grain is preferably located in the layer within a half in terms of silver amount, from the outermost surface of the silver halide grain. On the outer side of the above-mentioned metal complex-containing layer apart from a support, a layer containing no metal complex may be provided.

In the present invention, the above-mentioned metal complexes are preferably dissolved in water or a proper solvent and added directly to the reaction solution at the time of silver halide grain formation; or added to an aqueous halide solution, an aqueous silver salt solution or other solution for forming silver halide grains, so that they are doped to the inside of the silver halide grains. Furthermore, it is also preferable to employ a method, in which a metal complex is incorporated into the silver halide grains, by adding and dissolving silver halide fine grains doped with metal complex in advance, and depositing them on another silver halide grains.

The hydrogen ion concentration in a reaction solution to which a metal complex is added, is preferably 1 or more, but 10 or less; more preferably 3 or more, but 7 or less, in terms of pH.

The metal complex that can be preferably used in the present invention, is represented by formula (I) or formula (II):

$$[IrX^{I}_{n}L^{I}_{(6-n)}]^{m} \qquad \text{Formula (I)}$$

wherein $X^{I}$ represents a halogen ion or a pseudohalogen ion other than a cyanate ion; $L^{I}$ represents a ligand different from $X^{I}$; n represents an integer of 3, 4 or 5; and m represents an integer of −4 to −1, 0 or +1.

Herein, three to five of $X^{I}$s may be the same or different from each other. When plural $L^{I}$s are present, these plural $L^{I}$s may be the same or different from each other.

In formula (I), the pseudohalogen (halogenoid) ion means an ion having a nature similar with that of halogen ion; and examples of the same include cyanide ion ($CN^{-}$), thiocyanate ion ($SCN^{-}$), selenocyanate ion ($SeCN^{-}$), tellurocyanate ion ($TeCN^{-}$), azide dithiocarbonate ion ($SCSN_3^{-}$), cyanate ion ($OCN^{-}$), fulminate ion ($ONC^{-}$), and azide ion ($N_3^{-}$).

$X^{I}$ is preferably a fluoride ion, a chloride ion, a bromide ion, an iodide ion, a cyanide ion, an isocyanate ion, a thiocyanate ion, a nitrate ion, a nitrite ion, or an azide ion. Among these, chloride ion and bromide ion are particularly preferable. $L^{I}$ is not particularly limited, so long as it is a ligand different from $X^{I}$, and it may be an organic or inorganic compound that may or may not have electric charge(s), with organic or inorganic compounds with no electric charge being preferable.

The metal complex represented by formula (II) that can also be preferably used in the present invention, is described below:

$$[MX^{II}_{n1}L^{II}_{(6-n1)}]^{m1} \qquad \text{Formula (II)}$$

wherein M represents Cr, Mo, Re, Fe, Ru, Os, Co, Rh, Pd or Pt; $X^{II}$ represents a halogen ion; $L^{II}$ represents a ligand different from $X^{II}$; n1 represents an integer of 3 to 6; and ml represents an integer of −4 to +1 (i.e. −4 to −1, 0, or +1).

$X^{II}$ is preferably a fluoride ion, a chloride ion, a bromide ion, or an iodide ion, and particularly preferably a chloride ion or a bromide ion. $L^{II}$ may be an organic or inorganic compound that may or may not have electric charges, with inorganic compounds having no electric charge being preferable. $L^{II}$ is preferably $H_2O$, NO or NS.

Herein, 3 to 6 $X^{II}$s may be same as or different from each other. When plural $L^{II}$s exist, the plural $L^{II}$s may be same as or different from each other.

The foregoing metal complexes are anions. When these are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable. These metal complexes can be used by being dissolved in water or a mixed solvent of water and an appropriate water-miscible organic solvent (such as alcohols, ethers, glycols, ketones, esters and amides).

In the present invention, it is preferable that the above-mentioned metal complex is incorporated into the silver halide grains, by directly adding the same to a reaction solution for the formation of the silver halide grains, or to an aqueous solution of the halide for the formation of the silver halide grains, or to another solution and then to the reaction solution for the grain formation. It is also preferable that a metal complex is incorporated into the silver halide grains by physical ripening with fine grains having metal complex previously incorporated therein. Further, the metal complex can be also contained into the silver halide grains by a combination of these methods.

In case where the metal complex is doped (incorporated) into the silver halide grains, the metal complex is preferably uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Two or more kinds of complexes may be incorporated in the inside of an individual silver halide grain.

The silver halide grains in the silver halide emulsion that is used in the present invention may contain, in addition to the iridium complex represented by formula (I), another iridium complex in which all of 6 ligands are of Cl, Br or I. In this case, Cl, Br or I may be a mixture of them in the six-coordination complex. The iridium complex having Cl, Br or I as a ligand is particularly preferably incorporated in a silver bromide-containing phase, for obtaining hard gradation upon high illuminance exposure.

Specific examples of the iridium complex in which all of 6 ligands are Cl, Br or I are shown below, but the present invention is not limited to these.

$[IrCl_6]^{2-}$ $[IrCl_6]^{3-}$ $[IrBr_6]^{2-}$ $[IrBr_6]^{3-}$ $[IrI_6]^{3-}$

In the present invention, metal ion other than the above-mentioned metal complexes can be doped in the inside and/or on the surface of the silver halide grains. As the metal ion to be used, a transition metal ion is preferable, and an ion of iron, ruthenium, osmium, lead, cadmium or zinc is more preferable. It is further preferable that these metal ions are used in the form of six-coordination complexes of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in the molecule as an atom which is capable of coordinating to the metal. Particularly preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with the metal complex mentioned in the above. Preferred of these compounds are those in which the number of cyanide ions accounts for the majority of the coordination number intrinsic to the iron or ruthenium that is the central metal. The remaining coordination sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver.

Also, the silver halide emulsion of the present invention may contain a spectral sensitizing dye, for the purpose of imparting a so-called spectral sensitivity thereto so that the emulsion exhibits light-sensitivity in a desired wavelength region. Examples of the dye that can be used include a cyanine dye, a merocyanine dye, a complex-cyanine dye, a complex merocyanine dye, a holopolar cyanine dye, a hemicyanine dye, a styryl dye and a hemioxonol dye. In particular, examples of usable dyes are those belonging to the cyanine dye, merocyanine dye or complex merocyanine dye. For these dyes, any nucleus commonly used for cyanine dyes as a basic heterocyclic nucleus can be used. Examples of the nucleus include pyrroline nucleus, oxazoline nucleus, thiazoline nucleus, pyrrol nucleus, oxazole nucleus, thiazole.nucleus, selenazole nucleus, imidazole nucleus, tetrazole nucleus and pyridine nucleus; nuclei resulting from fusion of an alicyclic hydrocarbon ring to the aforementioned nuclei; and nuclei resulting from fusion of an aromatic hydrocarbon ring to the aforementioned nuclei, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus, quinoline nucleus and so forth. These nuclei may have a substituent on a carbon atom.

For the merocyanine dye or complex merocyanine dye, a 5- or 6-membered heterocyclic nucleus such as pyrazolin-5-one nucleus, thiohydantoin nucleus, 2-thiooxazolidine-2,4-dione nucleus, thiazolidine-2,4-dione nucleus, rhodanine nucleus and thiobarbituric acid nucleus may be used as a nucleus having a ketomethylene structure.

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618 and JP-A-52-109925.

In the present invention, together with the sensitizing dye, a dye having no spectral sensitizing action itself, or a substance that does not substantially absorb visible light and that exhibits supersensitization, may be included in the emulsion.

As a time when the sensitizing dye is added to a silver halide emulsion, it may be any time of the processes for preparation of the emulsion that has been recognized to be useful. In the present invention, addition of the sensitizing dye is, most commonly, carried out after completion of chemical sensitization, but before coating. However, the sensitizing dye may be simultaneously added together with a chemical sensitizer, to carry out spectral sensitization and chemical sensitization at the same time, as described in U.S. Pat. Nos. 3,628,969 and 4,225,666. Besides, as described in JP-A-58-113928, the sensitizing dye may be added prior to chemical sensitization, or alternatively the sensitizing dye may be added before completion of formation of precipitation of silver halide grains, to start spectral sensitization. Further, as taught in U.S. Pat. No. 4,225,666, it is possible that the sensitizing dye may be separately added, namely a part of sensitizing dye is added prior to chemical sensitization and the remaining of sensitizing dye is added after chemical sensitization. The sensitizing dye may be added in any stage during grain formation of silver halide, as exemplified by the method disclosed in U.S. Pat. No. 4,183,756.

The amount of the sensitizing dye to be added is preferably in the range of from $0.5\times10^{-6}$ to $1.0\times10^{-2}$ mol, more preferably in the range of from $1.0\times10^{-6}$ to $5.0\times10^{-3}$ mol, per mol of the silver halide.

At the time of chemical sensitization of the silver halide emulsion of the present invention, a previously prepared silver iodobromide emulsion may be added and dissolved, to improve fog formation during aging. The addition timing is not limited as long as it is during chemical sensitization. It is preferable that, first, a silver iodobromide emulsion is added and dissolved, and subsequently a sensitizing dye and a chemical sensitizing agent are added, in this order. The silver iodide content of the silver iodobromide emulsion to be used is generally lower than the surface silver iodine content of the host grains. The silver iodobromide emulsion to be added is preferably a pure silver bromide emulsion. The grain size of the silver iodobromide emulsion is not particularly limited, so long as the silver iodobromide grains are completely dissolved, and it is preferably 0.1 μm or less, more preferably 0.05 μm or less, in terms of equivalent-sphere diameter. The addition amount of the silver iodobromide grains varies depending on the host grains to be used, but, basically it is preferably 0.005 to 5 mol %, more preferably 0.1 to 1 mol %, per mol of silver.

The light-sensitive material utilizing the silver halide emulsion of the present invention may use an epi-emulsion in at least one light-sensitive emulsion layer.

The epi-emulsion referred to in the present invention means an emulsion that contains silver chloroiodobromide tabular grains, which have two parallel (111) primary planes facing each other, and which have epitaxial protrusions. The silver chloroiodobromide tabular grain having an epitaxial protrusion for use in the present invention has one twin plane or two or more parallel twin planes. The twin plane means a (111) plane when ions on all lattice points have a mirror image relation on both sides of the (111) plane.

The epi-emulsion that can be used in the present invention is preferably one in which epitaxial protrusions are deposited on tabular grains each having a hexagonal primary plane such that the ratio of the length of the longest side to the shortest side is 2 to 1, in preferably 70% or more, more preferably 90% or more, of the projected area of all grains. The epi-emulsion is further preferably one in which epitaxial protrusions be deposited on tabular grains each having a hexagonal primary plane such that the ratio of the length of the longest side to the shortest side is 1.5 to 1 in 90% or more of the projected area of all grains.

The epi-emulsion that can be used in the present invention is preferably monodispersion in the size distribution of grains contained therein. In the present invention, the coefficient of variation of the circle equivalent diameter of the projected area of all silver halide grains to be used is preferably 30% or less, more preferably 25% or less, and particularly preferably 20% or less. Herein, the coefficient of variation of the circle equivalent diameter is a value obtained by dividing the standard deviation of distribution of the circle equivalent diameter of individual silver halide grains by the average circle equivalent diameter.

The circle equivalent diameter of the tabular grains contained in the epi-emulsion is measured, as mentioned in the above, by taking a photograph by using a transmission electron microscope, according to, for example, a replica method, to find the diameter (circle equivalent diameter) of a circle having the area equal to the projected area of an individual grain. The thickness of each grain cannot be simply calculated from the length of the shadow of a replica because of epitaxial deposition. It is, however, possible to calculate the thickness, by measuring the length of the shadow of a replica before the epitaxial deposition. Alternatively, even after the epitaxial deposition, the thickness can be easily found, by cutting a sample to which epitaxial tabular grains are applied, and by taking an electron microphotograph of the section of the sample.

The composition of the silver halide grains contained in the epi-emulsion that can be used in the present invention is generally silver iodochlorobromide. The composition is preferably the following combination: the composition of the host tabular grains is silver iodobromide or silver iodochlorobromide, and the composition of the epitaxial protrusions is silver iodochlorobromide. The content of silver chloride is preferably 0.5 mol % or more and 6 mol % or less. The content of silver iodide is preferably 0.5 mol % or more and 10 mol % or less, more preferably 1 mol % or more and 6 mol % or less.

In the present invention, when the average silver chloride content of the epitaxial protrusions is designated to as CL mol %, the epi-emulsion preferably has the silver chloride content of the epitaxial protrusions in a range from 0.7 CL to 1.3 CL, particularly preferably in a range from 0.8 CL to 1.2 CL, in 70% or more of all the projected area. Further, when the average silver iodide content of the epitaxial protrusions is designated to as I mol %, the epi-emulsion preferably contains the epitaxial tabular grains whose silver iodide content of the epitaxial protrusions is in a range from 0.7 I to 1.3 I, particularly preferably in a range from 0.8 I to 1.2 I, in 70% or more of all the projected area. Herein, the average silver chloride content and average silver iodide content of the epitaxial protrusions are, respectively, averages of silver chloride content and silver iodide content of the epitaxial protrusions inside of each grain and among grains. The distributions of Cl and I of the epitaxial protrusions inside of each grain and among grains may be analyzed by using the following method. The tabular grains in the silver halide photographic light-sensitive material are taken out after treating a light-sensitive material with a protease, followed by centrifugation. These grains are re-dispersed and placed on a copper mesh on which a support film is spread. The amount of the protease to be used is preferably as small as possible, to prevent the grains from being denatured. Although depending on the case, a method may be used in which a light-sensitive material is cut layer-wise by a microtome to take out grains included in a binder. The grains taken out in this manner are observed from the direction of the principal plane, to scan a beam with a spot diameter narrowed to 2 nm or less by using an analytical electron microscope, in the epitaxial region protruded outwardly from the extended sides of the hexagon, thereby measuring each content of silver chloride and silver iodide in the epitaxial region of one location. In order to find the distribution inside of individual grain and among grains, generally 50 locations or more, preferably 100 locations or more of the epitaxial regions are measured. Each content of silver chloride and silver iodide can be calculated by finding the ratio of Ag intensity to halogen intensity in advance as a calibration curve by treating, in the same manner, silver halide grains whose composition and contents are known.

As the electron gun of the analytical electron microscope, a field emission-type electron gun having a high-electron density is more suitable than a thermionic-type electron gun, and the former can be used to easily analyze each content of silver chloride and silver iodide in the epitaxial part. At this time, the measurement is preferably conducted by cooling the sample to a low temperature, for preventing causing any damage to the sample due to electron beam. As the epi-emulsion usable in the present invention, a preferable one has epitaxial protrusion on at least one apex part among six apex parts of the primary plane of the hexagon, in 70% or more of the entire projected area. It is more preferable that the epi-emulsion contains tabular grains each having epitaxial. protrusion on at least one apex part among six apex parts of the primary plane of the hexagon, in 90% or more of the total projected area. Herein, the apex part means a area within an arc of a diameter that is ⅓ of the length of a shorter side in the two sides adjacent to each other at one apex when the tabular grain is viewed from a direction perpendicular to the primary plane. In the case of a rounded hexagon, specifically in the case where the hexagonal tabular grains have rounded apexes, a judgement may be made as to whether an imaginary hexagon formed by extending each side of the rounded hexagon fulfills the above requirements or not. An emulsion containing grains having at least one epitaxial protrusion on this apex part is the epi-emulsion for use in the present invention. The number of epitaxial protrusions is preferably one, on each six apex parts, namely six in all. Generally, epitaxial protrusions are formed on the primary plane of the tabular grain or on the sides of the tabular grains, except for the apex parts of tabular grains.

The epi-emulsion that can be used in the present invention may be prepared with reference to, for example, the descriptions in JP-A-2002-278007.

The silver halide photographic light-sensitive material of the present invention has at least one silver halide emulsion layer, which contains the silver halide emulsion chemically sensitized by the compound represented by formula (1), (6-1), (6-2) or (7). It is preferable that the light-sensitive material of the present invention is provided with, on a support, at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one light-insensitive layer. Further, the light-sensitive material may contain a colloidal silver-containing layer, if necessary. On the support, use can be made of a light-sensitive layer composed of a plurality of silver halide emulsion layers each having substantially the same color-sensitivity but different from each other in light-sensitivity. This light-sensitive layer is a unit color-sensitive layer having color-sensitivity to any one of blue light, green light and red light. The unit color-sensitive layers may be arranged in any order according to the purpose, and the red-sensitive layer, the green-sensitive layer and the blue-sensitive layer may be arranged in this order from the support side. This order may be reversed, or an arrangement in which a unit color-sensitive layer is inserted into another unit color-sensitive layer may be adopted. The non-light-sensitive layer may be formed as an interlayer between the silver halide light-sensitive layers described above, or as the uppermost layer or as the lowermost layer. The non-light-sensitive colloidal silver-containing layer may contain a coupler, a color-mixing inhibitor, or the like, as described below. The silver halide emulsion layers constituting each unit color-sensitive layer can take a two-layer constitution composed of a high-sensitive emulsion layer and a low-sensitive emulsion layer, as described in DE Patent No. 1,121,470 or GB Patent No. 923,045. Generally, these layers may be arranged such that the sensitivities are decreased toward the support. As described, for example, in JP-A-57-112751, JP-A-62-200350, JP-A-62-206541, and JP-A-62-20654.3, a low-sensitive emulsion layer may be placed away from the support, and a high-sensitive emulsion layer may be placed nearer to the support. Specific examples of the order include an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932, an order of a blue-sensitive layer/GH/RH/GL/RL stated from the side most away from the support is also possible. Further, as described in JP-A-56-25738 and JP-A-62-63936, an order of a blue-sensitive layer/GL/RL/GH/RH stated from the side most away from the support is also possible.

Further, as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer, stated from the side away from support, can be taken. In the case of four layers or more layers, the arrangement can be varied as above.

In order to improve color reproduction, as described in U.S. Pat. Nos. 4,663,271, 4,705,744, and 4,707,436, JP-A-62-160448, and JP-A-63-89850, it is preferable to form a donor layer (CL), which has a spectral sensitivity distribution different from that of a principal (main) light-sensitive layer, such as BL, GL and RL, and which has an inter-layer effect, in a position adjacent or in close proximity to the principal light-sensitive layer.

The light-sensitive material of the present invention may be provided with a hydrophilic colloid layer, an anti-halation layer, an intermediate layer, and a colored layer, if necessary, in addition to the aforementioned yellow color-forming layer, magenta color-forming layer, and cyan color-forming layer.

Various compounds or precursors thereof can be included in the silver halide emulsion of the present invention to prevent fogging from occurring or to stabilize photographic performance during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

In the present invention, it is possible to use non-light-sensitive fine grain silver halide. The non-light-sensitive fine grain silver halide is a silver halide fine grain which is not sensitive to light upon imagewise exposure for obtaining a dye image. In the non-light-sensitive fine grain silver halide, the content of silver bromide is 0 to 100 mol %. The fine grain silver halide may contain silver chloride and/or silver iodide, if necessary. The fine grain silver halide preferably contains silver iodide in a content of 0.5 to 10 mol %. The average grain diameter (the average value of circle equivalent diameter of projected area) of the non-light-sensitive fine grain silver halide is preferably 0.01 to 0.5 μm, more preferably 0.02 to 0.2 μm.

The non-light-sensitive fine grain silver halide may be prepared by the same procedure as that for a usual light-sensitive silver halide. The grain surface of the non-light-sensitive fine-grain silver halide needs not be optically sensitized nor spectrally sensitized. However, before the non-light-sensitive fine-grain silver halide grains are added to a coating solution, it is preferable to add any known stabilizer, such as triazole-series compounds, azaindene-series compounds, benzothiazolium-series compounds, mercapto-series compounds, and zinc compounds. Colloidal silver may be added to the layer containing those fine-grain silver halide grains.

In the light-sensitive material of the present invention, any of conventionally-known photographic materials or additives may be used.

For example, as a photographic support (base), a transmissive type support or a reflective type support may be used. As the transmissive type support, it is preferred to use a transparent support, such as a cellulose nitrate film, and a transparent film of polyethylene terephthalate, or a polyester of 2,6-naphthalenedicarboxylic acid (NDCA) and ethylene glycol (EG), or a polyester of NDCA, terephthalic acid and EG, provided thereon with an information-recording layer such as a magnetic layer.

As the reflective type support, it is especially preferable to use a reflective support having a substrate laminated thereon with a plurality of polyethylene layers or polyester layers, at least one of the water-proof resin layers (laminate layers) contains a white pigment such as titanium oxide. A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer provided on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent may be dispersed and contained in a hydrophilic colloid layer, which is formed separately form the above layers in the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer side or the reverse side of the support. In particular, it is preferable that the transmission density of support is adjusted to the range of 0.35 to 0.8 so that a display may be enjoyed by means of both transmitted and reflected rays of light.

In the light-sensitive material of the present invention, in order to improve, e.g., sharpness of an image, a dye (particularly an oxonole-series dye) that can be discolored by processing, as described in European Patent Application Publication No. 0,337,490A2, pages 27 to 76, may be added to the hydrophilic colloid layer. It is also possible to add 12% by mass or more (more preferably 14% by mass or more) of titanium oxide that is surface-treated with dihydric to tetrahydric alcohols (e.g., trimethylolethane) and the like, to a water-proof resin layer of the support.

The light-sensitive material of the present invention preferably contains, in the hydrophilic colloid layer, a dye (particularly oxonole dyes and cyanine dyes) that can be discolored by processing, as described in European Patent Application Publication No. 0337490A2, pages 27 to 76, in order to prevent irradiation or halation or enhance safelight safety, and the like. Further, a dye described in European Patent Publication No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (closer to a support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine particles of dye and of using colloidal silver.

Preferred examples of silver halide emulsions that can be additionally used in combination with the silver halide emulsion of the present invention, and other materials (additives or the like) applicable to the present invention, photographic constitutional layers (arrangement of the layers or the like), and processing methods for processing the photographic materials and additives for processing, include those disclosed in JP-A-62-215272, JP-A-2-33144, and European Patent Application Publication No. 0,355,660A2. In particular, those disclosed in European Patent Application Publication No. 0,355,660A2 can be preferably used. Further, it is also preferred to use silver halide color photographic light-sensitive materials and processing methods thereof described, for example, in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Application Publication No. 0520457A2.

In the present invention, known color mixing-inhibitors may be used. Among these compounds, those described in the following patent publications are preferred.

For example, high-molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No. 19629142 A1 and the like, may be used. In particular, in order to accelerate developing speed by increasing the pH of a developing solution, redox compounds described in German Patent Application Publication No. 19618786A1, European Patent Application Publication Nos. 839623A1 and 842975A1, German Patent Application Publication No. 19806846A1, French Patent Application Publication No. 2760460A1, and the like, are also preferably used.

In the present invention, as an ultraviolet ray absorbent, it is preferred to use a compound having a triazine skeleton high in a molar extinction coefficient. For example, those described in the following patent publications can be used. This compound can be preferably used in the light-sensitive layer or/and the light-insensitive layer. For example, use can be made of the compound described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804A, JP-T-8-501291 ("JP-T" means published searched patent publication), and the like.

As a binding agent or a protective colloid which can be used in the photosensitive material of the present invention, a gelatin is used advantageously. Hydrophilic colloid other than gelatin may be used singly or in combination with the gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the coating film of the light-sensitive material is preferably in the range of 4.0 to 7.0, more preferably in the range of 4.0 to 6.5.

In the present invention, the total amount of a gelatin to be applied in the photographic structural layer is preferably 3 g/m$^2$ or more and 6 g/m$^2$ or less, more preferably 3 g/m$^2$ or more and 5 g/m$^2$ or less. The film thickness of the entire photographic structural layers is preferably 3 μm to 7.5 μm, more preferably 3 μm to 6.5 μm, to satisfy development progress characteristics, fixing-bleaching property, and residual color, even in ultra-rapid processing. As to a method of measuring a dried film thickness, the film thickness can be measured based on a change in film thickness before and after the dried film is peeled off, or by observing the section by an optical microscope or an electron microscope. In the present invention, the swelled film thickness is preferably 8 μm to 19 μm, more preferably 9 μm to 18 μm, to achieve both the improvement in development progress characteristics and the increase in a drying speed. The swelled film thickness may be measured by immersing a dried light-sensitive material in a 35° C. aqueous solution to allow the material to be swelled into a sufficiently equilibrated condition, under which condition the thickness is measured by a known dotting method.

In the present invention, a surface-active agent may be added to the light-sensitive material, in view of improvement in coating-stability, prevention of static electricity from being occurred, and adjustment of the charge amount. As the surface-active agent, there are anionic, cationic, betaine or nonionic surfactants. Examples thereof include those described in JP-A-5-333492. As the surface-active agent for use in the present invention, a fluorine-containing surface-active agent is preferred. In particular, a fluorine-containing surface-active agent is preferably used. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The light-sensitive material of the present invention may be subjected to an exposure step of irradiating the light-sensitive material with light corresponding to image information, and to a development step of processing the exposed light-sensitive material, to thereby form an image.

The light-sensitive material of the present invention can be subjected to exposure by a scan exposure system using a cathode ray tube (CRT). The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used if necessary. For example, any one of red-light-emitting materials, green-light-emitting materials and blue-light-emitting aterials, or a mixture of two or more of these light-emitting materials may be used. The spectral regions are not limited to the above red, green and blue, and fluorophoroes or phosphors which can emit a light in a region of yellow, orange, purple or infrared can also be used. in particular, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred, from the viewpoint of high-image quality enhancement, because a cathode ray tube having a high resolving power can be used.

The light-sensitive material of the present invention can be preferably used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. The exposure time in such a scanning exposure is defined as the time necessary to expose the size of the picture element with the density of the picture element being 400 dpi, and preferred exposure time is $1\times10^{-4}$ sec or less, more preferably $1\times10^{-6}$ sec or less.

Specific examples of the laser light source that can be preferably used, include a blue-light semiconductor laser having a wavelength of 430 to 460 nm (Presentation by Nichia Corporation at the 48$^{th}$ Applied Physics Related Joint Meeting, in March of 2001); a green-light laser at about 530 nm obtained by wavelength modulation of a semiconductor laser (oscillation wavelength about 1,060 nm) with SHG crystal of $LiNbO_3$ having a reversed domain structure in the form of a wave guide; a red-light semiconductor laser of the wavelength at about 685 nm (Type No. HL6738MG (trade name) manufactured by Hitachi, Ltd.); and a red-light semiconductor laser of the wavelength at about 650 nm (Type No. HL6501MG (trade name) manufactured by Hitachi, Ltd.).

The silver halide color photographic photosensitive material of the present invention can be used in combination with the exposure and/or development system(s) described in the following publications. Example of the development system include automatic print and development system described in JP-A-10-333253; photosensitive material-conveying apparatus described in JP-A-2000-10206; recording system including image-reading apparatus, as described in JP-A-11-215312; exposure system with color-image-recording method, as described in JP-A-11-88619 and JP-A-10-202950; digital photo print system including remote diagnosis method, as described in JP-A-10-210206; and photo print system including image-recording apparatus, as described in Japanese Patent Application No. 10-159187.

In the present invention, a yellow microdot pattern may be previously pre-exposed before giving an image information, to thereby perform a copy restraint, as described in European Patent Application Publication Nos. 0789270A1 and 0789480A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied. Further, as the preservative for use in the developing solution, compounds described in the patent publications listed in the following table can be used.

Examples of a known development method applicable to the light-sensitive material after exposure, include a wet system, such as a development method using a developing solution containing an alkali agent and a developing agent, and a development method in which a developing agent is incorporated in the light-sensitive material and an activator solution, e.g., a developing agent-free alkaline solution, is employed for the development, as well as a heat development system using no processing solutions. However, a conventional development method using a developing solution containing an alkali agent and a developing agent, can be applied to the present invention.

The present invention may be applied to various color light-sensitive materials. Typical examples of the color light-sensitive material include color negative films for general use or movie use, color reverse films for slide use or television use, color papers, color positive films, and color reverse papers.

Photographic additives that can be used in the present invention are described in Research Disclosures (RD), and the particular parts are given below in a table.

| Kind of Additive | RD 17643 | RD 18716 | RD 307105 |
|---|---|---|---|
| 1. Chemical sensitizers | p. 23 | p. 648 (right column) | p. 866 |
| 2. Sensitivity-enhancing agents | — | p. 648 (right column) | — |
| 3. Spectral sensitizers and Supersensitizers | pp. 23–24 | pp. 648 (right column)–649 (right column) | pp. 866–868 |
| 4. Brightening agents | p. 24 | p. 647 (right column) | p. 868 |
| 5. Light absorbers, Filter dyes, and UV Absorbers | pp. 25–26 | pp. 649 (right column)–650 (left column) | p. 873 |
| 6. Binders | p. 26 | p. 651 (left column) | pp. 873–874 |
| 7. Plasticizers and Lubricants | p. 27 | p. 650 (right column) | p. 876 |
| 8. Coating aids and Surfactants | pp. 26–27 | p. 650 (right column) | pp. 875–876 |
| 9. Antistatic agents | p. 27 | p. 650 (right column) | pp. 876–877 |
| 10. Matting agents | — | — | pp. 878–879 |

Photographic processing and techniques such as arrangement of layers, silver halide emulsions that can be additionally used in combination with the silver halide emulsion of the present invention, dye-forming couplers, functional couplers such as DIR couplers, various kinds of additives, and the like, each of which can be used in the silver halide photographic photosensitive material of the present invention, are also described in European Patent Application Publication No. 0565096A1 (published on Oct. 13, 1993) and publications referred to therein. Each item and its corresponding portion of the description are listed below.

1. Layer structure: page 61, lines 23 to 35, and page 61, line 41 to page 62, line 14
2. Interlayer: page 61, lines 36 to 40
3. Interlayer effect-imparting layer: page 62, lines 15 to 18
4. Halogen composition of silver halide: page 62, lines 21 to 25
5. Crystal habit of silver halide grains: page 62, lines 26 to 30
6. Size of silver halide grains: page 62, lines 31 to 34
7. Production method of emulsion: page 62, lines 35 to 40
8. Grain size distribution of silver halide: page 62, lines 41 to 42
9. Tabular grains: page 62, lines 43 to 46
10. Inner structure of grains: page 62, lines 47 to 53
11. Latent image formation type of emulsion: page 62, line 54 to page 63, line 5
12. Physical ripening and chemical ripening of emulsion: page 63, lines 6 to 9
13. Use of mixed emulsion: page 63, lines 10 to 13
14. Fogged emulsion: page 63, lines 14 to 31
15. Non-light sensitive emulsion: page 63, lines 32 to 43
16. Coating amount of silver: page 63, lines 49 to 50
17. Formaldehyde scavenger: page 64, lines 54 to 57
18. Mercapto-series antifogging agent: page 65, lines 1 to 2
19. Releasing agent of fogged agent and the like: page 65, lines 3 to 7
20. Dye: page 65, lines 7 to 10
21. Color couplers in general: page 65, lines 11 to 13
22. Yellow, magenta and cyan couplers: page 65, lines 14 to 25
23. Polymer coupler: page 65, lines 26 to 28
24. Diffusible dye-forming coupler: page 65, lines 29 to 31
25. Colored coupler: page 65, lines 32 to 38
26. Functional couplers in general: page 65, lines 39 to 44
27. Coupler releasing a bleaching accelerator: page 65, lines 45 to 48
28. Coupler releasing a development accelerator: page 65, lines 49 to 53
29. Other DIR coupler: page 65, line 54 to page 66, line 4
30. Method of dispersing a coupler: page 66, lines 5 to 28
31. Antiseptics and anti-molding agent: page 66, lines 29 to 33
32. Kind of photosensitive material: page 66, lines 34 to 36
33. Film thickness and swelling speed of light-sensitive layer: page 66, lines 40 to page 67, line 1
34. Backing layer: page 67, lines 3 to 8
35. Development processing in general: page 67, lines 9 to 11
36. Developing solution and developing agent: page 67, lines 12 to 30
37. Additives of developing solution: page 67, lines 31 to 44
38. Reversal processing: page 67, lines 45 to 56
39. Aperture ratio of processing solution: page 67, line 57 to page 68, line 12
40. Developing time: page 68, lines 13 to 15
41. Blix, bleaching and fixing: page 68, line 16 to page 69, line 31
42. Automatic processing apparatus: page 69, lines 32 to 40
43. Washing, rinse and stabilization: page 69, line 41 to page 70, line 18
44. Replenishment and reuse of processing solution: page 70, lines 19 to 23
45. Developing agent-incorporated photosensitive material: page 70, lines 24 to 33
46. Processing temperature for development: page 70, lines 34 to 38
47. Application to films with lens: page 70, lines 39 to 41

With respect to techniques, such as those regarding a bleaching solution, a magnetic recording layer, a polyester support, and an antistatic agent, that are applicable to the silver halide photographic light-sensitive material of the present invention, and with respect to the utilization of the present invention in Advanced Photo System, etc., reference can be made to the descriptions in U.S. Patent Application Publication No. 2002/0042030 A1 (published on Apr. 11, 2002) and patent publications cited therein. The items and the locations where they are described will be listed below.

1. Bleaching solution: page 15, [0206];
2. Magnetic recording layer and magnetic particles: page 16, [0207] to [0213];
3. Polyester support: page 16, [0214] to page 17, [0218];
4. Antistatic agent: page 17, [0219] to [0221];
5. Sliding agent: page 17, [0222];
6. Matting agent: page 17, [0224];
7. Film cartridge: page 17, [0225] to page 18, [0227];
8. Use in Advanced Photo System: page 18, [0228], and [0238] to [0240];
9. Use in film with lens: page 18, [0229]; and
10. Processing by MiniLab system: page 18, [0230] to [0237].

According to the present invention, a silver halide emulsion can be provided, which gives high sensitivity, causes less fogging, and has good storage stability.

Further, according to the present invention, by using the silver halide emulsion, a silver halide color photographic light-sensitive material can be provided, which is high in sensitivity, and which is less in increase of fogging during storage and/or less in sensitivity variation caused by a difference in humidity condition at the time of exposure.

The present invention will be described in more detail based on the following examples, but the present invention is not limited thereto. Hereinafter, in the following examples and comparative examples, "%" to show a composition means mass %, unless otherwise specified.

EXAMPLES

Example 1

(Preparation of Blue-Sensitive Layer Emulsion BH-1)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_6]$ was added. Over the step of from 92% to 98% addition of the entire silver nitrate amount, $K_2[IrCl_5(H_2O)]$ and $K[IrCl_4(H_2O)_2]$ were added. At the completion of 94% addition of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2 and Ab-3 each set forth below, and calcium nitrate were added to the resulting emulsion for re-dispersion.

Compound Ab-1

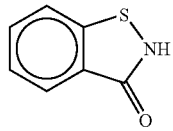

Compound Ab-2

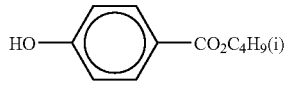

Compound Ab-3

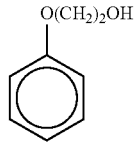

The thus re-dispersed emulsion was dissolved at 40° C., and Sensitizing dye S-1, Sensitizing dye S-2 and Sensitizing dye S-3 were added thereto, for optimal spectral sensitization. Then, to the resulting emulsion, were added sodium benzenethiosulfonate, Compound A (N,N-dimethylselenourea, $5.8\times10^{-6}$ mol per mol of the finished silver halide) and HK-1 (bis(1,4,5-trimethyl-1,2,4-triazolium-3-thiolate) aurate (I) tertafluoroborate), followed by ripening for optimal chemical sensitization. Then, 1-(5-methylureidophenyl)-5-mercaptotetrazole; Compound-2; a compound whose major components were recurring units 2 or 3 represented by Compound-3, in which both ends $X_1$ and $X_2$ each were a hydroxy group; Compound-4; and potassium bromide were added, to complete chemical sensitization. The thus-obtained emulsion was referred to as Emulsion BH-1.

Sensitizing dye S-1

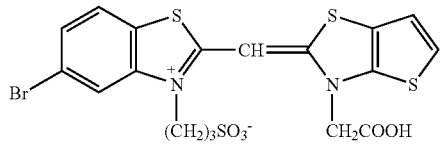

Sensitizing dye S-2

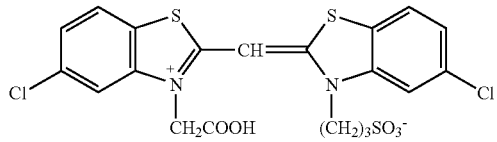

Sensitizing dye S-3

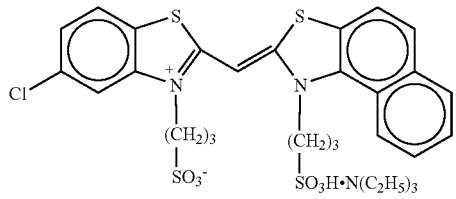

Compound-1

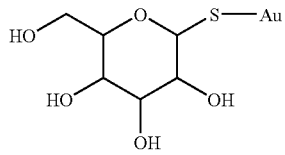

-continued

Compound-2

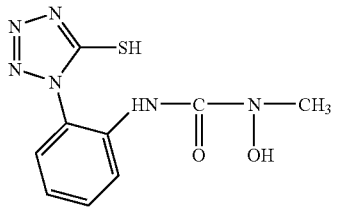

Compound-3

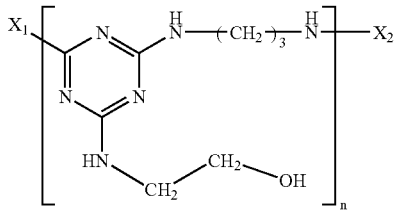

Compound-4

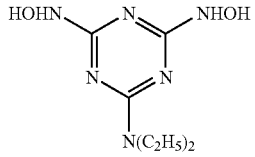

(Preparation of Blue-Sensitive Layer Emulsion BL-1)

Emulsion grains were prepared in the same manner as in the preparation of Emulsion BH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-1 was prepared in the same manner as Emulsion BH-1, except that the amounts of various compounds to be added in the preparation of Emulsion BH-1 were changed.

(Preparation of Green-Sensitive Layer Emulsion GH-1)

Using a method of adding silver nitrate and sodium chloride simultaneously to a deionized distilled water containing a deionized gelatin to mix these, under stirring, cubic high silver chloride grains were prepared. In the course of this preparation, $K_4[Ru(CN)_6]$ was added over the step of from 80% to 90% addition of the entire silver nitrate amount. Over the step of from 80% to 100% addition of the entire silver nitrate amount, potassium bromide (2 mol % per mol of the finished silver halide) was added. Over the step of from 83% to 88% addition of the entire silver nitrate amount, $K_2[IrCl_6]$ and $K_2[RhBr_5(H_2O)]$ were added. At the completion of 90% addition of the entire silver nitrate amount, potassium iodide (0.1 mol % per mol of the finished silver halide) was added under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a side length of 0.42 μm and a variation coefficient of 8.0%. The resulting emulsion was subjected to flocculation desalting treatment and re-dispersing treatment in the same manner as described in the above.

This emulsion was dissolved at 40° C., and sodium benzenethiosulfate, p-glutaramidophenyldisulfide, sodium thiosulfate pentahydrate, and HK-1 (bis(1,4,5-trimethyl-1,2,4-triazolium-3-thiorato) aurate (I) tetrafluoroborate) were added, and the emulsion was subjected to ripening for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. Further, in a midway of the emulsion preparation process, Sensitizing dyes S-4, S-5, S-6 and S-7 were added as sensitizing dyes, to conduct spectral sensitization. The thus-obtained emulsion was referred to as Emulsion GH-1.

Sensitizing dye S-4

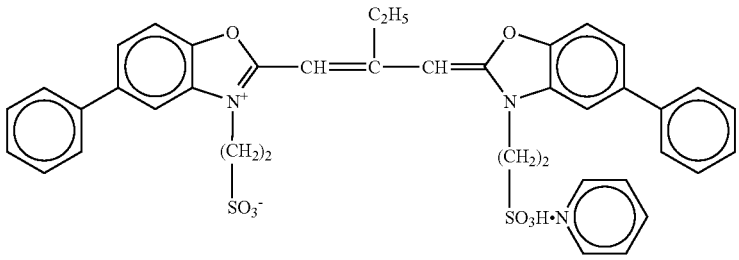

Sensitizing dye S-5

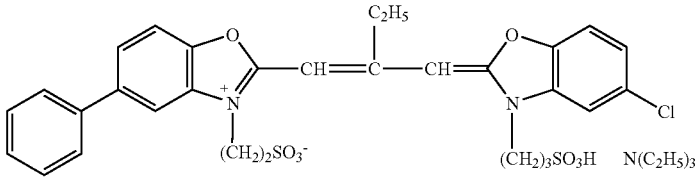

-continued

Sensitizing dye S-6

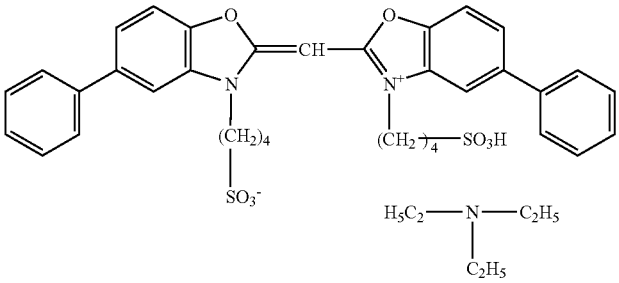

Sensitizing dye S-7

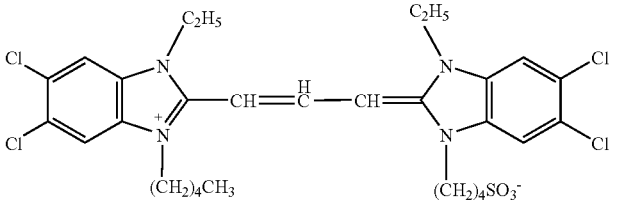

(Preparation of Green-Sensitive Layer Emulsion GL-1)

Emulsion grains were prepared in the same manner as in the preparation of Emulsion GH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.35 μm and a variation coefficient of 9.8%. After re-dispersion of this emulsion, Emulsion GL-1 was prepared in the same manner as Emulsion GH-1, except that the amounts of various compounds to be added in the preparation of Emulsion GH-1 were changed.

(Preparation of Red-Sensitive Layer Emulsion RH-1)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Ru(CN)_6]$ was added. Over the step of from 80% to 100% addition of the entire silver nitrate amount, potassium bromide (1.3 mol % per mol of the finished silver halide) was added. Over the step of from 83% to 88% addition of the entire silver nitrate amount, $K_2[IrCl_5(5\text{-methylthiazole})]$ was added. At the completion of 88% addition of the entire silver nitrate amount, potassium iodide (in an amount that the silver iodide amount would be 0.05 mol % per mol of the finished silver halide) was added, under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a cubic side length of 0.39 μm and a variation coefficient of 10%. The resulting emulsion was subjected to flocculation desalting treatment and re-dispersing treatment in the same manner as described in the above.

This emulsion was dissolved at 40° C., and Sensitizing dye S-8, Compound-5, triethylthiourea, and the above-described Compound-1 were added, and the resulting emulsion was ripened for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

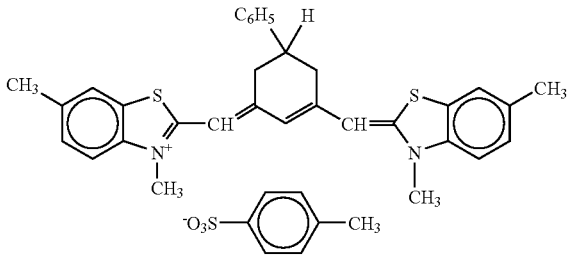

Compound-5

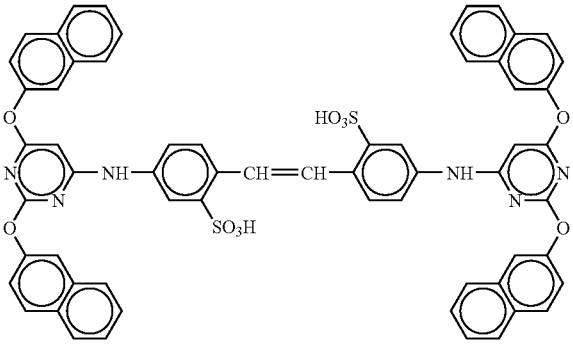

(Preparation of Red-Sensitive Layer Emulsion RL-1)

Emulsion grains were prepared in the same manner as in the preparation of Emulsion RH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to flocculation desalting treatment and re-dispersion, Emulsion RL-1 was prepared in the same manner as Emulsion RH-1, except that the amounts of various compounds to be added in the preparation of Emulsion RH-1 were changed.

(Preparation of a Coating Solution for the First Layer)

Into 23 g of a solvent (Solv-4), 4 g of a solvent (Solv-6), 23 g of a solvent (Solv-9), and 60 ml of ethyl acetate, were dissolved 34 g of a yellow coupler (EX-Y), 1 g of a color-image stabilizer (Cpd-1), 1 g of a color-image stabilizer (Cpd-2), 8 g of a color-image stabilizer (Cpd-8), 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-2). This solution was emulsified and dispersed in 270 g of a 20 mass % aqueous gelatin solution containing 4 g of sodium dodecylbenzenesulfonate, with a high-speed stirring emulsifier (dissolver). Then, water was added thereto, to prepare 900 g of Emulsified Dispersion A.

Separately, the above-described Emulsified Dispersion A, and the above-described Emulsions BH-1 and BL-1 were mixed and dissolved, to prepare a coating solution for the first layer having the composition shown below. The coating amounts of the emulsions are in terms of silver.

The coating solutions for the second to seventh layers were prepared in the similar manner as the coating solution for the first layer. As a gelatin hardener for each layer, 1-oxy-3,5-dichloro-s-triazine sodium salt (H-1), (H-2), and (H-3) were used. Further, (Ab-1), (Ab-2), and (Ab-3) were added to each layer, so that their total amounts would be 15.0 mg/m$^2$, 60.0 mg/m$^2$, 5.0 mg/m$^2$, and 10.0 mg/m$^2$, respectively.

(H-1) Hardener

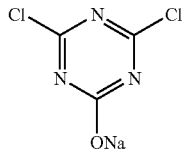

(H-2) Hardener

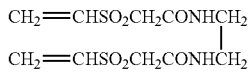

(H-3) Hardener

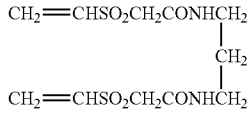

Further, 1-(3-methylureidophenyl)-5-mercaptotetrazole was added to the second layer, the fourth layer, and the sixth layer, in amounts of 0.2 mg/m$^2$, 0.2 mg/m$^2$, and 0.6 mg/m$^2$, respectively. Further, 4-hydroxy-6-methyl-1,3,3a,7-tetrazaindene was added to the blue-sensitive emulsion layer and the green-sensitive emulsion layer, in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Further, disodium catecol-3,5-disulfonate was added to the second layer, the fourth layer and the sixth layer, so that respective amounts would be 6 mg/m$^2$, 6 mg/m$^2$ and 18 mg/m$^2$. Further, to each layer, sodium polystyrenesulfonate was optionally added to adjust viscosity of the coating solutions. Further, in order to prevent irradiation, the following dyes (coating amounts are shown in parentheses) were added.

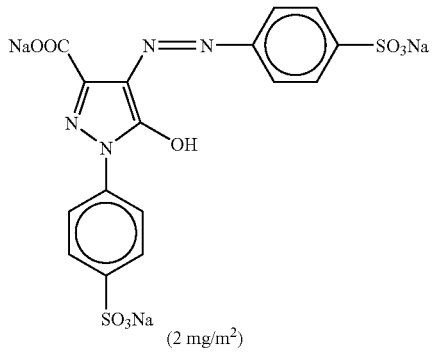

(2 mg/m$^2$)

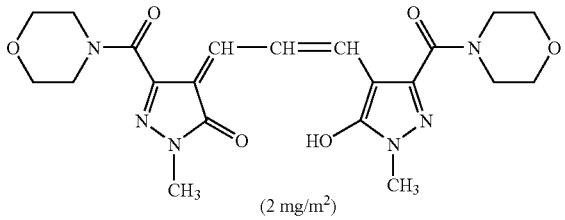

(2 mg/m$^2$)

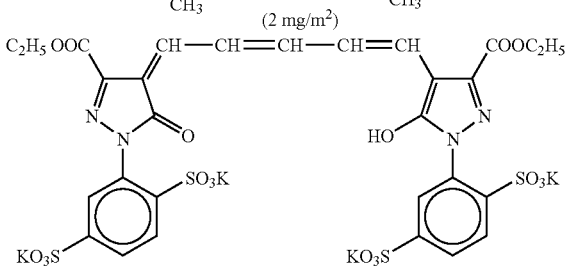

(24 mg/m$^2$)

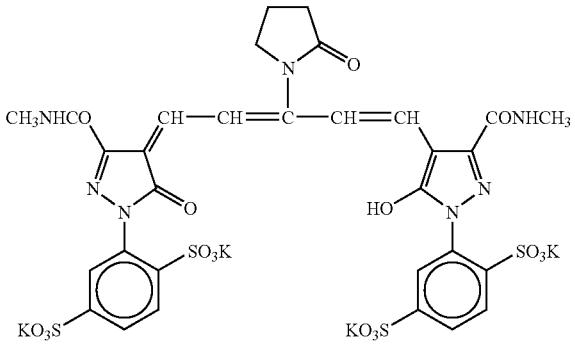

(3 mg/m$^2$)

(Layer Constitution)

The composition of each layer is shown below. The numbers show coating amounts (g/m$^2$). With respect to silver halide emulsions, the coating amount is in terms of silver.

Support

Polyethylene Resin-Laminated Paper

[The polyethylene resin on the first layer side contained a white pigment ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %). The amount of the polyethylene resin was 29.2 g/m$^2$]

| | |
|---|---|
| First Layer (Blue-Sensitive Emulsion Layer) | |
| Emulsion (a 5:5 mixture of BH-1 and BL-1 (in terms of mol of silver)) | 0.16 |
| Gelatin | 1.32 |
| Yellow coupler (EX-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Color-image stabilizer (Cpd-23) | 0.15 |
| Additive (ExC-1) | 0.001 |
| Color-image stabilizer (UV-4) | 0.01 |
| Solvent (Solv-4) | 0.23 |
| Solvent (Solv-6) | 0.04 |
| Solvent (Solv-9) | 0.23 |
| Second Layer (Color-Mixing Inhibiting Layer) | |
| Gelatin | 0.78 |
| Color-mixing inhibitor (Cpd-4) | 0.05 |
| Color-mixing inhibitor (Cpd-13) | 0.01 |
| Color-image stabilizer (Cpd-5) | 0.006 |
| Color-image stabilizer (Cpd-6) | 0.05 |
| Color-image stabilizer (Cpd-7) | 0.006 |
| Color-image stabilizer (UV-A) | 0.06 |
| Solvent (Solv-1) | 0.06 |
| Solvent (Solv-2) | 0.06 |
| Solvent (Solv-5) | 0.07 |
| Solvent (Solv-8) | 0.07 |
| Third Layer (Green-Sensitive Emulsion Layer) | |
| Emulsion (a 1:3 mixture of GH-1 and GL-1 (in terms of mol of silver)) | 0.12 |
| Gelatin | 0.95 |
| Magenta coupler (ExM) | 0.12 |
| Ultraviolet absorbing agent (UV-A) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth Layer (Color-Mixing Inhibiting Layer) | |
| Gelatin | 0.65 |
| Color-mixing inhibitor (Cpd-4) | 0.04 |
| Color-mixing inhibitor (Cpd-13) | 0.01 |
| Color-image stabilizer (Cpd-5) | 0.005 |
| Color-image stabilizer (Cpd-6) | 0.04 |
| Color-image stabilizer (Cpd-7) | 0.005 |
| Color-image stabilizer (UV-A) | 0.05 |
| Solvent (Solv-1) | 0.05 |
| Solvent (Solv-2) | 0.05 |
| Solvent (Solv-5) | 0.06 |
| Solvent (Solv-8) | 0.06 |
| Fifth Layer (Red-Sensitive Emulsion Layer) | |
| Emulsion (a 4:6 mixture of RH-1 and RL-1 (interms of mol of silver)) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |

-continued

| | |
|---|---|
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |
| Sixth Layer (Ultraviolet Absorbing Layer) | |
| Gelatin | 0.34 |
| Ultraviolet absorbing agent (UV-B) | 0.24 |
| Compound (S1-4) | 0.0015 |
| Solvent (Solv-7) | 0.11 |
| Seventh Layer (Protective Layer) | |
| Gelatin | 0.82 |
| Additive (Cpd-22) | 0.03 |
| Liquid paraffin | 0.02 |
| Surface-active agent (Cpd-13) | 0.02 |

(EX-Y) Yellow coupler

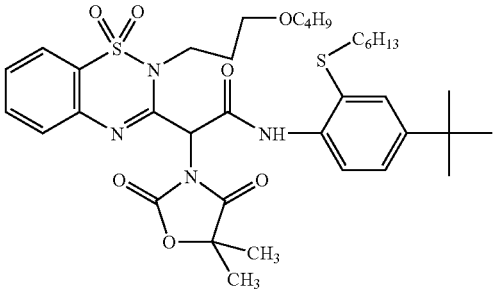

(ExM) Magenta coupler A mixture in 40:40:20 (molar ratio) of

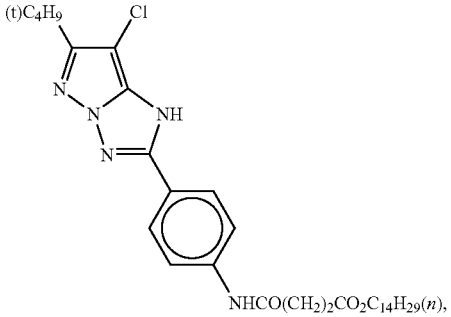

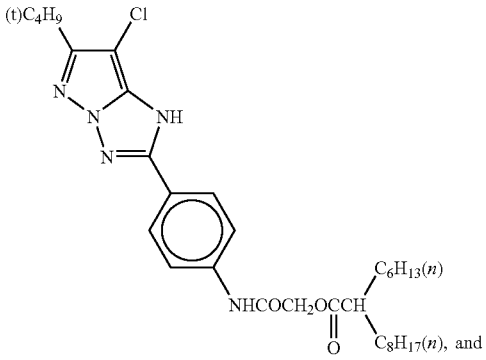

and

-continued

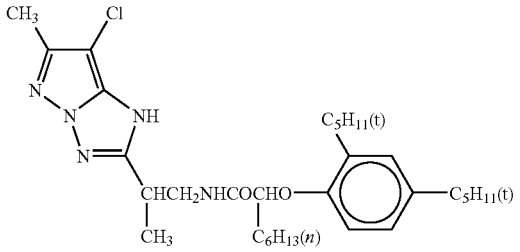

(ExC-1) Cyan coupler

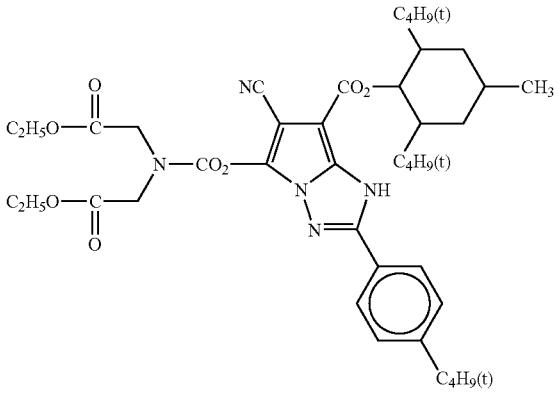

(ExC-2) Cyan coupler

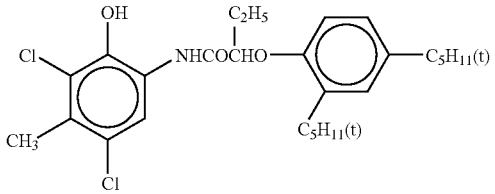

(ExC-3) Cyan coupler

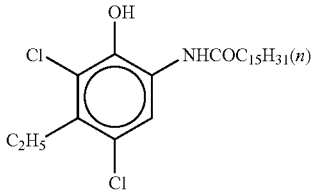

(Cpd-1) Color-image stabilizer

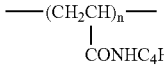

Number-average molecular weight 60,000

(Cpd-2) Color-image stabilizer

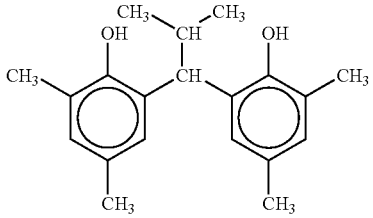

(Cpd-3) Color-image stabilizer

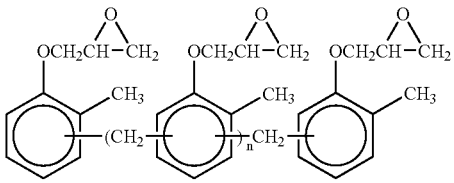

n = 7 ~ 8 (average value)

-continued (Cpd-4) Color-mixing inhibitor

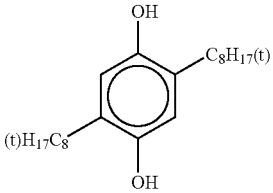

(Cpd-5) Color-image stabilizer

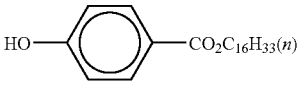

(Cpd-6) Color-image stabilizer

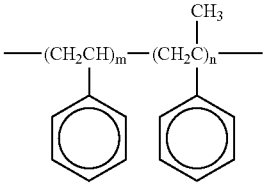

Number-average molecular weight 600 m/n = 10/90

(Cpd-7) Color-image stabilizer

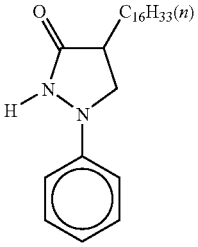

(Cpd-8) Color-image stabilizer

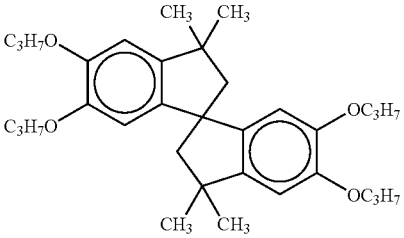

(Cpd-9) Color-image stabilizer

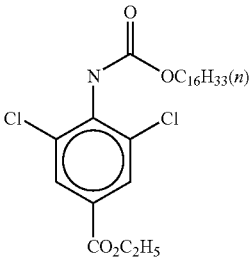

(Cpd-10) Color-image stabilizer

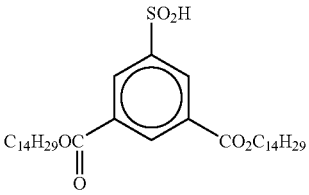

-continued
(Cpd-11)
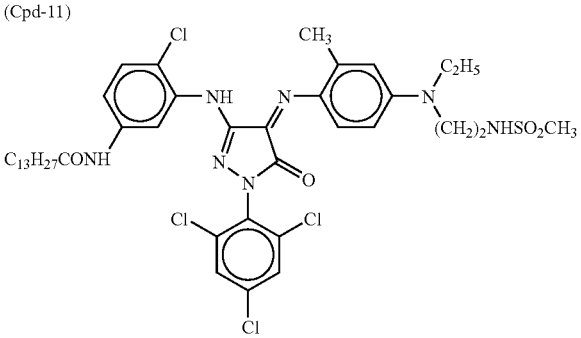
(Cpd-12)
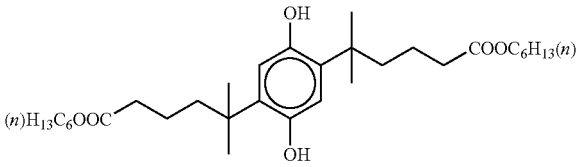
(Cpd-13) Surface-active agent A mixture in 6:2:2 (molar ratio) of (a)/(b)/(c)
(a)
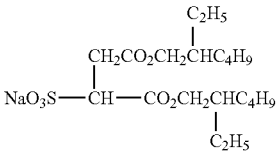
(b)
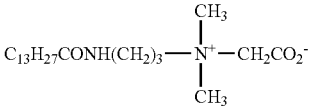
(c)
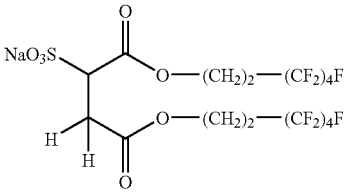
(Cpd-14)
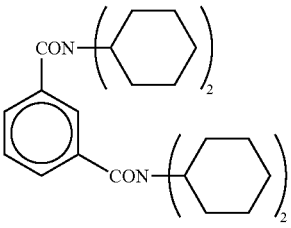
(Cpd-15)
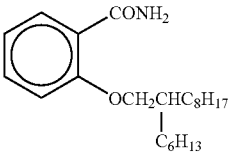
(Cpd-16)
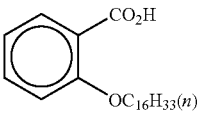
-continued
(Cpd-17)
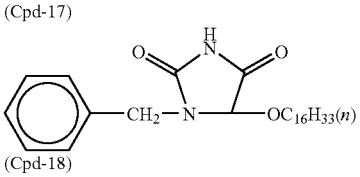
(Cpd-18)
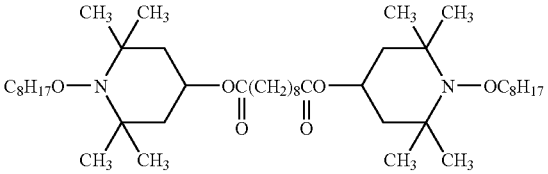
(Cpd-19)
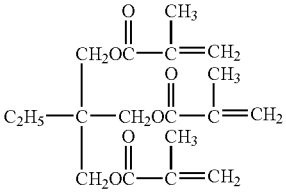
(Cpd-20)
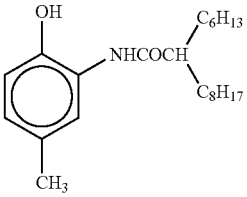
(Cpd-21)
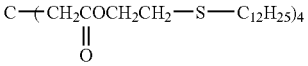
(Cpd-22)
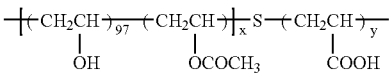
x:y = 5:1 (mass ratio)
(Cpd-23)
K A Y A R A D D P C A-30 manufactured by Nippon Kayaku Co., Ltd.
(Solv-1)
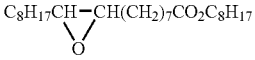
(Solv-2)
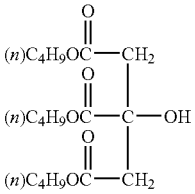
(Solv-3)
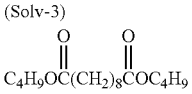
(Solv-4)
$O{=}P(OC_6H_{13}(n))_3$
(Solv-5)
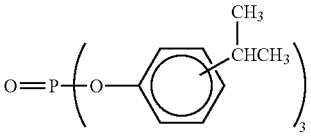
(Solv-6)
$C_8H_{17}CH{=}CHC_8H_{16}OH$ -continued (Solv-7)

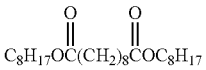

(Solv-8)

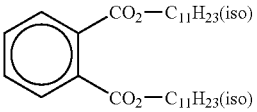

(Solv-9)

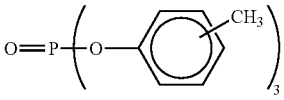

(S1-4)

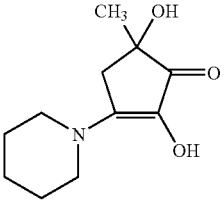

(UV-1) Ultraviolet absorbing agent

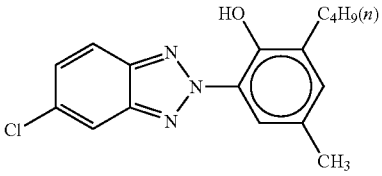

(UV-2) Ultraviolet absorbing agent

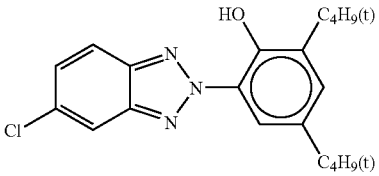

(UV-3) Ultraviolet absorbing agent

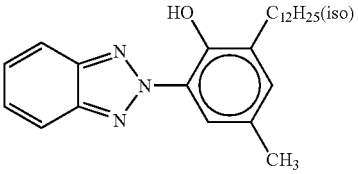

(UV-4) Ultraviolet absorbing agent

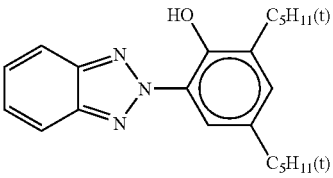

-continued (UV-5) Ultraviolet absorbing agent

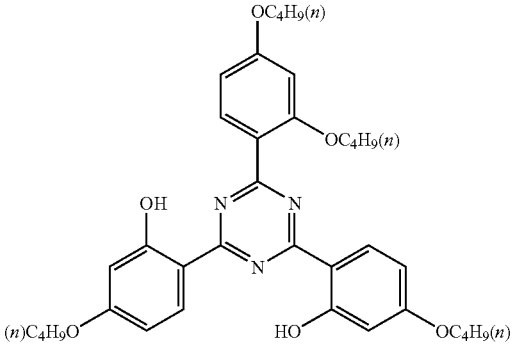

UV-A:

A mixture of UV-1/UV-4/UV-5 = 1/7/2 (mass ratio)

UV-B:

A mixture of UV-1/UV-3/UV-4/UV-5 = 1/3/5/1 (mass ratio)

The thus-obtained sample was designated to as Sample 101. Samples 102 to 112 were prepared in the same manner as Sample 101, except that Compound A was changed, as shown in Table 1 below.

Compound B: Compound described in JP-A-7-140579

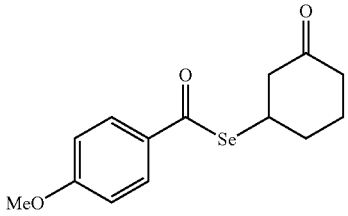

Compound C: Compound described in JP-A-7-140579

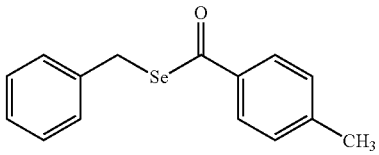

Compound D: Compound described in JP-A-7-301879

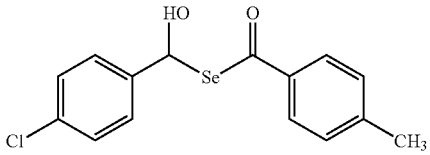

Processing Process

The above Sample 105 was processed into a form of a roll with a width of 127 mm, and the resultant sample was exposed with a standard photographic image, by using Digital Mini Lab FRONTIER 350 (trade name, manufactured by Fuji Photo Film Co., Ltd.). Thereafter, a continuous processing (running test) was performed until the volume of the color-developer replenisher used in the following processing step became twice the volume of the color-developer tank.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Note)

*Replenishment rate per $m^2$ of the photosensitive material to be processed

-continued

| Processing step | Temperature | Time | Replenishment rate* |
|---|---|---|---|

**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained inthat tank was supplied to the rinse (4), and the concentrated water was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The compositions of each processing solution were as follows.

| | (Tank solution) | (Replenisher) |
|---|---|---|
| (Color developer) | | |
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline. 3/2 sulfate-monohydrate | 4.8 g | 14.0 g |
| Potassium carbonate | 26.3 g | 26.3 g |
| Water to make | 1,000 ml | 1,000 ml |
| pH (25° C., adjusted using sulfuric acid and KOH) | 10.15 | 12.40 |
| (Bleach-fixing solution) | | |
| Water | 800 ml | 800 ml |
| Ammonium thiosulfate (750 g/l) | 107 ml | 214 ml |
| m-Carboxybenzenesulfinic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C., adjusted using nitric acid and aqueous ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

FL-1

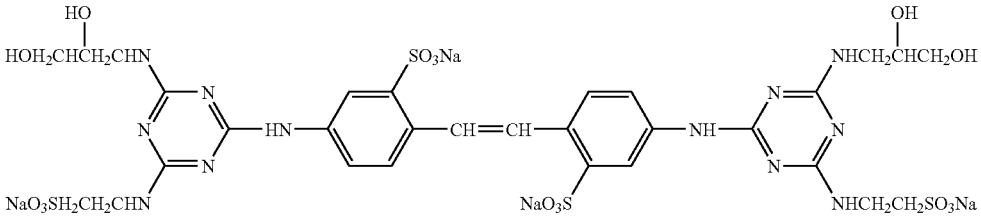

-continued

| | (Tank solution) | (Replenisher) |
|---|---|---|
| FL-2 | | |

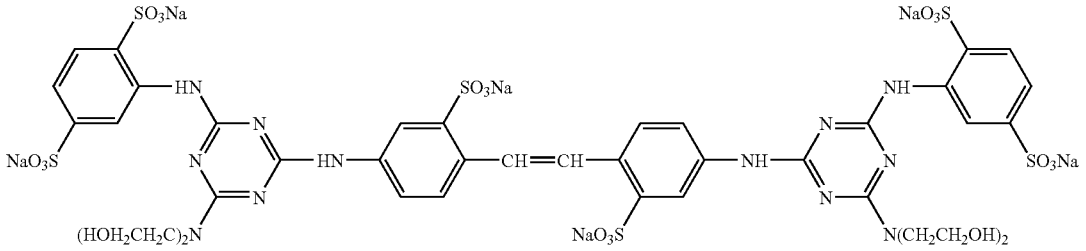

Each sample was subjected to gradation exposure to impart gray, with the following exposure apparatus, and then, at five seconds after the exposure was finished, the sample was subject to color-development processing by the above processing. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG, manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers was maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The sensitivity was defined as the inverse number of the exposure amount required to give a density higher by 1.0 than the fog density of yellow, and expressed by a relative value when the sensitivity of Sample 101 was defined as 100.

To evaluate the rate of increase in the fog density of yellow when a light-sensitive material was stored for a long period of time, the above exposure and processing were carried out for the case of each sample being stored for two weeks in an atmosphere of 35° C./55%RH, and the case of each sample being stored in a refrigerator (10° C.) for the same period of time. The increase in the fog density of yellow was expressed by the difference (ΔD) in fog density between the sample stored in the refrigerator and the sample stored at 35° C./55%RH. The larger the value (difference) is, the larger the increase in the fog density of yellow is, when the light-sensitive material is stored for a long period of time.

TABLE 1

| Sample | Added compound | Relative sensitivity | ΔD | Remarks |
|---|---|---|---|---|
| 101 | Compound A | 100 | 0.06 | Comparative example |
| 102 | Compound B | 105 | 0.05 | Comparative example |

TABLE 1-continued

| Sample | Added compound | Relative sensitivity | ΔD | Remarks |
|---|---|---|---|---|
| 103 | Compound C | 99 | 0.04 | Comparative example |
| 104 | Compound D | 101 | 0.05 | Comparative example |
| 105 | Compound 1 according to this invention | 137 | 0.03 | This invention |
| 106 | Compound 14 according to this invention | 131 | 0.02 | This invention |
| 107 | Compound 21 according to this invention | 137 | 0.02 | This invention |
| 108 | Compound 22 according to this invention | 135 | 0.02 | This invention |
| 109 | Compound 31 according to this invention | 136 | 0.02 | This invention |
| 110 | Compound 40 according to this invention | 130 | 0.02 | This invention |
| 111 | Compound 41 according to this invention | 133 | 0.02 | This invention |
| 112 | Compound 43 according to this invention | 131 | 0.02 | This invention |

As is apparent from the results in Table 1, it is understood that the color papers containing the silver halide grains, which were chemically sensitized in the presence of the compound represented by formula (1), were remarkably high in sensitivity and quite low in the fog density after storage for a long period of time.

Example 2

(Preparation of Seed Emulsion 1)

One liter of a dispersion medium solution, containing 0.38 g of KBr and 0.5 g of a low-molecular weight gelatin (molecular weight, 15,000), was kept in a reactor at 40° C., and then thereto was added 20 ml of a 0.29 mol/l aqueous silver nitrate solution, and 20 ml of a 0.29 mol/l aqueous KBr solution, simultaneously, over 40 seconds, with stirring. After the addition was finished, 22 ml of a 10% KBr solution was added to the mixture, which was then heated to 75° C. After the temperature was raised, an aqueous gelatin solution (60° C.) of 35 g of trimellitated gelatin in 250 ml of water was added to the dispersion medium solution. At this time, the solution was adjusted to pH 6.0. Then, a 1.2 mol/l aqueous silver nitrate solution and a 1.2 mol/l aqueous KBr solution were added, simultaneously, to the above solution. At this time, silver iodide fine-grains were added at the same time, in an amount that would make the proportion of silver iodide to silver nitrate to be added be 10 mol %. At this time, the pBr of the dispersion medium was kept at 2.64. After the solution was washed with water, a gelatin was added thereto, to adjust the solution to make the pH and pAg of the solution 5.7 and 8.8, respectively; to make the mass of silver per 1 kg of the emulsion 131.8 g, and to make the mass of the gelatin 64.1 g, to thereby prepare Seed emulsion 1.

(Preparation of Emulsion Em-K)

1,211 ml of an aqueous solution containing 46 g of trimellitated gelatin, with a trimellitated ratio of 97%, and 1.7 g of KBr, was kept at 75° C. and stirred vigorously. 48 g of the aforementioned Seed emulsion 1 was added to the solution, and then to thereto was added 0.3 g of a modified silicon oil (L7602, trade name, manufactured by Nippon Unicar Company Limited). The resulting solution was adjusted to pH 5.5 by adding $H_2SO_4$. Then, to the above solution, an aqueous KBr and KI mixture solution containing KI 10 mol % and 67.6 ml of an aqueous solution containing 7.0 g of $AgNO_3$, were added, over six minutes, by a double jet method in such a manner that the flow rates of the solutions were accelerated to make the final flow rates 5.1 times the initial flow rates. At this time, the potential of silver was kept at +0 mV to a saturated calomel electrode. After 2 mg of sodium benzenethiosulfonate and 2 mg of thiourea dioxide were added to the solution, an aqueous KBr and KI mixed solution containing KI 10 mol % and 600 ml of an aqueous solution containing 170 g of $AgNO_3$, were added to the above solution, over 120 minutes, by a double jet method, in such a manner that the flow rates of the solutions were accelerated to make the final flow rates 3.7 times the initial flow rates. At this time, the potential of silver was kept at +10 mV to a saturated calomel electrode. 150 ml of an aqueous solution containing 46.8 g of $AgNO_3$, and an aqueous KBr solution, were added, over 22 minutes, by a double jet method. At this time, the potential of silver was kept at +20 mV with respect to a saturated calomel electrode. After the resulting solution was washed with water, a gelatin was added, to adjust the solution to pH 5.8 and pAg 8.7, at 40° C. N-hydroxy-N-methylurea and F-11 were added to the solution, which was then heated to 60° C. Sensitizing dyes 13 and 14 were added, and then potassium thiocyanate, chloroauric acid, and sodium thiosulfate were added, in proper amounts, and further, Compound A ($4.0\times10^{-6}$ mol per mol of the finished silver halide) was added to the solution, to carry out optimum chemical sensitization. F-2 and F-3 were added when the chemical sensitization was finished.

The support used in this example was prepared in the following manner.

1) First Layer and Undercoat Layer

A polyethylene naphthalate support, 90 μm in thickness, was subjected to glow discharge treatment, in which both surfaces of the support were treated in the following conditions: treating atmosphere pressure, 2.66×10 Pa; partial pressure of $H_2O$ in the atmosphere gas, 75%; discharge frequency, 30 kHz; power, 2,500 W; and process intensity, 0.5 kV·A·min/$m^2$. Onto this support, a coating solution having the following composition was applied as a first layer, in a coating amount of 5 mL/$m^2$, using a bar coating method described in JP-B-58-4589.

| | |
|---|---|
| Conductive fine-particle dispersion (aqueous dispersion having a $SnO_2/Sb_2O_5$ particle concentration of 10%, secondary aggregate of primary particles having a particle diameter of 0.005 μm, the secondary aggregate having an average particle diameter of 0.05 μm) | 50 mass parts |
| Gelatin | 0.5 mass part |
| Water | 49 mass parts |
| Polyglycerol polyglycidyl ether | 0.16 mass part |
| Poly oxyethylene sorbitan monolaurate (degree of polymerization: 20) | 0.1 mass part |

Further, after the first layer was formed by coating, the support was wound around a stainless core, of diameter 20 cm, and heat-treated at 110° C. (Tg of the PEN support, 119° C.) for 48 hours, imparting heat history, followed by annealing. Then, a coating solution having the following composition was applied, as an undercoat layer for emulsion, to the side opposite to the first layer side of the support, in a coating amount of 10 mL/$m^2$, using a bar coating method.

| | |
|---|---|
| Gelatin | 1.01 mass parts |
| Salicylic acid | 0.30 mass part |
| Resorcin | 0.40 mass part |
| Polyoxyethylene nonylphenyl ether (degree of polymerization: 10) | 0.11 mass part |
| Water | 3.53 mass parts |
| Methanol | 84.57 mass parts |
| n-Propanol | 10.08 mass parts |

Further, a second layer and a third layer, which will be explained later, were formed, in this order, on the first layer by coating, and finally, a color negative light-sensitive material, having a composition that will be explained later, was multi-coated to the side opposite with respect to the support, to manufacture a transparent magnetic recording medium with a silver halide emulsion layer.

2) Second Layer (Transparent Magnetic Recording Layer)

(1) Dispersion of a Magnetic Substance 1100 mass parts of $\gamma$-$Fe_2O_3$ magnetic substance coated with Co (average major axis length, 0.25 μm; SBET, 39 $m^2$/g; Hc, $6.56\times10^4$ A/m; σS, 77.1 $Am^2$/kg; and σr, 37.4 $Am^2$/kg), 220 mass parts of water, and 165 mass parts of a silane coupling agent [i.e. 3-(polyoxyethynyl)oxypropyl trimethoxysilane (degree of polymerization, 10)], were added and thoroughly kneaded for three hours in an open kneader. This coarsely dispersed and viscous solution was dried at 70° C. for one day and one night, to remove water, followed by heat treatment at 110° C. for one hour, to manufacture surface-treated magnetic particles.

Further, the following components were kneaded for 4 hours again in an open kneader.

| | |
|---|---|
| The above surface-treated magnetic particles | 855 g |
| Diacetyl cellulose | 25.3 g |
| Methyl ethyl ketone | 136.3 g |
| Cyclohexanone | 136.3 g |

Further, the following components were finely dispersed for 4 hours in a sand mill (¼ G sand mill) at 2,000 rpm. As the dispersing media, 1 mmϕ glass beads were used.

| | |
|---|---|
| The above kneaded solution | 45 g |
| Diacetyl cellulose | 23.7 g |
| Methyl ethyl ketone | 127.7 g |
| Cyclohexanone | 127.7 g |

Further, according to the following formulation, a magnetic substance-containing intermediate solution was manufactured.

(2) Preparation of a Magnetic Substance-Containing Intermediate Solution

| | |
|---|---|
| The above fine-dispersion of the magnetic substance | 674 g |
| Diacetyl cellulose solution (solid content, 4.34%; solvent, methylethylketone/cyclohexanone = 1/1) | 24,280 g |
| Cyclohexanone | 46 g |

These components were mixed and then stirred using a disper, to manufacture a "magnetic substance-containing intermediate solution".

The following components were used, to manufacture an α-alumina abrasive dispersion.

(a) Preparation of a Particle Dispersion of Sumiko Random AA-1.5 (average primary particle diameter, 1.5 μm; specific surface area, 1.3 $m^2/g$)

| | |
|---|---|
| Sumiko Random AA-1.5 | 152 g |
| Silane coupling agent KBM 903 (trade name, manufactured by Shin-Etsu Chemical Co., Ltd.) | 0.48 g |
| Diacetyl cellulose solution (solid content, 4.5%; solvent, methylethylketone/cyclohexanone = 1/1) | 227.52 g |

The above components were finely dispersed, using a sand mill (¼ G sand mill) coated with ceramics, at 800 rpm for 4 hours. As the media, 1 mmϕ zirconia beads were used.

(b) Colloidal Silica Particle Dispersion (Fine-Particles)

"MEK-ST", trade name, manufactured by Nissan Chemical Industries Ltd., was used.

This is a dispersion of colloidal silica having an average primary particle diameter of 0.015 μm, in methyl ethyl ketone as the dispersion medium, with the solid content of 30%.

(3) Preparation of a Second Layer Coating Solution

| | |
|---|---|
| The above magnetic substance-containing intermediate solution | 19,053 g |
| Diacetyl cellulose solution (solid content, 4.5%; solvent, methylethylketone/cyclohexanone = 1/1) | 264 g |
| Colloidal silica dispersion "MEK-ST" "dispersion b" (solid content: 30%) | 128 g |

-continued

| | |
|---|---|
| AA-1.5 dispersion "dispersion a" | 12 g |
| Millionate MR-400 diluted solution (trade name, manufactured by Nippon Polyurethane Industry Co., Ltd.; solid content, 20%; dilute solvent, methylethylketone/cyclohexanone = 1/1) | 203 g |
| Methyl ethyl ketone | 170 g |
| Cyclohexanone | 170 g |

A coating solution obtained by mixing and stirring the above components was applied in a coating amount of 29.3 $mL/m^2$, by using a wire bar. The coated solution was dried at 110° C. The dried thickness of the magnetic layer was 1.0 μm.

3) Third Layer (Higher Fatty Acid Ester Lubricant-Containing Layer)

(1) Preparation of a Lubricant Dispersion Raw Solution

The following Solution (i) was heated to 100° C. to dissolve, and it was added to the following Solution (ii). The resultant mixed solution was dispersed by a high-pressure homogenizer, to prepare a lubricant dispersion raw solution.

| | |
|---|---|
| Solution (i) | |
| The following compound $C_6H_{13}CH(OH)(CH_2)_{10}COOC_{50}H_{101}$ | 399 mass parts |
| The following compound $n\text{-}C_{50}H_{101}O(CH_2CH_2O)_{16}H$ | 171 mass parts |
| Cyclohexanone | 830 mass parts |
| Solution (ii) | |
| Cyclohexanone | 8,600 mass parts |

(2) Preparation of a Spherical Inorganic Particle Dispersion

The following formulation was used, to prepare a spherical inorganic particle dispersion (c1).

| | |
|---|---|
| Isopropyl alcohol | 93.54 mass parts |
| Silane coupling agent KBM903 (trade name, manufactured by Shin Etsu Silicone Co., Ltd.) | |
| Compound 1-1: $(CH_3O)_3Si—(CH_2)_3—NH_2$ | 5.53 mass parts |
| Compound 1 | 2.93 mass parts |

Compound 1

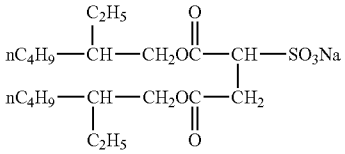

| | |
|---|---|
| Seehosta KEP50 (amorphous spherical silica; average particle diameter, 0.5 μm; trade, name, manufactured by Nippon Shokubai Co., Ltd.) | 88.00 mass parts |

The above components were stirred for 10 minutes, and then the following component was added thereto.

| | |
|---|---|
| Diacetone alcohol | 252.93 mass parts |

The resulting solution was dispersed for 3 hours under ice-cooling and stirring by using a ultrasonic homogenizer "SONIFIER450" (trade name, manufactured by BRANSON), to complete a spherical inorganic particle dispersion c1.

(3) Preparation of a Spherical Organic Polymer Particle Dispersion

A spherical organic polymer particle dispersion "c2" was prepared using the following formulation.

| | |
|---|---|
| XC99-A8808 (trade name, manufactured by GE Toshiba Silicones, spherical crosslinked polysiloxane particles, average particle diameter of 0.9 μm) | 60 mass parts |
| Methyl ethyl ketone | 120 mass parts |
| Cyclohexanone (solid content, 20%; solvent, methylethylketone/cyclohexanone = 1/1) | 120 mass parts |

The above components were dispersed for 2 hours under ice-cooling and stirring by using a ultrasonic homogenizer "SONIFIER450 (manufactured by BRANSON), to complete a spherical organic polymer particle dispersion c2.

(4) Preparation of a Third Layer Coating Solution

To 542 g of the aforementioned lubricant dispersion raw solution, were added the following components, to prepare a third layer coating solution.

| | |
|---|---|
| Diacetone alcohol | 5,950 g |
| Cyclohexanone | 176 g |
| Ethyl acetate | 1,700 g |
| The above Seehosta KEP50 dispersion "cl" | 53.1 g |
| The above spherical organic polymer particle dispersion "c2" | 300 g |
| FC 431 (trade name, manufactured by 3M, solid content of 50%; solvent, ethyl acetate) | 2.65 g |
| BYK 310 (trade name, manufactured by BYK Chemi Japan Co., Ltd.; solid content, 25%) | 5.3 g |

The above third layer coating solution was applied onto the second layer, in a coating amount of 10.35 mL/m$^2$, and then dried at 110° C., further at 97° C., for 3 minutes.

4) Formation of a Light-Sensitive Layer by Coating

Then, each layer having the following composition was multicoated, to the side opposite to the back layer obtained above with respect to the support, to prepare a color negative film Sample 201.

(Layer Constitution)

The composition of each layer is shown below. The numbers show coating amounts (g/m$^2$). In the case of the silver halide emulsion, the coating amount is in terms of silver.

| (Sample 201) | |
|---|---|
| First Layer (First halation-preventing layer) | |
| Black colloidal silver | silver 0.168 |
| Silver iodobromide emulsion (not spectrally sensitized; average particle diameter in equivalent sphere diameter, 0.07 μm) | silver 0.010 |
| Gelatin | 0.740 |
| ExM-1 | 0.068 |
| ExC-1 | 0.002 |
| ExC-3 | 0.002 |
| Cpd-2 | 0.001 |
| F-8 | 0.001 |
| HBS-1 | 0.099 |
| HBS-2 | 0.013 |
| Second Layer (Second halation-preventing layer) | |
| Black colloidal silver | silver 0.102 |
| Gelatin | 0.667 |
| ExF-1 | 0.002 |
| F-8 | 0.001 |
| Solid dispersed dye ExF-7 | 0.100 |
| HBS-1 | 0.045 |
| Third Layer (Intermediate layer) | |
| ExC-2 | 0.050 |
| Cpd-1 | 0.089 |
| Polyethyl acrylate latex | 0.200 |
| HBS-1 | 0.054 |
| Gelatin | 0.458 |
| Fourth Layer (Low-sensitivity red-sensitive emulsion layer) | |
| Em-C | silver 0.320 |
| Em-D | silver 0.414 |
| ExC-1 | 0.354 |
| ExC-2 | 0.014 |
| ExC-3 | 0.093 |
| ExC-4 | 0.193 |
| ExC-5 | 0.034 |
| ExC-6 | 0.015 |
| ExC-8 | 0.053 |
| ExC-9 | 0.020 |
| Cpd-2 | 0.025 |
| Cpd-4 | 0.025 |
| Cpd-7 | 0.015 |
| UV-2 | 0.022 |
| UV-3 | 0.042 |
| UV-4 | 0.009 |
| UV-5 | 0.075 |
| HBS-1 | 0.274 |
| HBS-5 | 0.038 |
| Gelatin | 2.757 |
| Fifth Layer (Medium-sensitivity red-sensitive emulsion layer) | |
| Em-B | silver 1.152 |
| ExM-5 | 0.011 |
| ExC-1 | 0.304 |
| ExC-2 | 0.057 |
| ExC-3 | 0.020 |
| ExC-4 | 0.135 |
| ExC-5 | 0.012 |
| ExC-6 | 0.039 |
| ExC-8 | 0.016 |
| ExC-9 | 0.077 |
| Cpd-2 | 0.056 |
| Cpd-4 | 0.035 |
| Cpd-7 | 0.020 |

-continued (Sample 201)

| | |
|---|---|
| HBS-1 | 0.190 |
| Gelatin | 1.346 |
| Sixth Layer | |
| (High-sensitivity red-sensitive emulsion layer) | |
| Em-A | silver 0.932 |
| ExM-5 | 0.156 |
| ExC-1 | 0.066 |
| ExC-3 | 0.015 |
| ExC-6 | 0.027 |
| ExC-8 | 0.114 |
| ExC-9 | 0.089 |
| ExC-10 | 0.107 |
| ExY-3 | 0.010 |
| Cpd-2 | 0.070 |
| Cpd-4 | 0.079 |
| Cpd-7 | 0.030 |
| HBS-1 | 0.314 |
| HBS-2 | 0.120 |
| Gelatin | 1.206 |
| Seventh Layer (Intermediate layer) | |
| Cpd-1 | 0.078 |
| Cpd-6 | 0.369 |
| Solid dispersed dye ExF-4 | 0.030 |
| HBS-1 | 0.048 |
| Polyethyl acrylate latex | 0.088 |
| Gelatin | 0.739 |
| Eighth Layer | |
| (Layer to give interlayer effect to red-sensitive layers) | |
| Em-E | silver 0.408 |
| Cpd-4 | 0.034 |
| ExM-2 | 0.121 |
| ExM-3 | 0.002 |
| ExM-4 | 0.035 |
| ExY-1 | 0.018 |
| ExY-4 | 0.038 |
| ExC-7 | 0.036 |
| HBS-1 | 0.343 |
| HBS-3 | 0.006 |
| HBS-5 | 0.030 |
| Gelatin | 0.884 |
| Ninth Layer | |
| (Low-sensitivity green-sensitive emulsion layer) | |
| Em-H | silver 0.276 |
| Em-I | silver 0.238 |
| Em-J | silver 0.325 |
| ExM-2 | 0.344 |
| ExM-3 | 0.055 |
| ExY-1 | 0.018 |
| ExY-3 | 0.014 |
| ExC-7 | 0.004 |
| HBS-1 | 0.505 |
| HBS-3 | 0.012 |
| HBS-4 | 0.095 |
| HBS-5 | 0.055 |
| Cpd-5 | 0.010 |
| Cpd-7 | 0.020 |
| Gelatin | 1.382 |
| Tenth layer | |
| (Middle-sensitivity green-sensitive emulsion layer) | |
| Em-G | silver 0.439 |
| ExM-2 | 0.046 |
| ExM-3 | 0.033 |
| ExM-5 | 0.019 |
| ExY-3 | 0.006 |
| ExC-6 | 0.010 |
| ExC-7 | 0.011 |

-continued (Sample 201)

| | |
|---|---|
| ExC-8 | 0.010 |
| ExC-9 | 0.009 |
| HBS-1 | 0.046 |
| HBS-3 | 0.002 |
| HBS-4 | 0.035 |
| HBS-5 | 0.020 |
| Cpd-5 | 0.004 |
| Cpd-7 | 0.010 |
| Gelatin | 0.446 |
| Eleventh layer | |
| (High-sensitivity green-sensitive emulsion layer) | |
| Em-F | silver 0.497 |
| Em-H | silver 0.286 |
| ExC-6 | 0.007 |
| ExC-8 | 0.012 |
| ExC-9 | 0.014 |
| ExM-1 | 0.019 |
| ExM-2 | 0.056 |
| ExM-3 | 0.013 |
| ExM-4 | 0.034 |
| ExM-5 | 0.039 |
| ExM-6 | 0.021 |
| ExY-3 | 0.005 |
| Cpd-3 | 0.005 |
| Cpd-4 | 0.007 |
| Cpd-5 | 0.010 |
| Cpd-7 | 0.020 |
| HBS-1 | 0.248 |
| HBS-3 | 0.003 |
| HBS-4 | 0.094 |
| HBS-5 | 0.037 |
| Poly(ethyl acrylate)latex | 0.099 |
| Gelatin | 0.950 |
| Twelfth layer (Yellow filter layer) | |
| Cpd-1 | 0.090 |
| Solid dispersed dye ExF-2 | 0.070 |
| Solid dispersed dye ExF-5 | 0.010 |
| Oil-soluble dye ExF-6 | 0.010 |
| HBS-1 | 0.055 |
| Gelatin | 0.589 |
| Thirteenth Layer | |
| (Low-sensitivity blue-sensitive emulsion layer) | |
| Em-M | silver 0.300 |
| Em-N | silver 0.260 |
| Em-O | silver 0.112 |
| ExC-1 | 0.027 |
| ExC-7 | 0.013 |
| ExY-1 | 0.002 |
| ExY-2 | 0.890 |
| ExY-4 | 0.058 |
| Cpd-2 | 0.100 |
| Cpd-3 | 0.004 |
| HBS-1 | 0.222 |
| HBS-5 | 0.074 |
| Gelatin | 1.553 |
| Fourteenth Layer | |
| (High-sensitivity blue-sensitive emulsion layer) | |
| Em-K | silver 0.421 |
| Em-L | silver 0.421 |
| ExY-2 | 0.211 |
| ExY-4 | 0.068 |
| Cpd-2 | 0.075 |
| Cpd-3 | 0.001 |

-continued

| (Sample 201) | |
|---|---|
| Cpd-7 | 0.030 |
| HBS-1 | 0.124 |
| Gelatin | 0.678 |
| Fifteenth Layer (First protective layer) | |
| Silver iodobromide emulsion (not spectrally sensitized; average particle diameter in equivalent sphere diameter of 0.07 μm) | silver 0.278 |
| UV-1 | 0.167 |
| UV-2 | 0.066 |
| UV-3 | 0.099 |
| UV-4 | 0.013 |
| UV-5 | 0.160 |
| F-ll | 0.008 |
| ExF-3 | 0.003 |
| S-1 | 0.077 |
| HBS-1 | 0.175 |
| HBS-4 | 0.017 |
| Gelatin | 1.297 |
| Sixteenth Layer (Second protective layer) | |
| H-1 | 0.400 |
| B-1 (diameter: 1.7 μm) | 0.050 |
| B-2 (diameter: 1.7 μm) | 0.150 |
| B-3 | 0.029 |
| S-1 | 0.200 |
| Gelatin | 0.748 |

Further, to improve preservability, processability, pressure resistance, antimold and antibacterial properties, antistatic property, and coating property, compounds of W-1 to W-11, B-4 to B-6, and F-1 to F-20, and salts of lead, platinum, iridium and rhodium, were suitably added in each layer.

Preparation of an Organic Solid Dispersion of a Dye

The solid dispersion of Dye ExF-2 in the twelfth layer was dispersed in the following manner.

| | |
|---|---|
| Wet cake of ExF-2 (containing water in 17.6 mass %) | 2.800 kg |
| Sodium octylphenyldiethoxymethanesulfonate (31 mass % aqueous solution) | 0.376 kg |
| F-15 (7% aqueous solution) | 0.011 kg |
| Water | 4.020 kg |
| Total (adjusted to pH 7.2 using NaOH) | 7.210 kg |

A slurry having the above composition was stirred by a dissolver, to make a coarse dispersion. The coarse dispersion was then dispersed, using an agitator mill LMK-4 in the following conditions: peripheral speed of 10 m/s, and discharge amount of 0.6 kg/min, using 0.3-mm-diameter zirconia beads packed at a ratio of 80%, until the absorbance ratio of the dispersion would become 0.29, to obtain a solid dispersion of Dye ExF-2. The average particle diameter of the dye fine-particles was 0.29 μm. Solid dispersions of Dye ExF-4 or ExF-7 were obtained in the same manner. The average particle diameters of the dye fine-particles were 0.28 μm and 0.49 μm, respectively. The solid dispersion of Dye ExF-5 was dispersed by a microprecipitation dispersing method described in Example 1 of European Patent Publication No. 549,489A. The average particle diameter was 0.06 μm.

The characteristics of emulsions to be used in the above light-sensitive material are shown in Tables 2 and 3.

TABLE 2

| | Layer in which the emulsion was used | Grain shape | Average sphere equivalent diameter (μm) | Average circle equivalent diameter (μm)/ variation coefficient (%) | Average thickness (μm)/ variation coefficient (%) | Average aspect ratio | Proportion of tabular grains occupied in all grains (%) | Average thickness in core portion (μm) | Average number of dislocation lines per grain |
|---|---|---|---|---|---|---|---|---|---|
| Em-A | High-sensitivity red-sensitive layer | Tabular grain having (111) principal plane | 1.00 | 1.74/34 | 0.22/16 | 7.9 | 91 | 0.13 | 20 |
| Em-B | Middle-sensitivity red-sensitive layer | Tabular grain having (111) principal plane | 0.69 | 1.14/35 | 0.17/15 | 6.7 | 90 | 0.12 | 15 |
| Em-C | Low-sensitivity red-sensitive layer | Tabular grain having (111) principal plane | 0.50 | 0.79/29 | 0.12/18 | 6.7 | 94 | 0.11 | 10 |
| Em-D | Low-sensitivity red-sensitive layer | Tabular grain having (111) principal plane | 0.37 | 0.45/23 | 0.15/12 | 2.6 | 95 | 0.11 | 10 |
| Em-E | Layer to give interlayer effect to red-sensitive layers | Tabular grain having (111) principal plane | 0.78 | 1.33/30 | 0.18/18 | 7.4 | 90 | 0.12 | 20 |
| Em-F | High-sensitivity green-sensitive layer | Tabular grain having (111) principal plane | 1.00 | 1.74/34 | 0.22/16 | 7.9 | 91 | 0.13 | 20 |
| Em-G | Middle-sensitivity green-sensitive layer | Tabular grain having (111) principal plane | 0.74 | 1.23/40 | 0.18/18 | 6.8 | 90 | 0.12 | 15 |
| Em-H | High-/Low-sensitivity green-sensitive layers | Tabular grain having (111) principal plane | 0.74 | 1.16/31 | 0.20/15 | 5.8 | 91 | 0.12 | 20 |

TABLE 2-continued

| | Layer in which the emulsion was used | Grain shape | Average sphere equivalent diameter (μm) | Average circle equivalent diameter (μm)/ variation coefficient (%) | Average thickness (μm)/ variation coefficient (%) | Average aspect ratio | Proportion of tabular grains occupied in all grains (%) | Average thickness in core portion (μm) | Average number of dislocation lines per grain |
|---|---|---|---|---|---|---|---|---|---|
| Em-I | Low-sensitivity green-sensitive layer | Tabular grain having (111) principal plane | 0.55 | 0.79/30 | 0.14/13 | 5.5 | 97 | 0.13 | 30 |
| Em-J | Low-sensitivity green-sensitive layer | Tabular grain having (111) principal plane | 0.44 | 0.53/30 | 0.17/18 | 3.2 | 97 | 0.10 | 20 |
| Em-K | High-sensitivity blue-sensitive layer | Tabular grain having (111) principal plane | 1.60 | 3.00/25 | 0.31/21 | 10 | 99 | 0.16 | 15 |
| Em-L | High-sensitivity blue-sensitive layer | Tabular grain having (111) principal plane | 1.30 | 2.20/24 | 0.34/22 | 7 | 98 | 0.14 | 20 |
| Em-M | Low-sensitivity blue-sensitive layer | Tabular grain having (111) principal plane | 0.81 | 1.10/30 | 0.23/18 | 4.7 | 97 | 0.13 | 20 |
| Em-N | Low-sensitivity blue-sensitive layer | Tabular grain having (111) principal plane | 0.40 | 0.55/32 | 0.13/16 | 4.6 | 96 | 0.11 | 20 |
| Em-O | Low-sensitivity blue-sensitive layer | Cubic grain having (100) principal plane | 0.21 | 0.21/20 | 0.21/20 | 1 | — | — | — |

TABLE 3

| | Layer in which the emulsion was used | Sensitizing dye(s) |
|---|---|---|
| Em-A | High-sensitivity red-sensitive layer | 1, 3, 4 |
| Em-B | Middle-sensitivity red-sensitive layer | 2, 3, 4 |
| Em-C | Low-sensitivity red-sensitive layer | 1, 3, 4 |
| Em-D | Low-sensitivity red-sensitive layer | 1, 3, 4 |
| Em-E | Layer to give interlayer effect to red-sensitive layers | 5, 10 |
| Em-F | High-sensitivity green-sensitive layer | 5, 6, 9 |
| Em-G | Middle-sensitivity green-sensitive layer | 5, 6, 9 |
| Em-H | High-/Low-sensitivity green-sensitive layers | 5, 6, 7, 8, 9 |
| Em-I | Low-sensitivity green-sensitive layer | 6, 8, 9 |
| Em-J | Low-sensitivity green-sensitive layer | 5, 6, 7 |
| Em-K | High-sensitivity blue-sensitive layer | 13, 14 |
| Em-L | High-sensitivity blue-sensitive layer | 12 |
| Em-M | Low-sensitivity blue-sensitive layer | 14 |
| Em-N | Low-sensitivity blue-sensitive layer | 12, 13 |
| Em-O | Low-sensitivity blue-sensitive layer | 11, 13 |

To each of the emulsions, was added an optimum amount of the spectral sensitizing dye(s), as shown in Table 3, and each of the emulsions was chemically sensitized optimally.

The sensitizing dyes shown in Table 3 are shown below.

Sensitizing dye 1

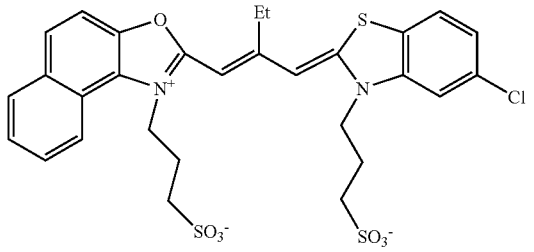

-continued

Sensitizing dye 2

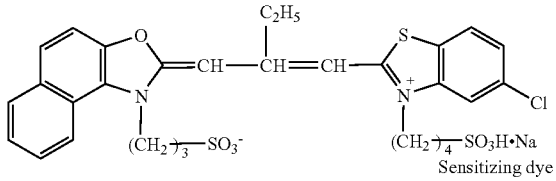

Sensitizing dye 3

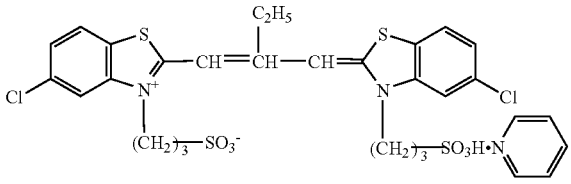

Sensitizing dye 4

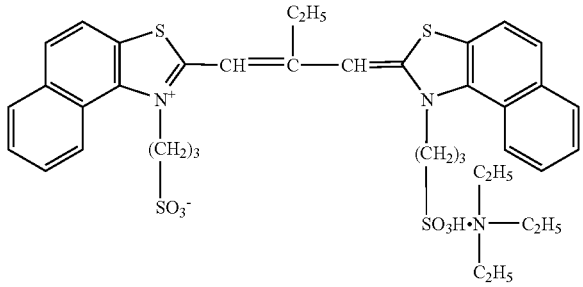

Sensitizing dye 5

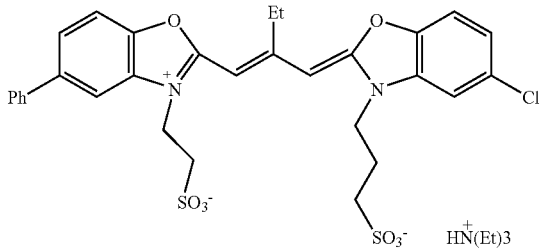

-continued

Sensitizing dye 6

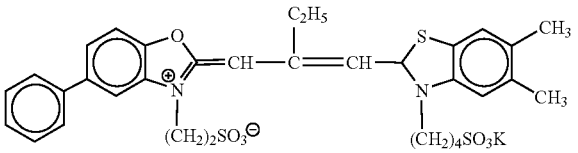

Sensitizing dye 7

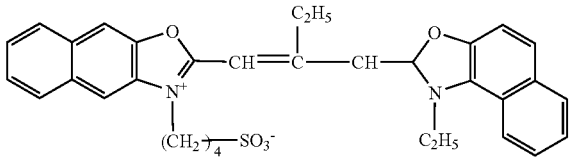

Sensitizing dye 8

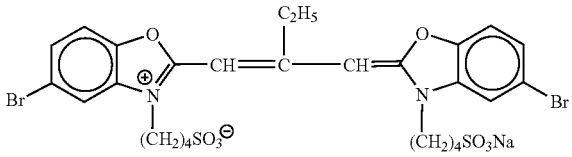

Sensitizing dye 9

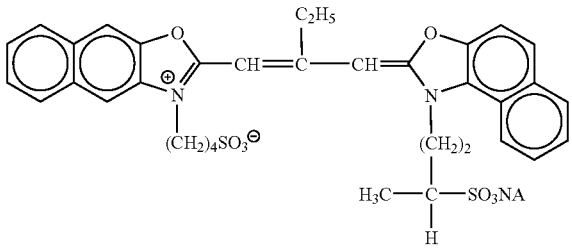

Sensitizing dye 10

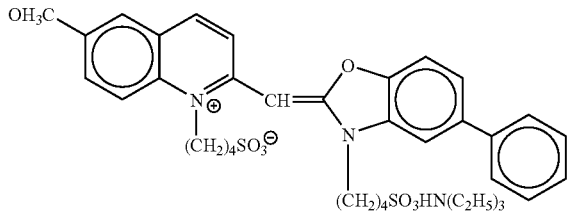

Sensitizing dye 11

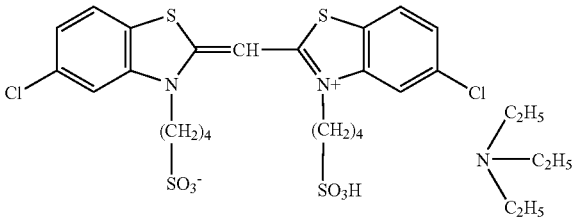

-continued

Sensitizing dye 12

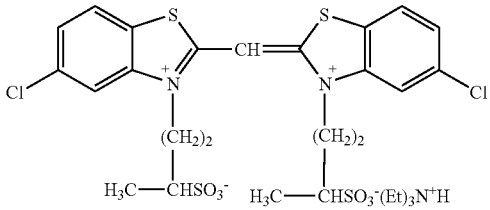

Sensitizing dye 13

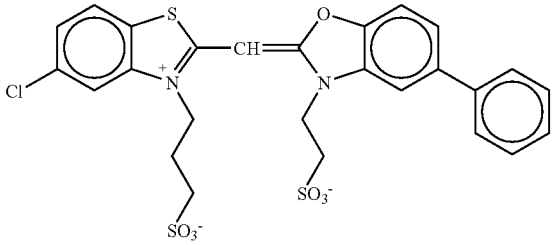

Sensitizing dye 14

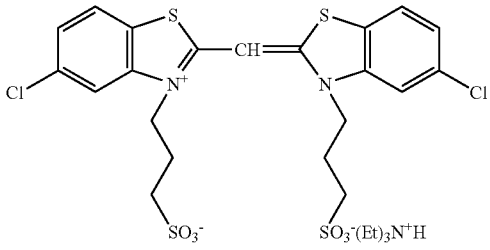

In the preparation of the tabular grains, a low-molecular weight gelatin was used, according to the example described in JP-A-1-158426.

The emulsions Em-L to Em-O each were subjected to reduction sensitization when preparing the grains.

The emulsions Em-A to Em-D and Em-J each were introduced dislocation, by using an iodide ion-releasing agent, according to the example described in JP-A-6-11782.

The emulsions Em-E to Em-H each were introduced dislocation, by using silver iodide fine-grains, which had been prepared just before the addition thereof, in a separate chamber provided with a magnetic coupling induction-type stirrer, as described in JP-A-10-43570.

Compounds used in each layers described above are shown below.

ExF-1
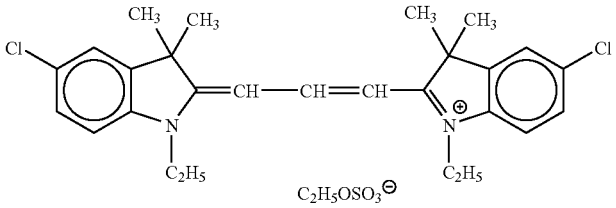
ExF-2
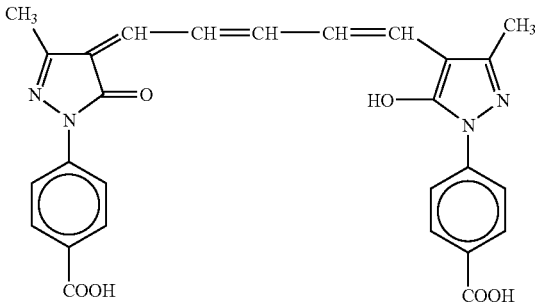
ExF-3
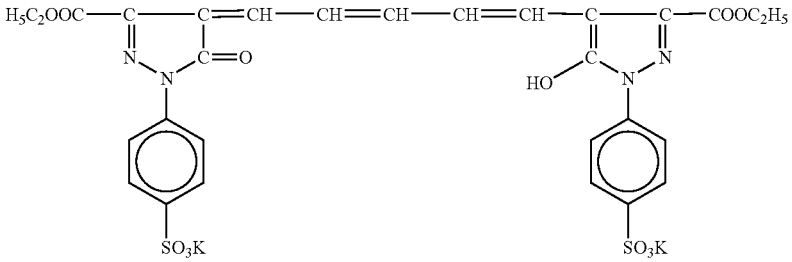
ExF-4
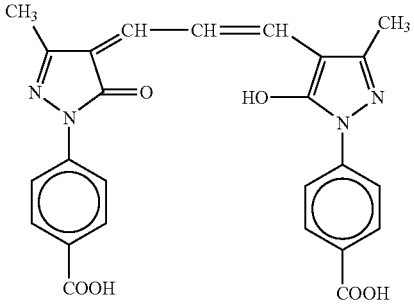
ExF-5
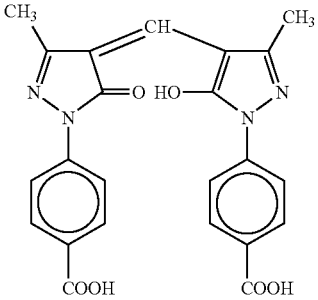
ExF-6
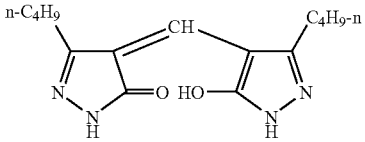
ExF-7
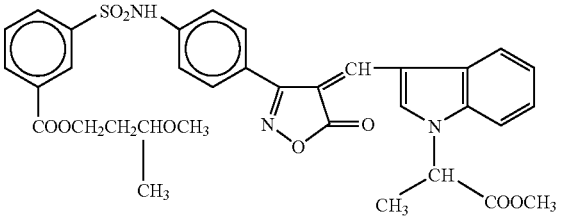
ExC-1
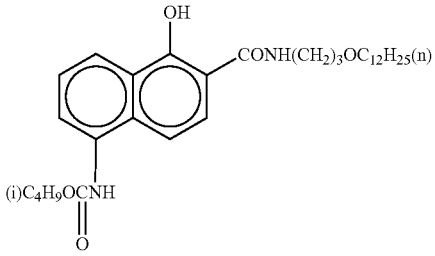

-continued
ExC-2
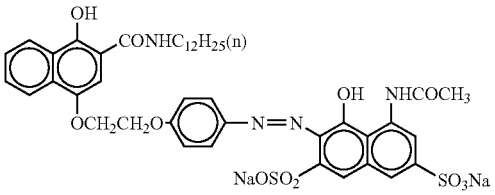
ExC-3
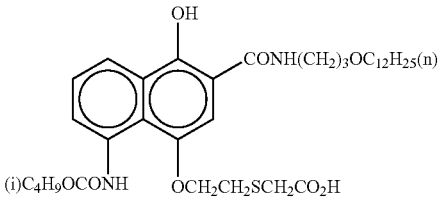
ExC-4
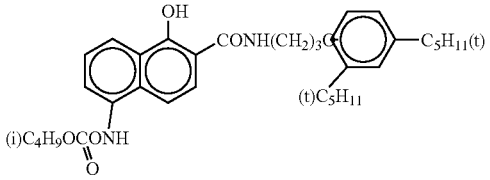
ExC-5
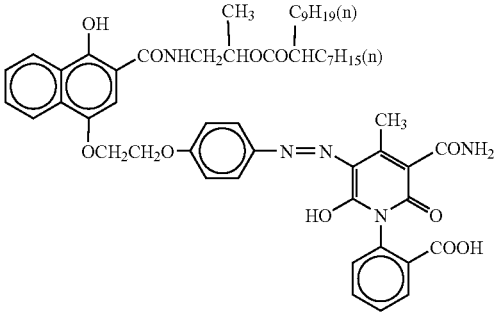
ExC-6
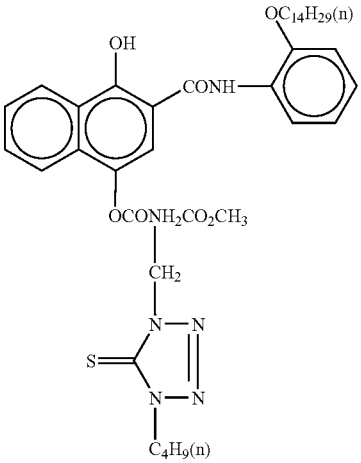
ExC-7
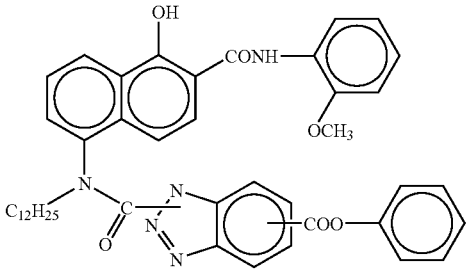
ExC-8
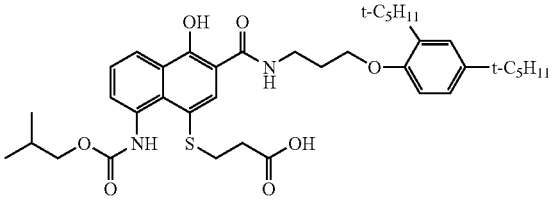
ExC-9
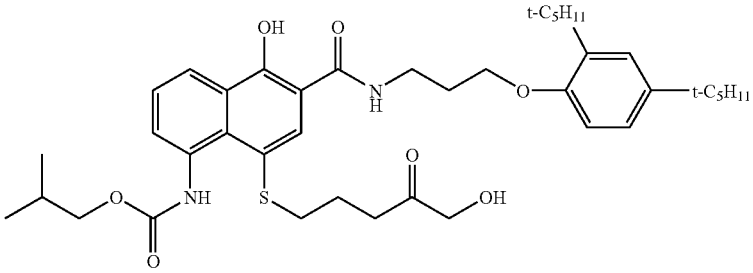

-continued
ExC-10
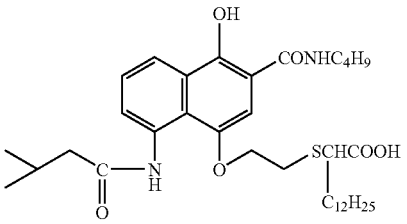
ExM-1
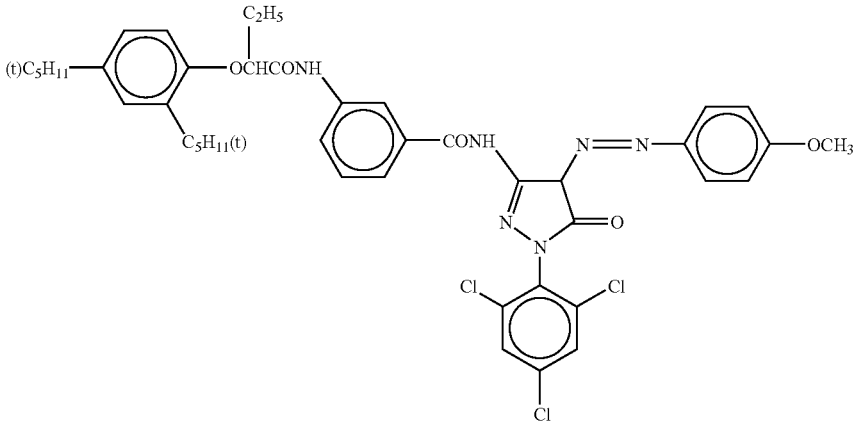
ExM-2
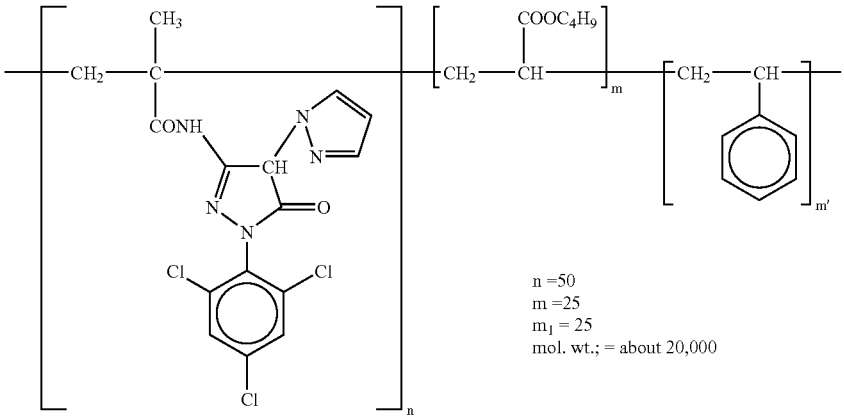
ExM-3
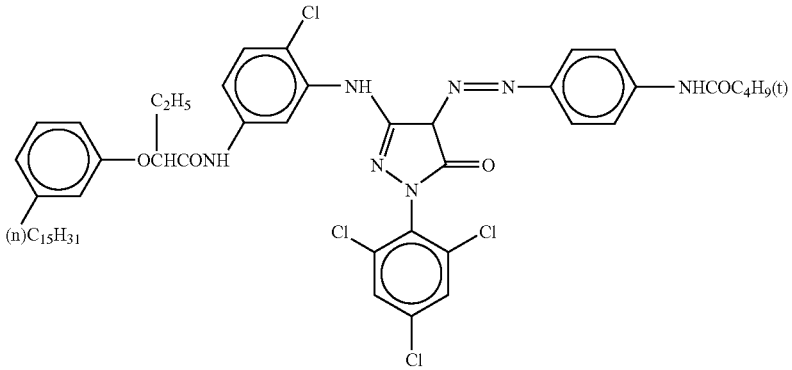

-continued
ExM-4
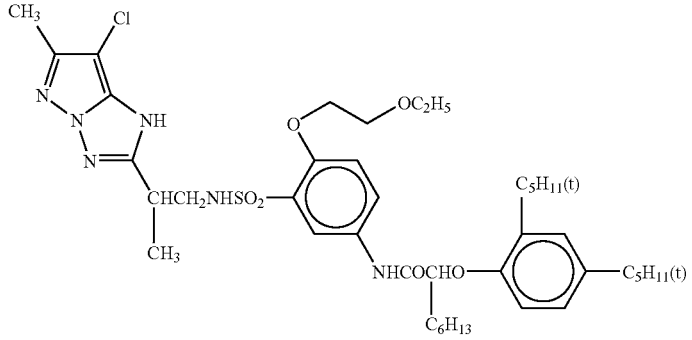
ExM-5
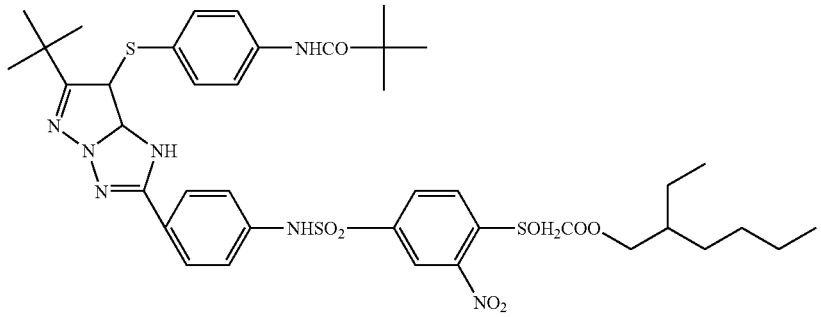
ExM-6
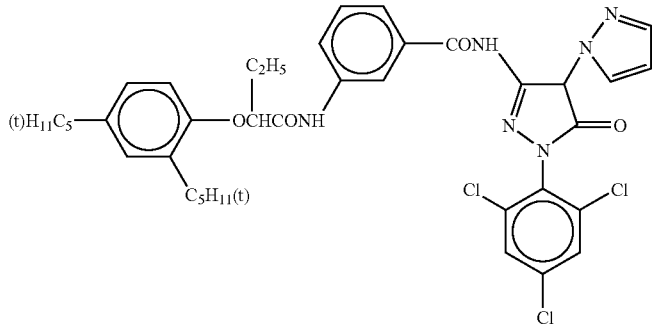
ExY-1
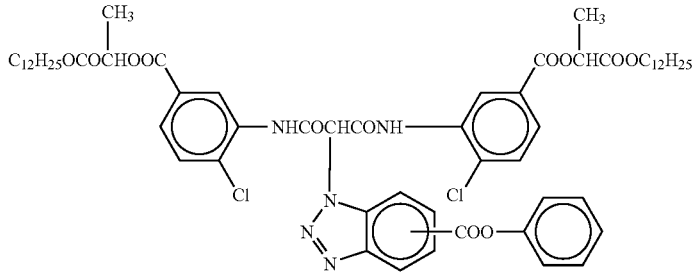
ExY-2
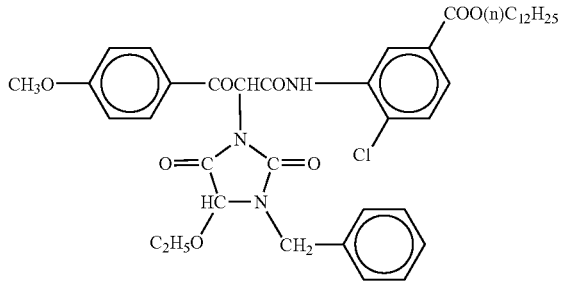

-continued
ExY-3
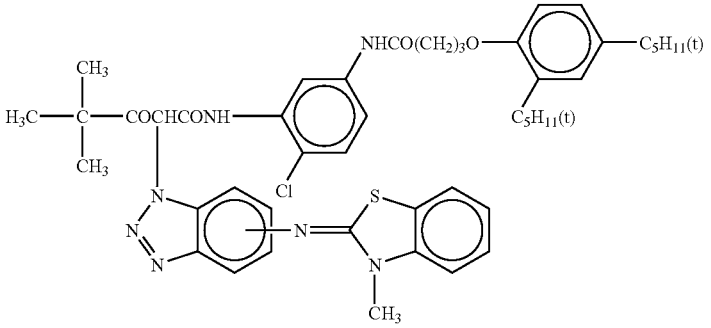
ExY-4
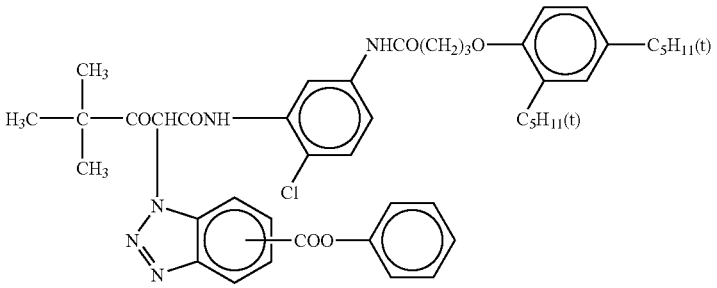
Cpd-1
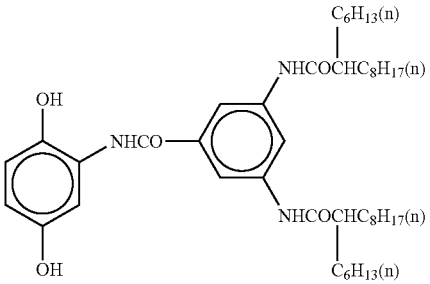
Cpd-2
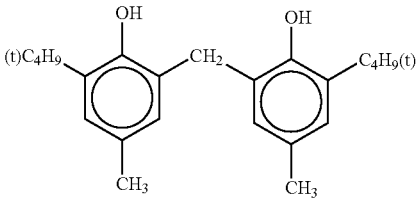
Cpd-3
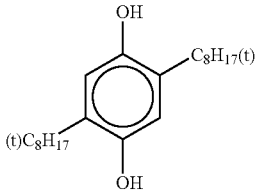
Cpd-4
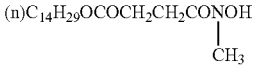
Cpd-5
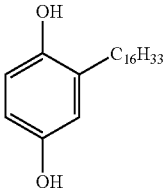
Cpd-6
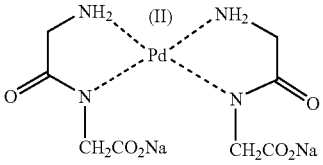
Cpd-7
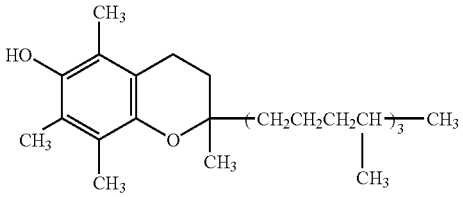
UV-1
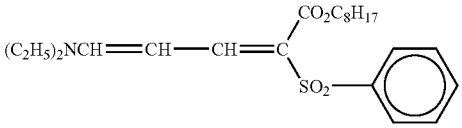

-continued

UV-2

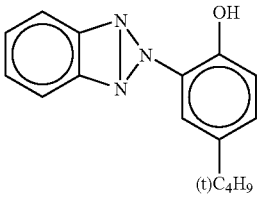

UV-3

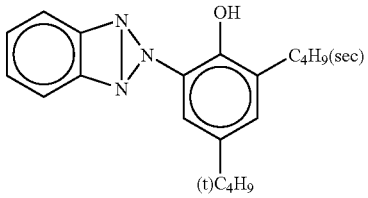

UV-4

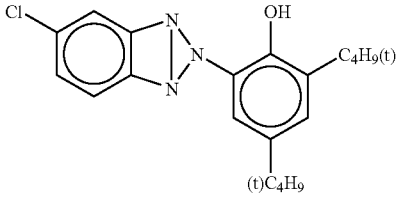

UV-5

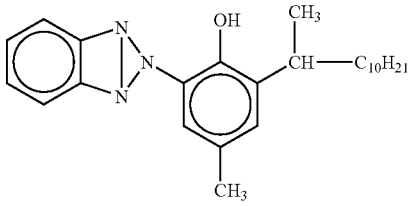

B-1

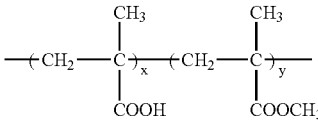

x/y = 10/90 (mass ratio)
Average molecular weight: about 35,000

B-2

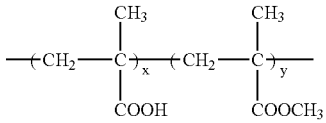

x/y = 40/60 (mass ratio)
Average molecular weight: about 20,000

B-3

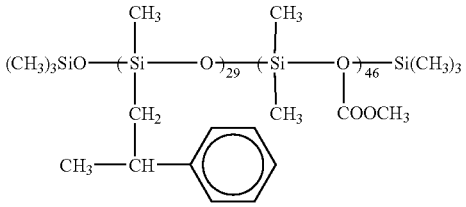

(molar ratio)
Average molecular weight: about 8,000

B-4

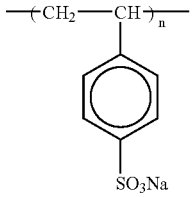

Average molecular weight: about 750,000

B-5

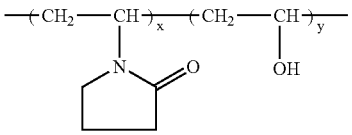

x/y = 70/30 (mass ratio)
Average molecular weight: about 17,000

B-6

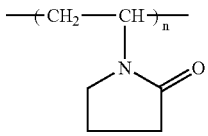

Average molecular weight: about 10,000

HBS-1

Tricresyl phosphate

HBS-2

Di-n-butyl-phthalate

HBS-3

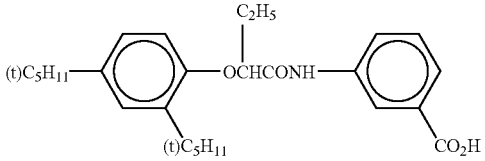

HBS-4

Tri(2-ethylhexyl) phosphate

HBS-5

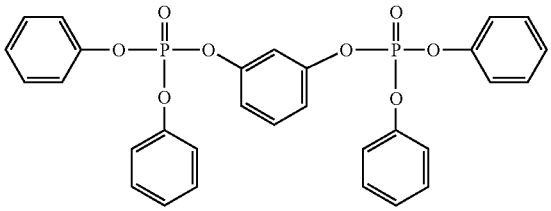

S-1

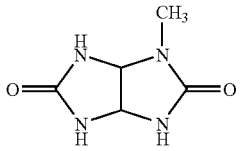

H-1

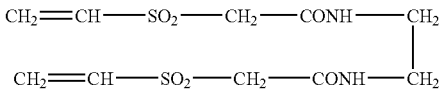

F-1

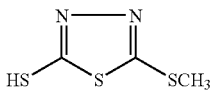

-continued
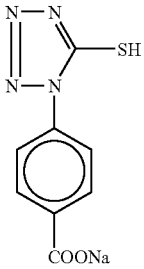
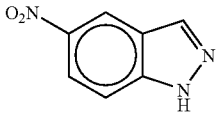
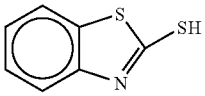
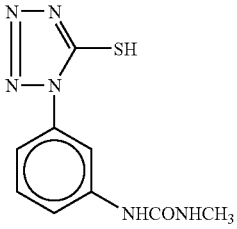
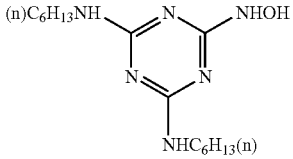
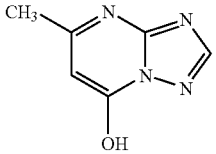
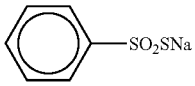
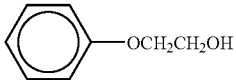
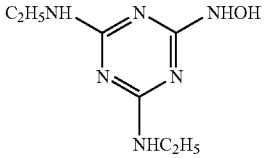
F-2
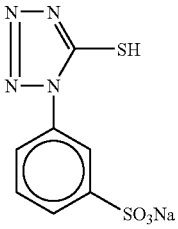
F-3
F-4
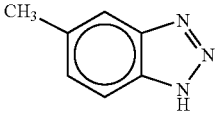
F-5
F-7
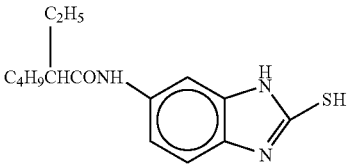
F-8
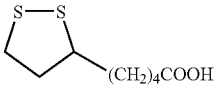
F-9
F-10
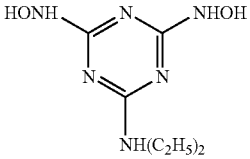
F-11
F-12
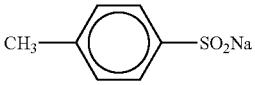
F-13
F-14
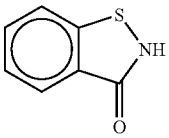
F-15
F-16
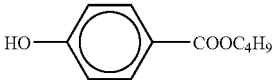
F-17
F-18
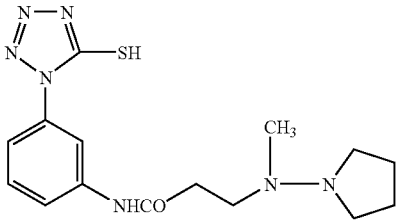
F-19

-continued

W-1

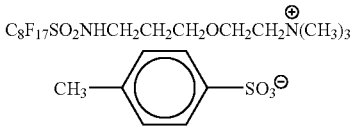

W-2

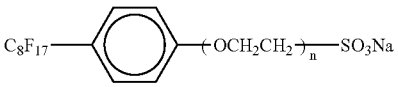

n = 2 ~ 4

W-3

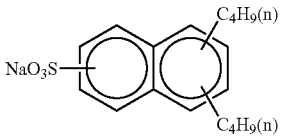

W-4

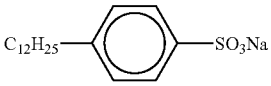

W-5

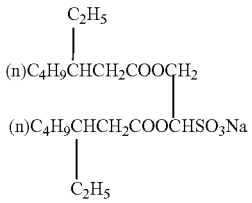

W-6

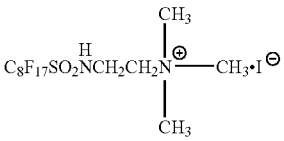

W-7

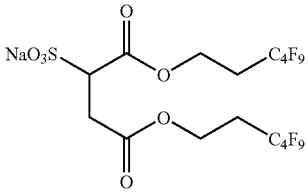

W-8

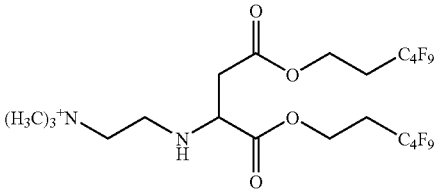

W-9

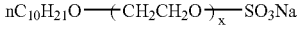

x = 1 ~ 3

W-10

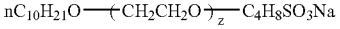

z = 1 ~ 3

W-11

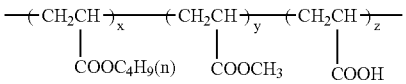

x/y/z = 20/60/20 (mass ratio)
Average molecular weight: about 36,000

The above silver halide color photographic light-sensitive material is designated to as Sample 201.

(Preparation of Samples 202 to 212)

Samples 202 to 212 were prepared in the same manner as Sample 201, except that Compound A in the Emulsion Em-K in the above 14th layer was changed to each compound, as shown in Table 4.

TABLE 4

| Sample | Added compound | Fog | Relative sensitivity | Remarks |
|---|---|---|---|---|
| 201 | Compound A | 0.39 | 100 | Comparative example |
| 202 | Compound B | 0.39 | 106 | Comparative example |
| 203 | Compound C | 0.37 | 98 | Comparative example |
| 204 | Compound D | 0.39 | 101 | Comparative example |
| 205 | Compound 1 according to this invention | 0.31 | 134 | This invention |
| 206 | Compound 14 according to this invention | 0.33 | 131 | This invention |
| 207 | Compound 21 according to this invention | 0.32 | 136 | This invention |

TABLE 4-continued

| Sample | Added compound | Fog | Relative sensitivity | Remarks |
|---|---|---|---|---|
| 208 | Compound 22 according to this invention | 0.30 | 134 | This invention |
| 209 | Compound 31 according to this invention | 0.31 | 133 | This invention |
| 210 | Compound 40 according to this invention | 0.26 | 125 | This invention |
| 211 | Compound 41 according to this invention | 0.28 | 129 | This invention |
| 212 | Compound 43 according to this invention | 0.27 | 128 | This invention |

The above Samples 201 to 212 each were subjected to exposure to light for (1/100) sec, through a continuous wedge and a gelatin filter SC-39 (trade name) manufactured by Fuji Photo Film Co., Ltd.

Each sample after exposure to light was processed with the following method.

[Processing method]

| Step | Processing Time | Processing Temperature |
|---|---|---|
| Color-Developing | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilizing | 30 sec | 38° C. |
| Drying | 4 min 20 sec | 55° C. |

The compositions of the processing solutions are shown below.

| | (Unit, g) |
|---|---|
| (Color-developer) | |
| Diethylenetriaminepentaacetic acid | 1.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)-amino]-2-methylaniline sulfate | 4.5 |
| Water to make | 1.0 liter |
| pH (adjusted using potassium hydroxide and sulfuric acid) | 10.05 |

| | (g) |
|---|---|
| (Bleaching solution) | |
| Ethylenediaminetetraacetate iron(III) sodium trihydrate | 100.0 |
| Disodium ethylenediaminetetraacetate | 10.0 |
| 3-Mercapto-1,2,4-triazole | 0.03 |
| Ammonium bromide | 140.0 |
| Ammonium nitrate | 30.0 |
| Aqueous ammonia (27%) | 6.5 ml |
| Water to make | 1.0 liter |
| pH (adjusted using aqueous ammonia and nitric acid) | 6.0 |
| (Fixing solution) | |
| Disodium ethylenediaminetetraacetate | 0.5 |
| Ammonium sulfite | 20.0 |
| Ammonium thiosulfate aqueous solution (700 g/L) | 295.0 ml |
| Acetic acid (90%) | 3.3 |
| Water to make | 1.0 liter |
| pH (adjusted using aqueous ammonia and nitric acid) | 6.7 |
| (Stabilizing solution) | |
| p-Nonylphenoxypolyglycidol (average polymerization degree of glycidol: 10) | 0.2 |
| Ethylenediaminetetraacetic acid | 0.05 |
| 1,2,4-Triazole | 1.3 |
| 1,4-Bis(1,2,4-triazole-1-ylmethyl)-pyperazine | 0.75 |
| Hydroxyacetic acid | 0.02 |
| Hydroxyethyl cellulose (manufactured by Daicell Chemicals Co., Ltd., HEC SP-2000 (trade name)) | 0.1 |
| 1,2-Benzisothiazoline-3-one | 0.05 |

-continued

| | |
|---|---|
| Water to make | 1.0 liter |
| pH | 8.5 |

(Fog and Yellow Sensitivity of the Light-Sensitive) Material)

The sensitometry curve of each sample that had been subjected to the above processing was found, to compare the value of yellow density fog and the logarithmic value of the inverse number of the exposure amount at (yellow density fog+0.2). Thereby, each sample was evaluated based on those values, which are expressed as relative values when the value of Sample 201 was defined as 100. The smaller the value is, the less the fog is. The larger the relative sensitivity that is shown as to the yellow density is, the higher the sensitivity is, which is preferable.

As is apparent from the results in Table 4, the color negative films containing the silver halide grains, which were chemically sensitized in the presence of the compound represented by formula (1), were remarkably high in sensitivity and quite low in fog.

Example 3

The sample prepared in the same manner as Sample 101 in the above Example 1, was designated to as Sample 301. Samples 302 to 308 were prepared in the same manner as Sample 301, except that Compound A was changed, as shown in Table 5 below.

The thus-obtained samples were processed and evaluated in the same manner as in the above Example 1. The results are shown in Table 5.

As is apparent from the results in Table 5, it is understood that the color papers containing the silver halide grains, which were chemically sensitized in the presence of the compound represented by formula (1), were remarkably high in sensitivity and quite low in the fog density after storage for a long period of time.

TABLE 5

| Sample | Added compound | Relative sensitivity | ΔD | Remarks |
|---|---|---|---|---|
| 301 | Compound A | 100 | 0.06 | Comparative example |
| 302 | Compound B | 102 | 0.05 | Comparative example |
| 303 | Compound C | 101 | 0.05 | Comparative example |
| 304 | Compound D | 98 | 0.04 | Comparative example |
| 305 | Compound 101 according to this invention | 138 | 0.03 | This invention |
| 306 | Compound 103 according to this invention | 134 | 0.03 | This invention |
| 307 | Compound 104 according to this invention | 132 | 0.02 | This invention |
| 308 | Compound 105 according to this invention | 137 | 0.03 | This invention |

Example 4

The silver halide color photographic light-sensitive material prepared in the same manner as Sample 201 in the above Example 2 is designated to as Sample 401.

Samples 402 to 408 were prepared in the same manner as Sample 401, except that Compound A in the Emulsion Em-K in the above 14th layer was changed to each compound, as shown in Table 6.

The thus-obtained samples were processed and evaluated in the same manner as in the above Example 2. The results are shown in Table 6.

TABLE 6

| Sample | Added compound | Fog | Relative sensitivity | Remarks |
|---|---|---|---|---|
| 401 | Compound A | 0.39 | 100 | Comparative example |
| 402 | Compound B | 0.38 | 100 | Comparative example |
| 403 | Compound C | 0.38 | 101 | Comparative example |
| 404 | Compound D | 0.34 | 97 | Comparative example |
| 405 | Compound 101 according to this invention | 0.33 | 138 | This invention |
| 406 | Compound 103 according to this invention | 0.34 | 135 | This invention |
| 407 | Compound 104 according to this invention | 0.26 | 130 | This invention |
| 408 | Compound 105 according to this invention | 0.34 | 135 | This invention |

As is apparent from the results in Table 6, the color negative films containing the silver halide grains, which were chemically sensitized in the presence of the compound represented by formula (1), were remarkably high in sensitivity and quite low in fog.

Example 5

The sample prepared in the same manner as Sample 101 in the above Example 1, was designated to as Sample 501. Samples 502 to 509 were prepared in the same manner as Samples 501, except that Compound A was changed, as shown in Table 7 below.

The thus-obtained samples were processed and evaluated in the same manner as in the above Example 1. the results are shown in Table 7.

As is apparent from the results in Table 7, it is understood that the color papers containing the silver halide grains, which were chemically sensitized in the presence of the compound represented by formula (1), were remarkably high in sensitivity and quite low in the fog density after storage for a long period of time.

TABLE 7

| Sample | Added compound | Relative sensitivity | ΔD | Remarks |
|---|---|---|---|---|
| 501 | Compound A | 100 | 0.06 | Comparative example |
| 502 | Compound B | 101 | 0.05 | Comparative example |
| 503 | Compound C | 102 | 0.05 | Comparative example |
| 504 | Compound 201 according to this invention | 137 | 0.03 | This invention |
| 505 | Compound 202 according to this invention | 134 | 0.02 | This invention |
| 506 | Compound 204 according to this invention | 133 | 0.03 | This invention |
| 507 | Compound 206 according to this invention | 133 | 0.02 | This invention |

TABLE 7-continued

| Sample | Added compound | Relative sensitivity | ΔD | Remarks |
|---|---|---|---|---|
| 508 | Compound 217 according to this invention | 137 | 0.03 | This invention |
| 509 | Compound 218 according to this invention | 139 | 0.02 | This invention |

Example 6

The silver halide color photographic light-sensitive material prepared in the same manner as Sample 201 in the above Example 2 is designated to as Sample 601.

Samples 602 to 609 were prepared in the same manner as Sample 601, except that Compound A in the Emulsion Em-K in the above 14th layer was changed to each compound, as shown in Table 8.

The thus-obtained samples were processed and evaluated in the same manner as in the above Example 2. The results are shown in Table 8.

TABLE 8

| Sample | Added compound | Fog | Relative sensitivity | Remarks |
|---|---|---|---|---|
| 601 | Compound A | 0.39 | 100 | Comparative example |
| 602 | Compound B | 0.39 | 101 | Comparative example |
| 603 | Compound C | 0.38 | 100 | Comparative example |
| 604 | Compound 201 according to this invention | 0.31 | 135 | This invention |
| 605 | Compound 202 according to this invention | 0.28 | 128 | This invention |
| 606 | Compound 204 according to this invention | 0.27 | 127 | This invention |
| 607 | Compound 206 according to this invention | 0.27 | 128 | This invention |
| 608 | Compound 217 according to this invention | 0.30 | 133 | This invention |
| 609 | Compound 218 according to this invention | 0.30 | 136 | This invention |

As is apparent from the results in Table 8, the color negative films containing the silver halide grains, which were chemically sensitized in the presence of the compound represented by formula (1), were remarkably high in sensitivity and quite low in fog.

Example 7

The sample prepared in the same manner as Sample 101 in the above Example 1, was designated to as Sample 701. Samples 702 to 708 were prepared in the same manner as Sample 701, except that Compound A was changed, as shown in Table 9 below.

The thus-obtained samples were processed and evaluated in the same manner as in the above Example 1. The results are shown in Table 9.

TABLE 9

| Sample | Added compound | Relative sensitivity | ΔD | Remarks |
|---|---|---|---|---|
| 701 | Compound A | 100 | 0.06 | Comparative example |
| 702 | Compound B | 105 | 0.05 | Comparative example |
| 703 | Compound C | 100 | 0.05 | Comparative example |
| 704 | Compound D | 102 | 0.06 | Comparative example |
| 705 | Compound 301 according to this invention | 131 | 0.02 | This invention |
| 706 | Compound 302 according to this invention | 133 | 0.02 | This invention |
| 707 | Compound 306 according to this invention | 130 | 0.02 | This invention |
| 708 | Compound 310 according to this invention | 132 | 0.02 | This invention |

As is apparent from the results in Table 9, it is understood that the color papers containing the silver halide grains, which were chemically sensitized in the presence of the compound represented by formula (1), were remarkably high in sensitivity and quite low in the fog density after storage for a long period of time.

Example 8

The silver halide color photographic light-sensitive material prepared in the same manner as Sample 201 in the above Example 2 is designated to as Sample 801.

Samples 802 to 808 were prepared in the same manner as Sample 801, except that Compound A in the Emulsion Em-K in the above 14th layer was changed to each compound, as shown in Table 10.

The thus-obtained samples were processed and evaluated in the same manner as in the above Example 2. The results are shown in Table 10.

TABLE 10

| Sample | Added compound | Fog | Relative sensitivity | Remarks |
|---|---|---|---|---|
| 801 | Compound A | 0.39 | 100 | Comparative example |
| 802 | Compound B | 0.39 | 106 | Comparative example |
| 803 | Compound C | 0.38 | 101 | Comparative example |
| 804 | Compound D | 0.40 | 104 | Comparative example |
| 805 | Compound 301 according to this invention | 0.25 | 122 | This invention |
| 806 | Compound 302 according to this invention | 0.26 | 128 | This invention |
| 807 | Compound 306 according to this invention | 0.25 | 121 | This invention |
| 808 | Compound 310 according to this invention | 0.25 | 127 | This invention |

As is apparent from the results in Table 10, the color negative films containing the silver halide grains, which were chemically sensitized in the presence of the compound represented-by formula (1), were remarkably high in sensitivity and quite low in fog.

Example 9

The sample prepared in the same manner as Sample 101 in the above Example 1, was designated to as Sample 901.

Samples 902 to 907 were prepared in the same manner as Sample 901, except that Compound A was changed, as shown in Table 11 below.

The thus-obtained samples were processed and evaluated in the same manner as in the above Example 1. The results are shown in Table 11.

As is apparent from the results in Table 11, it is understood that the color papers containing the silver halide grains, which were chemically sensitized in the presence of the compound represented by formula (1), were remarkably high in sensitivity and quite low in the fog density after storage for a long period of time.

TABLE 11

| Sample | Added compound | Relative sensitivity | ΔD | Remarks |
|---|---|---|---|---|
| 901 | Compound A | 100 | 0.06 | Comparative example |
| 902 | Compound B | 105 | 0.05 | Comparative example |
| 903 | Compound C | 100 | 0.05 | Comparative example |
| 904 | Compound 402 according to this invention | 138 | 0.03 | This invention |
| 905 | Compound 403 according to this invention | 132 | 0.02 | This invention |
| 906 | Compound 408 according to this invention | 133 | 0.02 | This invention |
| 907 | Compound 415 according to this invention | 136 | 0.03 | This invention |

Example 10

The silver halide color photographic light-sensitive material prepared in the same manner as Sample 201 in the above Example 2 is designated to as Sample 1001.

Samples 1002 to 1007 were prepared in the same manner as Sample 1001, except that Compound A in the Emulsion Em-K in the above 14th layer was changed to each compound, as shown in Table 12.

The thus-obtained samples were processed and evaluated in the same manner as in the above Example 2. The results are shown in Table 12.

TABLE 12

| Sample | Added compound | Fog | Relative sensitivity | Remarks |
|---|---|---|---|---|
| 1001 | Compound A | 0.39 | 100 | Comparative example |
| 1002 | Compound B | 0.39 | 106 | Comparative example |
| 1003 | Compound C | 0.38 | 101 | Comparative example |
| 1004 | Compound 402 according to this invention | 0.34 | 137 | This invention |
| 1005 | Compound 403 according to this invention | 0.28 | 135 | This invention |
| 1006 | Compound 408 according to this invention | 0.29 | 134 | This invention |
| 1007 | Compound 415 according to this invention | 0.32 | 136 | This invention |

As is apparent from the results in Table 12, the color negative films containing the silver halide grains, which were chemically sensitized in the presence of the compound represented by formula (1), were remarkably high in sensitivity and quite low in fog.

Example 11

The sample prepared in the same manner as Sample 101 in the above Example 1, was designated to as Sample 1101. Sample 102 to 1111 were prepared in the same manner as Sample 1101, except that Compound A was changed, as shown in Table 13 below.

The thus-obtained samples were processed and evaluated in the same manner as in the above Example 1. The results are shown in Table 13.

TABLE 13

| Sample | Added compound | Relative sensitivity | ΔD | Remarks |
|---|---|---|---|---|
| 1101 | Compound A | 100 | 0.07 | Comparative example |
| 1102 | Compound E | 105 | 0.12 | Comparative example |
| 1103 | Compound F | 78 | 0.09 | Comparative example |
| 1104 | Compound 2-2 according to this invention | 130 | 0.05 | This invention |
| 1105 | Compound 3-1 according to this invention | 131 | 0.04 | This invention |
| 1106 | Compound 4-1 according to this invention | 128 | 0.02 | This invention |
| 1107 | Compound 4-5 according to this invention | 131 | 0.03 | This invention |
| 1108 | Compound 4-10 according to this invention | 135 | 0.03 | This invention |
| 1109 | Compound 4-11 according to this invention | 134 | 0.03 | This invention |
| 1110 | Compound 4-21 according to this invention | 134 | 0.04 | This invention |
| 1111 | Compound 4-33 according to this invention | 133 | 0.04 | This invention |

Compounds for comparison

Compound E: Compound described in JP-A-2001-75215

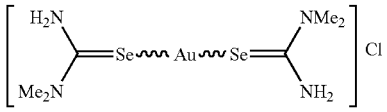

Compound F: Compound described in JP-A-2002-268170

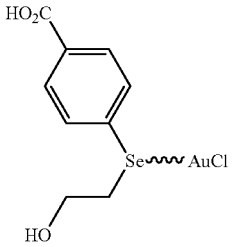

As is apparent from the results in Table 13, it is understood that the color papers containing the silver halide grains, which were chemically sensitized in the presence of the compound represented by formula (6-1), were remarkably high in sensitivity and quite low in the fog density after storage for a long period of time.

Example 12

The silver halide color photographic light-sensitive material prepared in the same manner as Sample 201 in the above Example 2 is designated to as Sample 1201.

Samples 1202 to 1211 were prepared in the same manner as Sample 1201, except that Compound A in the Emulsion Em-K in the above 14th layer was changed to each compound, as shown in Table 14.

The thus-obtained samples were processed and evaluated in the same manner as in the above Example 2. The results are shown in Table 14.

TABLE 14

| Sample | Added compound | Fog | Relative sensitivity | Remarks |
|---|---|---|---|---|
| 1201 | Compound A | 0.39 | 100 | Comparative example |
| 1202 | Compound E | 0.44 | 109 | Comparative example |
| 1203 | Compound F | 0.40 | 76 | Comparative example |
| 1204 | Compound 2-2 according to this invention | 0.37 | 127 | This invention |
| 1205 | Compound 3-1 according to this invention | 0.35 | 129 | This invention |
| 1206 | Compound 4-1 according to this invention | 0.28 | 126 | This invention |
| 1207 | Compound 4-5 according to this invention | 0.29 | 127 | This invention |
| 1208 | Compound 4-10 according to this invention | 0.30 | 131 | This invention |
| 1209 | Compound 4-11 according to this invention | 0.31 | 130 | This invention |
| 1210 | Compound 4-21 according to this invention | 0.33 | 129 | This invention |
| 1211 | Compound 4-33 according to this invention | 0.32 | 129 | This invention |

As is apparent from the results in Table 14, the color negative films containing the silver halide grains, which were chemically sensitized in the presence of the compound represented by formula (6-1), were remarkably high in sensitivity and quite low in fog.

Example 13

The sample prepared in the same manner as Sample 101 in the above Example 1, was designated to as Sample 1301. Further, Samples 1302 to 1307 were prepared in the same manner as Sample 1301, except that Compounds A and HK-1 were changed to Compounds for comparison HK-2 to HK-4 or the compounds for use in the present invention, as shown in Table 15 below.

The thus-obtained samples were processed and evaluated in the same manner as in the above Example 1. The results are shown in Table 15.

TABLE 15

| Sample | Added compound | Relative sensitivity | ΔD | Remarks |
|---|---|---|---|---|
| 1301 | Compounds A, HK-1 | 100 | 0.06 | Comparative example |
| 1302 | Compounds A, HK-2 | 88 | 0.05 | Comparative example |
| 1303 | Compounds A, HK-3 | 89 | 0.05 | Comparative example |
| 1304 | Compounds A, HK-4 | 101 | 0.06 | Comparative example |
| 1305 | Compound A-14 according to this invention | 132 | 0.03 | This invention |
| 1306 | Compound A-22 according to this invention | 131 | 0.03 | This invention |
| 1307 | Compound A-33 according to this invention | 127 | 0.03 | This invention |

HK-1

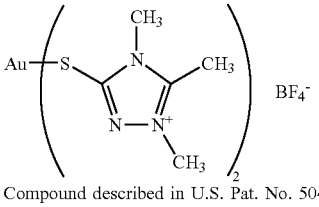

Compound described in U.S. Pat. No. 5049485

HK-2

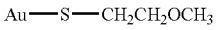

Compound described in JP-A-8-69075

HK-3

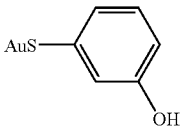

Compound described in JP-A-8-69075

HK-4

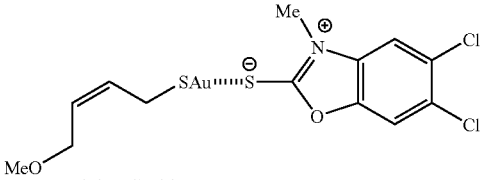

Compound described in U.S. Pat. No. 5912112

As is apparent from the results in Table 15, it is understood that the color papers containing the silver halide grains, which were chemically sensitized in the presence of the compound represented by formula (7) for use in the present invention, were remarkably high in sensitivity and quite low in the fog density after storage for a long period of time.

Example 14

The silver halide color photographic light-sensitive material prepared in the same manner as Sample 201 in the above Example 2 is designated to as Sample 1401.

Samples 1402 to 1408 were prepared in the same manner as Sample 1401, except that Compound A and chloroauric acid in the Emulsion Em-K in the above 14th layer were changed to each compound, as shown in Table 16.

The thus-obtained samples were processed and evaluated in the same manner as in the above Example 2. The results are shown in Table 16.

TABLE 16

| Sample | Added compound | Fog | Relative sensitivity | Remarks |
|---|---|---|---|---|
| 1401 | Compound A, chloroauric acid | 0.40 | 100 | Comparative example |
| 1402 | Compounds A, HK-1 | 0.39 | 104 | Comparative example |
| 1403 | Compounds A, HK-2 | 0.43 | 91 | Comparative example |
| 1404 | Compounds A, HK-3 | 0.42 | 90 | Comparative example |
| 1405 | Compounds A, HK-4 | 0.40 | 104 | Comparative example |
| 1406 | Compound A-14 according to this invention | 0.28 | 127 | This invention |
| 1407 | Compound A-22 according to this invention | 0.27 | 125 | This invention |
| 1408 | Compound A-23 according to this invention | 0.25 | 123 | This invention |

As is apparent from the results in Table 16, the color negative films containing the silver halide grains, which were chemically sensitized in the presence of the compound represented by formula (7) for use in the present invention, were remarkably high in sensitivity and quite low in fog.

Having described our invention as related to the present embodiments, it is our intention that the invention not be limited by any of the details of the description, unless otherwise specified, but rather be construed broadly within its spirit and scope as set out in the accompanying claims.

This nonprovisional application claims priority under 35 U.S.C. § 119 (a) on Patent Application No. 2003-305371 filed in Japan on Aug. 28, 2003, on Patent Application No. 2003-330632 filed in Japan on Sep. 22, 2003, on Patent Application No. 2003-330721 filed in Japan on Sep. 22, 2003, on Patent Application No. 2003-330739 filed in Japan on Sep. 22, 2003, on Patent Application No. 2003-331827 filed in Japan on Sep. 24, 2003, on Patent Application No. 2003-332308 filed in Japan on Sep. 24, 2003, and on Patent Application No. 2003-332351 filed in Japan on Sep. 24, 2003, which are herein incorporated by reference.

We claim:

1. A silver halide emulsion, which is chemically sensitized by a compound represented by formula (1):

$$E^1\text{-Ch-}E^2 \qquad \text{Formula (1)}$$

wherein, in formula (1), Ch represents a sulfur atom, a selenium atom or a tellurium atom; $E^1$ is a group selected from groups represented by formula (3), (4) or (5); and $E^2$ is a group selected from groups represented by formula (5);

Formula (3)

$$-L^1-EWG$$

Formula (4)

$$-\underset{R^6}{\overset{R^5}{C}}-A^1-R^4$$

-continued

Formula (5)

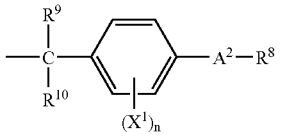

wherein, in formula (3), $L^1$ represents an aliphatic group having 2 to 20 carbon atoms; and EWG represents an electron withdrawing group;

wherein, in formula (4), $A^1$ represents an oxygen atom, a sulfur atom or $NR^7$; and $R^4$, $R^5$, $R^6$ and $R^7$ each independently represent a hydrogen atom, an alkyl group, an alkenyl group, an alkynyl group, an aryl group, or a heterocyclic group; or $R^4$ and $R^5$, $R^4$ and $R^6$, or $R^4$ and $R^7$ may bond together to form a ring;

wherein, in formula (5), $A^2$ represents an oxygen atom, a sulfur atom, or $NR^{11}$; $R^8$ represents a hydrogen atom, an alkyl group, an alkenyl group, an alkynyl group, an aryl group, a heterocyclic group, or an acyl group; $R^9$, $R^{10}$, and $R^{11}$ each independently represent a hydrogen atom, an alkyl group, an alkenyl group, an alkynyl group, an aryl group, or a heterocyclic group; $X^1$ represents a substituent; and n is an integer from 0 to 4; when n is 2 or more, $X^1$s may be the same or different; and wherein when $E^1$ and $E^2$ each represent a group represented by the same formula, $E^1$ and $E^2$ may be the same or different.

2. The silver halide emulsion according to claim 1, wherein, in formula (1), Ch is a selenium atom or a tellurium atom.

3. The silver halide emulsion according to claim 1, wherein, in formula (1), Ch is a selenium atom.

4. The silver halide emulsion according to claim 1, wherein, in formula (1), $E^1$ is a group selected from groups represented by formula (4) or (5).

5. The silver halide emulsion according to claim 1, wherein, in formula (1), $E^1$ is a group selected from groups represented by formula (5).

6. The silver halide emulsion according to claim 1, wherein, in formula (3), the divalent linking group represented by $L^1$ is represented by formula (LA) or (LB):

Formula (LA)

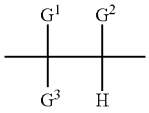

Formula (LB)

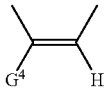

in which, in formulae (LA) and (LB), $G^1$, $G^2$, $G^3$ and $G^4$ each independently represent a hydrogen atom, an alkyl group, an aryl group, or a heterocyclic group; $G^1$ and $G^2$, or $G^2$ and $G^3$ may bond together to form a ring; or EWG and any of $G^1$ to $G^3$ may bond together to form a ring.

7. A silver halide photographic light-sensitive material, comprising:

at least one silver halide emulsion layer on a support, wherein at least one layer of said at least one silver halide emulsion layer contains the silver halide emulsion according to claim 1.

8. A method of chemically sensitizing a silver halide emulsion, comprising:

using at least one compound represented by formula (1):

$E^1$-Ch-$E^2$ Formula (1)

wherein, in formula (1), Ch represents a sulfur atom, a selenium atom or a tellurium atom; $E^1$ is a group selected from groups represented by formula (3), (4) or (5); and $E^2$ is a group selected from groups represented by formula (5);

Formula (3)

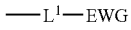

Formula (4)

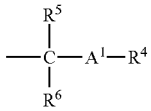

Formula (5)

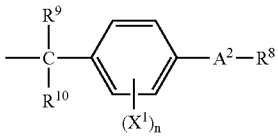

wherein, in formula (3), $L^1$ represents an aliphatic group having 2 to 20 carbon atoms; and EWG represents an electron withdrawing group;

wherein, in formula (4), $A^1$ represents an oxygen atom, a sulfur atom or $NR^7$; and $R^4$, $R^5$, $R^6$ and $R^7$ each independently represent a hydrogen atom, an alkyl group, an alkenyl group, an alkynyl group, an aryl group, or a heterocyclic group; or $R^4$ and $R^5$, $R^4$ and $R^6$, or $R^4$ and $R^7$ may bond together to form a ring;

wherein, in formula (5), $A^2$ represents an oxygen atom, a sulfur atom, or $NR^{11}$; $R^8$ represents a hydrogen atom, an alkyl group, an alkenyl group, an alkynyl group, an aryl group, a heterocyclic group, or an acyl group; $R^9$, $R^{10}$, and $R^{11}$ each independently represent a hydrogen atom, an alkyl group, an alkenyl group, an alkynyl group, an aryl group, or a heterocyclic group; $X^1$ represents a substituent; and n is an integer from 0 to 4; when n is 2 or more, $X^1$s may be the same or different; and wherein when $E^1$ and $F^2$ each represent a group represented by the same formula, $E^1$ and $E^2$ may be the same or different.

9. The silver halide emulsion according to claim 1, wherein, in formula (5), $R^8$ is an alkyl group.

10. The silver halide emulsion according to claim 1, wherein, in formula (5), n is 0.

11. The silver halide emulsion according to claim 1, wherein, in formula (5), $A^2$ is an oxygen atom.

* * * * *